US007123872B2

(12) United States Patent
Shakuto et al.

(10) Patent No.: US 7,123,872 B2
(45) Date of Patent: Oct. 17, 2006

(54) CLEANING DEVICE AND METHOD, IMAGE FORMING APPARATUS, AND PROCESS CARTRIDGE

(75) Inventors: Masahiko Shakuto, Kanagawa (JP); Tohru Nakano, Kanagawa (JP); Masanori Horike, Kanagawa (JP); Osamu Naruse, Kanagawa (JP); Masahiko Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/659,468

(22) Filed: Sep. 11, 2003

(65) Prior Publication Data

US 2004/0105710 A1 Jun. 3, 2004

(30) Foreign Application Priority Data

Sep. 11, 2002 (JP) ..... 2002-265076
Sep. 19, 2002 (JP) ..... 2002-272963
Sep. 24, 2002 (JP) ..... 2002-276613
Mar. 19, 2003 (JP) ..... 2003-075939

(51) Int. Cl.
*G03G 21/00* (2006.01)

(52) U.S. Cl. ..... 399/350

(58) Field of Classification Search ..... 399/350, 399/351, 349
See application file for complete search history.

(56) References Cited

U.S. PATENT DOCUMENTS 4,111,545 A * 9/1978 Meltzer ..... 399/351
4,875,070 A * 10/1989 Hattori ..... 399/350
4,982,240 A * 1/1991 Nakano ..... 399/350
5,842,102 A * 11/1998 Montfort et al. ..... 399/349
5,937,228 A 8/1999 Shoji et al.
6,115,576 A 9/2000 Nakano et al.
6,128,461 A * 10/2000 Yoshikawa ..... 399/350
6,203,962 B1 * 3/2001 Itami et al. ..... 399/350
6,215,974 B1 4/2001 Katoh et al.
6,366,751 B1 4/2002 Shakuto et al.
6,463,254 B1 * 10/2002 Maul et al. ..... 399/350
6,611,672 B1 8/2003 Aoki et al.
6,625,409 B1 9/2003 Shakuto et al.
6,640,073 B1 10/2003 Kurotori et al.
6,654,579 B1 11/2003 Shakuto et al.
6,694,122 B1 * 2/2004 Muto et al. ..... 399/350
6,801,747 B1 * 10/2004 Ogara et al. ..... 399/350
6,836,638 B1 * 12/2004 Muto et al. ..... 399/350
2003/0031488 A1 * 2/2003 Kunishi et al. ..... 399/350
2003/0063928 A1 * 4/2003 Matsuguma

FOREIGN PATENT DOCUMENTS

JP 60-131547 7/1985
JP 62-111489 5/1987
JP 62-201489 9/1987
JP 63-168677 7/1988

(Continued)

OTHER PUBLICATIONS

U.S. Appl. No. 09/949,651, filed Sep. 12, 2001, Kojima et al.

(Continued)

*Primary Examiner*—Susan Lee
(74) *Attorney, Agent, or Firm*—Oblon, Spivak, McClelland, Maier & Neustadt, P.C.

(57) ABSTRACT

A cleaning device includes a blade member having an end that touches an image carrier that caries a toner image made with toner, a vibratable member to which the blade member is fixed, and a vibrating unit that vibrates the vibratable member in such a manner that the end of the blade member does not curl.

75 Claims, 62 Drawing Sheets

FOREIGN PATENT DOCUMENTS

| | | | | |
|---|---|---|---|---|
| JP | 2-221991 | | | 9/1990 |
| JP | 6-4014 | | | 1/1994 |
| JP | 6-51673 | | | 2/1994 |
| JP | 6-148941 | | | 5/1994 |
| JP | 6-308869 | | | 11/1994 |
| JP | 07337042 | A | * | 12/1995 |
| JP | 8-123273 | | | 5/1996 |
| JP | 8-254873 | | | 10/1996 |
| JP | 09034249 | A | * | 2/1997 |
| JP | 11-30938 | | | 2/1999 |
| JP | 11-174922 | | | 7/1999 |
| JP | 11174922 | A | * | 7/1999 |
| JP | 2000-267536 | | | 9/2000 |
| JP | 2001066963 | A | * | 3/2001 |
| JP | 2001-188452 | | | 7/2001 |
| JP | 2002268490 | A | * | 9/2002 |

OTHER PUBLICATIONS

U.S. Appl. No. 10/028,767, filed Dec. 28, 2001, Shakuto et al.
U.S. Appl. No. 10/028,769, filed Dec. 28, 2001, Shakuto et al.
U.S. Appl. No. 10/050,865, filed Jan. 18, 2002, Ohtaka et al.
U.S. Appl. No. 10/098,125, filed Mar. 15, 2002, Miyaguchi et al.
U.S. Appl. No. 10/101,872, filed Mar. 21, 2002, Yoshino et al.
U.S. Appl. No. 10/107,249, filed Mar. 28, 2002, Shakuto et al.
U.S. Appl. No. 10/143,928, filed May 14, 2002, Shakuto et al.
U.S. Appl. No. 10/188,818, filed Jul. 5, 2002, Sasaki et al.
U.S. Appl. No. 10/226,344, filed Aug. 23, 2002, Suzuki et al.
U.S. Appl. No. 10/253,936, filed Sep. 25, 2002, Sugiura et al.
U.S. Appl. No. 10/385,535, filed Mar. 12, 2003, Miyaguchi et al.
U.S. Appl. No. 10/394,025, filed Mar. 24, 2003, Sakai et al.
U.S. Appl. No. 11/011,193, filed Dec. 15, 2004, Nakazato et al.
U.S. Appl. No. 10/942,902, filed Sep. 17, 2004, Watanabe et al.
U.S. Appl. No. 10/943,980, filed Sep. 20, 2004, Naruse et al.
U.S. Appl. No. 11/126,233, filed May 11, 2005, Naruse, et al.
U.S. Appl. No. 11/261,515, filed Oct. 31, 2005, Watanabe et al.
U.S. Appl. No. 11/370,057, filed Mar. 8, 2006, Yamada et al.
U.S. Appl. No. 11/370,823, filed Mar. 9, 2006, Nakagawa et al.
U.S. Appl. No. 11/376,434, filed Mar. 16, 2006, Takahashi, et al.

* cited by examiner

CIRCUMFERENTIAL LENGTH : L1

PARTICLE PROJECTED IMAGE AREA : S

CIRCLE OF AREA : S

CIRCUMFERENTIAL LENGTH : L2

$$\text{SPHERICITY} = \frac{L2}{L1}$$

CLEANING DEVICE AND METHOD, IMAGE FORMING APPARATUS, AND PROCESS CARTRIDGE

BACKGROUND OF THE INVENTION

1) Field of the Invention

The present invention relates to a cleaning device that scraps off the toner on the surface of the image carrier of an image forming apparatus.

2) Description of the Related Art

Image forming apparatuses such as printers, facsimiles, and copiers those use electrophotography to form images are widely used. Such an image forming apparatus has a cleaning device that scraps off toner remaining on a surface of an image carrier after the toner is transferred. Sometimes the toner is collected and recycled.

The cleaning device includes a cleaning blade. This cleaning blade is generally made of an elastic material such as rubber. This is because, the cleaning blade made of rubber has a simple structure and it can scrap off the toner very effectively.

It is known, that better image quality is achieved if the particles of the toner are spherical (hereafter, "spherical toner"). Therefore, the spherical toner is becoming popular. The spherical toner is produced by polymerization. To improve the image quality, the approaches are to reduce the particle size of the toner (hereafter, "toner size") or to use more spherical particles.

However, if the toner size is too small or if the toner is perfectly spherical, the cleaning device can not completely scrap off the toner. If the toner remains on the image carrier, the image quality degrades, and the toner flies here and there inside the device. Particularly, the toner remaining on the image carrier gets stick to a charger that electrically charges the image carrier.

The spherical toner with particles having sphericity of 1 or close to 1 is particularly difficult to scrap off. Even if the average sphericity of the particles is 0.95 or less, the toner includes particles of sphericity of 1 or close to 1 and makes the toner difficult to scrap off.

Environmental temperature also affects the cleaning capability. The image forming apparatuses are installed in places where the temperature is between 10° C. and 30° C. However, the cleaning capability worsens as the temperature drops.

JP-A No. 2001-188452 discloses in detail why the fine toner or spherical toner is difficult to scrap off. In general the reasons are as follows.

When the blade made of rubber is used, the edge of the rubber blade bends as the blade slides on the image carrier. Consequently, a wedge-shaped space is formed between the blade and the image carrier. Toner enters into this space. More toner enters into this space if the toner is fine. Moreover, more toner enters into this space if the particles are spherical.

Once the toner enters into this space, it remains there almost permanently. In other words, a "non-flow region" is formed in this space. When the frictional resistance between the toner in the non-flow region and the image carrier is small and the toner smoothly slide over the image carrier, faulty cleaning does not occur. However, if the friction increases, due to say separation of an external additive from the toner because when the toner slides against the image carrier, the spherical particles start rolling because the frictional force of spherical particles is smaller than irregular particles. As a result, some of the particles come out of the non-flow region and disadvantageously remain at the surface of the image carrier.

Japanese Patent Application Laid Open (JP-A) No. 2001-188452 discloses a technology to solve this problem. The cleaning device disclosed in this publication includes a blade and a brush. The blade scrapes off the toner on the photoreceptor. The brush is disposed on the upstream side, with respect to the direction in which the photoreceptor moves, of the blade. This brush pulverizes the remaining toner and creates fine-grained toner particles.

JP-A No. 2000-267536 also discloses a technology to solve the problem described above. The image forming apparatus disclosed in this publication includes a toner image carrier and a transfer device. The toner image carrier rotates so that the surface, which carries the toner image formed with the spherical toner, of the toner image carrier passes through a region (hereafter, "transfer region") in which the toner image is transferred and a region (hereafter, "cleaning region") in which the toner is scraped off. In the transfer region, the transfer device transfers the toner image onto a transfer material. In the cleaning region, a blade having an edge, which makes a contact with the surface of the image carrier, scraps the toner. A cleaner is applied to the edge of the blade. This cleaner is a mixture of powdered lubricant and toner having irregular particles and an average particle size smaller than that of the spherical toner.

JP-A No. SHO 62-111489 also discloses a cleaning device. The cleaning device disclosed in this publication includes a blade that scraps off the toner and a vibrator that vibrates the blade. Any toner or foreign particles remaining on the blade fall down as the blade vibrates.

JP-A No. HEI 6-51673 also discloses a cleaning device. The cleaning device disclosed in this publication includes a vibrator that comes in contact with a photoreceptor that caries the toner image. The vibrator vibrates the photoreceptor.

JP-A No. HEI 11-30938 also discloses a cleaning device. The cleaning device disclosed in this publication includes a blade, one end of which is fixed, that scraps off the toner and a vibrator that vibrates the fixed end of the blade. Any toner or foreign particles remaining on the photoreceptor fall down as the photoreceptor vibrates.

JP-A No. SHO 60-131547, JP-A No. HEI 6-148941, and JP-A No. HEI 8-254873 teach to use toner that includes the spherical toner and a toner containing irregular-shaped particles (hereinafter, "irregular toner").

JP-A No. 2001-188452 requires the cleaning brush. This causes the size and the cost of the image forming device to increase. Moreover, it is quite difficult to pulverize the toner made of resin. Even if the toner can be pulverized, the toner damages the surface of the image carrier. The image quality degrades if the image carrier is damaged.

JP-A No. 2000-267536 teaches to use the mixture of powdered lubricant and toner having irregular-shaped particles and an average particle size smaller than that of the spherical toner. However, as the mixture is used, the image quality degrades in comparison when the spherical toner is used.

JP-A No. SHO 62-111489, JP-A No. HEI 6-51673, and JP-A No. HEI 11-30938 teach to use a vibrator to vibrate either the blade or the image carrier. However, these cleaning devices do not cope with a mechanism of occurrence of faulty cleaning for spherical toner, and therefore, the toner is not scrapped off completely (hereafter, "faulty cleaning").

The inventors of the present invention studied why the faulty cleaning takes place in the cleaning blade of a counter type when the spherical toner was used. Their study showed that the reasons are as follows.

FIG. 53 illustrates a typical cleaning device of the counter type that scraps off the toner remaining (hereafter, "residual toner") on an image carrier 111. A metal holder 100 holds a cleaning blade 101 in the following manner. That is, an edge of the cleaning blade 101 touches a surface of the image carrier 111, the cleaning blade 101 makes an acute angle θ with a tangent to the surface of the image carrier 111 in an opposite direction (i.e., counter direction) with respect to the direction of rotation (hereafter, "rotating direction") A of the image carrier. That is, the flat part 101*c* of the cleaning blade 101 and the surface of the image carrier 111 form an angle. The edge of the cleaning blade 101 is pressed against the image carrier 111 for a distance d.

The cleaning blade 101 is made of elastic material with polyurethane rubber as the main component. The cleaning blade 101 generally has JISA hardness of 65 degrees to 70 degrees, thickness of about 1.5 millimeters to 2.0 millimeters, free length (i.e., length from the metal holder 100 to the edge of the cleaning blade 101) of 8 millimeters to 15 millimeters, and the angle θ is 20 degrees to 30 degrees.

When the image carrier 111 rotates, as illustrated in FIG. 54, an edge part 101*b* of a cut face 101*a* of the cleaning blade 101 is pulled in the rotating direction A, as the cleaning blade 101 is made of the elastic material, due to a frictional force with the image carrier 111. As a result, the cut face 101*a* deforms in the form of a curl. Because of such distortion, a wedge-shaped space is produced between the cut face 101*a* and the image carrier 111.

FIG. 55 is an enlarged view of a nip portion N shown in FIG. 54. Considering that the toner is the irregular toner, the toner Ta enters into the wedge-shaped space. The toner particles make a stick-slip movement in this space.

The stick-slip movement is explained with reference to FIG. 56. When a nip formed by the blade toward the image carrier ("blade nip") is fixed on the moving surface of the image carrier, the blade nip is forcefully expanded in the rotating direction of the image carrier 111 as shown by a broken line in FIG. 56. When the blade nip is expanded to a certain position, the repulsive force of the blade is increased to such an extent that the static frictional force and the repulsive force are balanced. At this point in time, the blade nip slides over the surface of the image carrier. In a state where sliding occurs between the blade nip and the image carrier, the coefficient of dynamic friction is smaller than the coefficient of static friction, and thereby the blade nip returns to the original direction (direction indicated by a solid line) while sliding over the surface of the image carrier. By the restoring force of the stick-slip movement repeatedly performed (the range is indicated by SP), the toner Ta staying in the wedge-like nip undergo the force of returning in the direction opposite to the preceding direction of the image carrier 111, and is cleaned.

On the other hand, if the toner is the spherical toner, as illustrated in FIG. 57, the toner Tb does not remain in wedge-shaped space because the toner Tb has spherical shape. The toner Tb rotates in this space due to the frictional force with the image carrier 111. Therefore, the toner Tb moves along with the image carrier 111 while rotating in the direction reverse to the rotating direction A of the image carrier 111, and passes through the nip between the cleaning blade 101 and the image carrier 111. This results into faulty cleaning.

Moreover, the toner Tb that passes through the nip function as a lubricant and, as illustrated in FIG. 58, reduces the frictional force between the cleaning blade 101 and the image carrier 111. This makes the tip of the cleaning blade 101 flat (as against curly). As a result, the toner Tb does not undergo the stick-slip movement. This results into faulty cleaning.

The fine toner more easily enters into the nip as illustrated in FIG. 57. Moreover, even if the particles are irregular shapes, they do not have so many edges. Therefore, the fine toner easily passes through the nip.

The inventors further studied on the mechanism of occurrence of faulty cleaning for the spherical and fine toner based on the mechanism of the occurrence previously found by the inventors. As a result of the study, the inventors have found that a new mechanism different from the conventional cleaning mechanism allows the spherical and fine toner to be cleaned.

In the blade cleaning method (cleaning method using the cleaning blade), it is generally known that the toner cleaning capability is enhanced, in other words, the capability of sliding contact is increased and therefore the frictional resistance between the blade and the image carrier tends to be increased.

Particularly, if no residual toner remains on the image carrier after toner transfer, the frictional resistance between the blade (edge) part and the image carrier extremely increases. If the frictional resistance is very high, the blade is pulled to the image carrier, and a so-called "warping" occurs, which may prevent the cleaning capability from being fully delivered.

In the cleaning method using the blade, the image carrier is slid by the rubber blade as explained above to scrape the toner off the image carrier. Therefore, the edge front of the rubber blade is deformed by the frictional resistance between the image carrier and the rubber blade, and a fine wedge-like space is formed between the two. Since forming the wedge-like region is important for the cleaning, formation of the blade edge is largely related to the cleaning capability.

However, if the frictional resistance between the blade edge and the image carrier is too high, the "warping" occurs, and in addition to this, the edge part essential to the cleaning may be chipped. Therefore, it is preferable to maintain the edge part while minimum frictional resistance required for the cleaning is ensured and maintained in terms of durability. However, the cleaning unit using the conventional cleaning blade has a problem such that the unit cannot ensure and maintain such minimum frictional resistance required for the cleaning.

Furthermore, the inventors have found that deficiency also occurs to the image carrier other than the chipping of the blade edge. The deficiency is caused by an increase in the frictional resistance between the blade edge and the image carrier.

An example of the deficiency includes filming such that the toner is elongated by the blade over the surface of the image carrier to form a toner film layer on the image carrier, and film scraping of a photoreceptive layer forming the image carrier. Since the filming is formed on the photoreceptive layer, the filming becomes an obstacle when an accurate image is formed on the photoreceptor. Further, the film scraping causes the durability of the image carrier to be reduced. Therefore, it is necessary that the deficiencies are prevented to occur as less as possible. There is also a case where the film scraping is proceeding when the filming occurs, and in this case, sometimes, only the film scraping seems to occur, depending on the case.

It has been found that these deficiencies occur in the image forming apparatus using the cleaning blade because the frictional resistance between the blade and the image carrier is high.

SUMMARY OF THE INVENTION

It is an object of the present invention to solve at least the problems in the conventional technology.

A cleaning device, for cleaning toner from an image carrier that carries a toner image made of toner, according to one aspect of the present invention includes a blade member having an end, wherein the end touches a surface of the image carrier and scraps off toner from the surface; a vibratable member to which the blade member is fixed; and a vibrating unit that vibrates the vibratable member so that the end of the blade member does not curl.

A cleaning device, for cleaning toner from an image carrier that carries a toner image made of toner, according to another aspect of the present invention includes a blade member having an end, wherein the end is pressed against a surface of the image carrier for a specified amount to thereby scrap off toner from the surface; a vibratable member to which the blade member is fixed; and a vibrating unit that vibrates the vibratable member in such a manner that amplitude of the vibrations is smaller than the specified amount for which the blade member is pressed against the surface of the image carrier.

A cleaning device, for cleaning toner from an image carrier that carries a toner image made of toner, according to still another aspect of the present invention includes a blade member having an end, wherein the end is pressed against a surface of the image carrier for a specified amount to thereby scrap off toner from the surface; a vibratable member to which the blade member is fixed; and a vibrating unit that vibrates the vibratable member in such a manner that toner that is not in contact with the end of the blade member is vibrated.

A process cartridge according to still another aspect of the present invention includes an image carrier that carries a toner image made of toner; and the cleaning unit according to the above mentioned aspects of the present invention.

An image forming apparatus according to still another aspect of the present invention includes an image carrier that carries a toner image made of toner; and the cleaning unit according to the above mentioned aspects of the present invention.

In an image forming apparatus according to still another aspect of the present invention, a latent image is formed on an image carrier, the latent image is developed with a toner having sphericity of 0.96 to 1.00 based on a flow type particle image analyzer (FPIA), the toner image is transferred onto a recording medium. This image forming apparatus includes a blade member having an end, wherein the end touches a surface of the image carrier; a vibratable member to which to the blade member is fixed; and a vibrating unit that, after the toner image is transferred onto the recording medium, vibrates the vibratable member so that the end of the blade member vibrates to thereby clean toner remaining on the image carrier.

A cleaning device according to still another aspect of the present invention includes a blade member having an end, wherein the end touches a surface of a image carrier that carries a toner image made of toner having sphericity of 0.96 to 1.00 based on a flow type particle image analyzer; a vibratable member to which the blade member is fixed; and a vibrating unit that vibrates the vibratable member so that the end of the blade member vibrates to thereby clean the toner on the image carrier.

A process cartridge according to still another aspect of the present invention includes an image carrier that carries a toner image made of toner; and the cleaning unit according to the above mentioned aspects of the present invention.

An image forming apparatus according to still another aspect of the present invention includes a plurality of process cartridges, wherein each process cartridge has a configuration as described in the above mentioned aspects of the present invention.

In an image forming apparatus according to still another aspect of the present invention, a toner image is formed on an image carrier with a toner having sphericity of 0.96 to 1.00 based on a flow type particle image analyzer (FPIA). This image forming apparatus includes a cleaning unit. This cleaning unit includes a blade member having an end, wherein the end touches a surface of the image carrier; a vibratable member to which the blade member is fixed; and a vibrating unit that vibrates the vibratable member so that the end of the blade member vibrates to thereby clean toner remaining on the image carrier. Friction between the image carrier and the blade member is less when the vibrating unit vibrates the vibratable member than when the vibrating unit does not vibrate the vibratable member.

A cleaning device according to still another aspect of the present invention includes a blade member having a first end and a second end, wherein the first end touches a surface of an image carrier that carries a toner image made of toner; a vibratable member to which to the second end of the blade member is fixed; and a vibrating unit that vibrates the vibratable member so that the first end of the blade member vibrates to thereby clean the toner from the surface of the image carrier. Friction between the image carrier and the blade member is less when the vibrating unit vibrates the vibratable member than when the vibrating unit does not vibrate the vibratable member.

A process cartridge according to still another aspect of the present invention includes an image carrier that carries a toner image made of toner; and the cleaning unit according to the above mentioned aspects of the present invention.

An image forming apparatus according to still another aspect of the present invention includes a plurality of process cartridges, wherein each process cartridge has a configuration as described in the above mentioned aspects of the present invention.

A method of cleaning, according to still another aspect of the present invention, is a method of cleaning toner remaining on an image carrier, wherein the toner having sphericity of 0.96 to 1.00 based on a flow type particle image analyzer. The method includes fixing a blade member, having an end, to a vibratable member such that the end of the blade member touches the image carrier; and vibrating the vibratable member so that the end of the blade member vibrates to thereby clean the toner on the image carrier.

The other objects, features and advantages of the present invention are specifically set forth in or will become apparent from the following detailed descriptions of the invention when read in conjunction with the accompanying drawings.

DETAILED DESCRIPTION

Exemplary embodiments of a cleaning device, a cleaning method, an image forming apparatus, and a process cartridge of the present invention will be explained in detail below with reference to the accompanying drawings.

A new cleaning mechanism of a cleaning device according to the present invention will be explained first with reference to FIG. 1. The cleaning device is structured to efficiently vibrate a front region of a blade member 1. The vibration by the blade member 1 is transmitted to toner particles ("toners") T present between the front region of the blade member 1 and an image carrier 11, and the vibration of the front region of the blade member 1 is transmitted to the image carrier 11. The vibration is also transmitted from the image carrier 11 to the toners T.

These vibrating operations are different from those in a conventional cleaning device. That is, vibration is produced so that a nip part of the blade member 1 is formed or moved differently from that of the cleaning device using the conventional vibrating operation, and it is thereby possible to prevent the spherical toner and fine toner from entering the blade nip part, and to eliminate faulty cleaning for the spherical toner and the fine toner.

Figure 1:
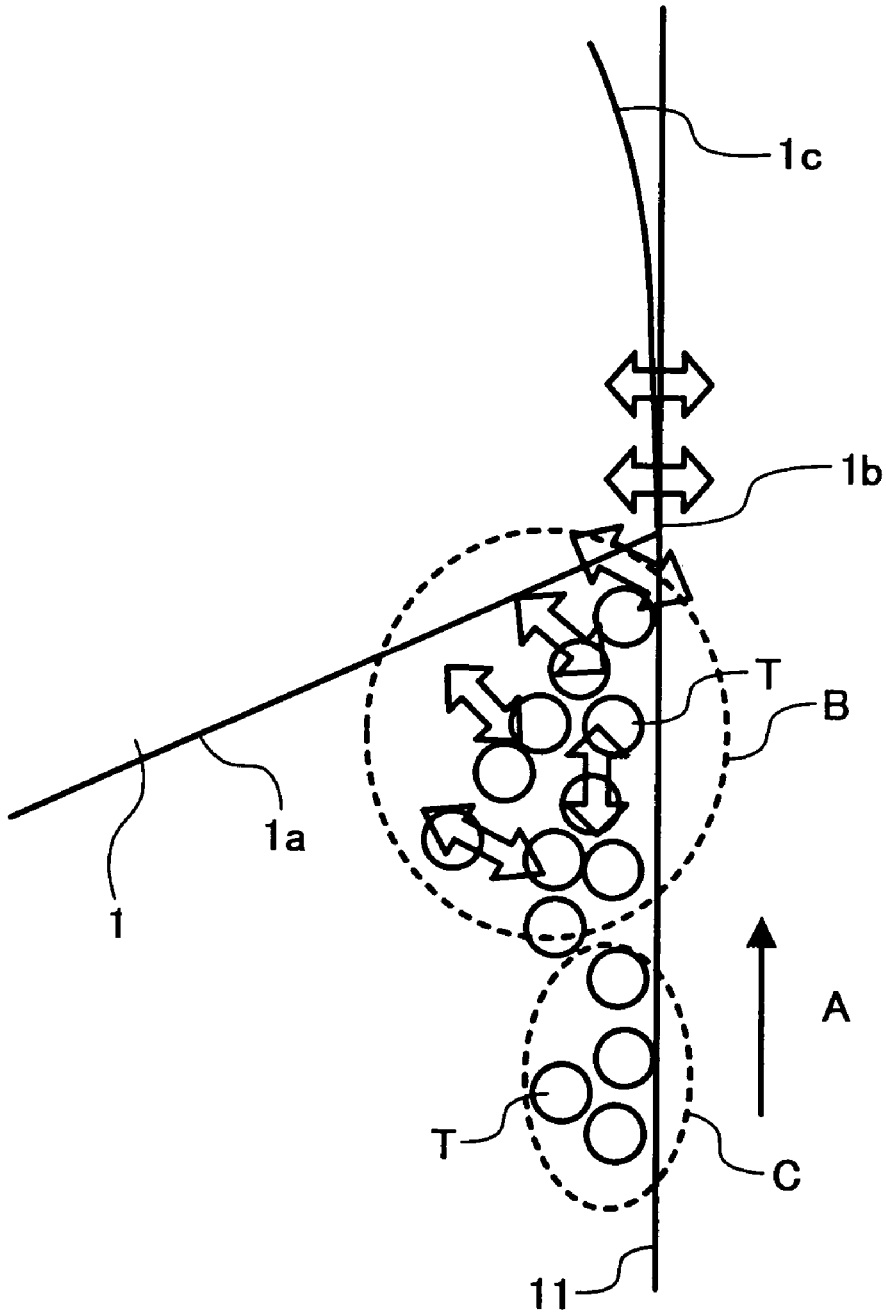
FIG. 1 illustrates a cleaning mechanism of a cleaning device according to the present invention.

FIG. 1 illustrates how the blade member 1 is vibrated, the vibration of the member 1 is transmitted to the spherical toners T, and the toners T are actively vibrating (indicated by hollow arrows in the figure). This figure illustrates the results of observing the toners by a high-speed video camera through a microscope with a high magnification. As illustrated in FIG. 1, it has been clear from the observation that curling of the cut face does not occur in the blade member 1 and the edge part 1*b* of the cut face 1*a* keeps its initial form with respect to the surface of the image carrier. Reference numeral 1*c* in FIG. 1 denotes a flat face (the face opposite to the surface of the image carrier 11) of the blade member 1.

It has been also found from the observation that the spherical toners T near the front cut face 1*a* of the blade member 1 and the image carrier 11 are vibrating over a region including several toner particles (the region of B part in FIG. 1).

In such a state, a toner group (toners in the B part) that is vibrating near the nip part acts like a barrier (wall of vibrating toners), and prevents subsequent toners T (toners in C part in FIG. 1) on the image carrier 11 from entering the nip. Thus, faulty cleaning even for the spherical toners, which is perfectly spherical, is prevented.

Figure 57:
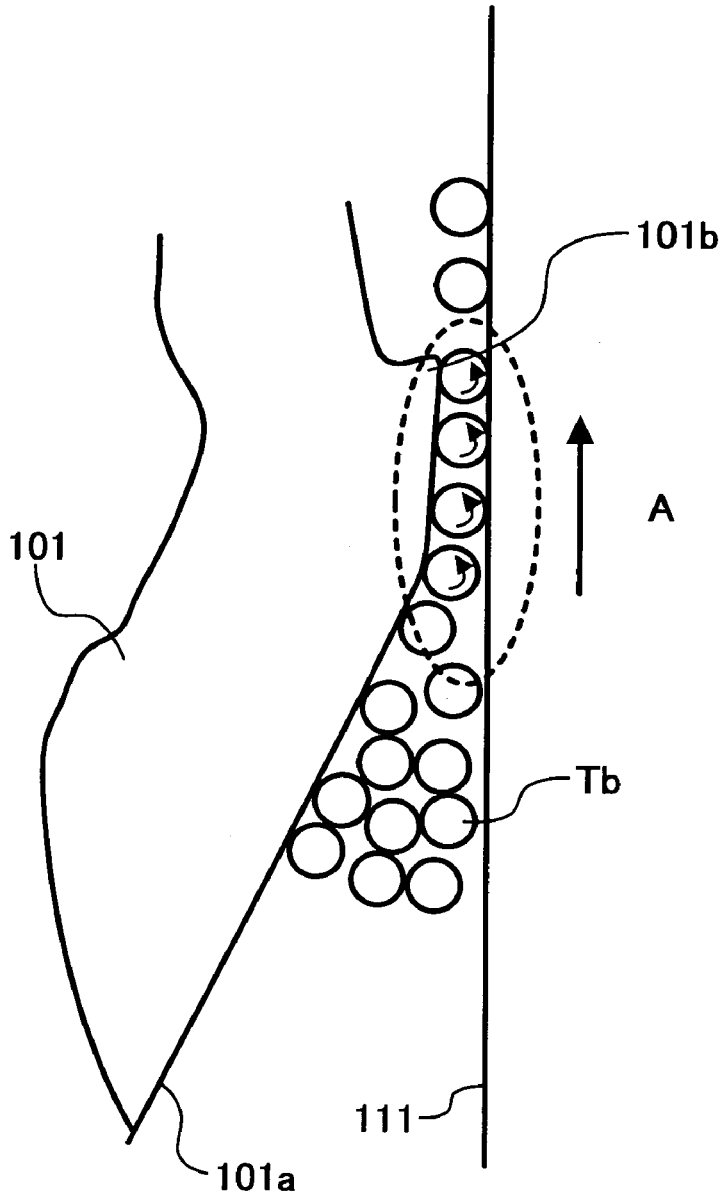
BACKGROUND ART FIG. 57
FIG. 57 illustrates a mechanism of occurrence of faulty cleaning for spherical toner when the same cleaning blade is used.
Figure 58:
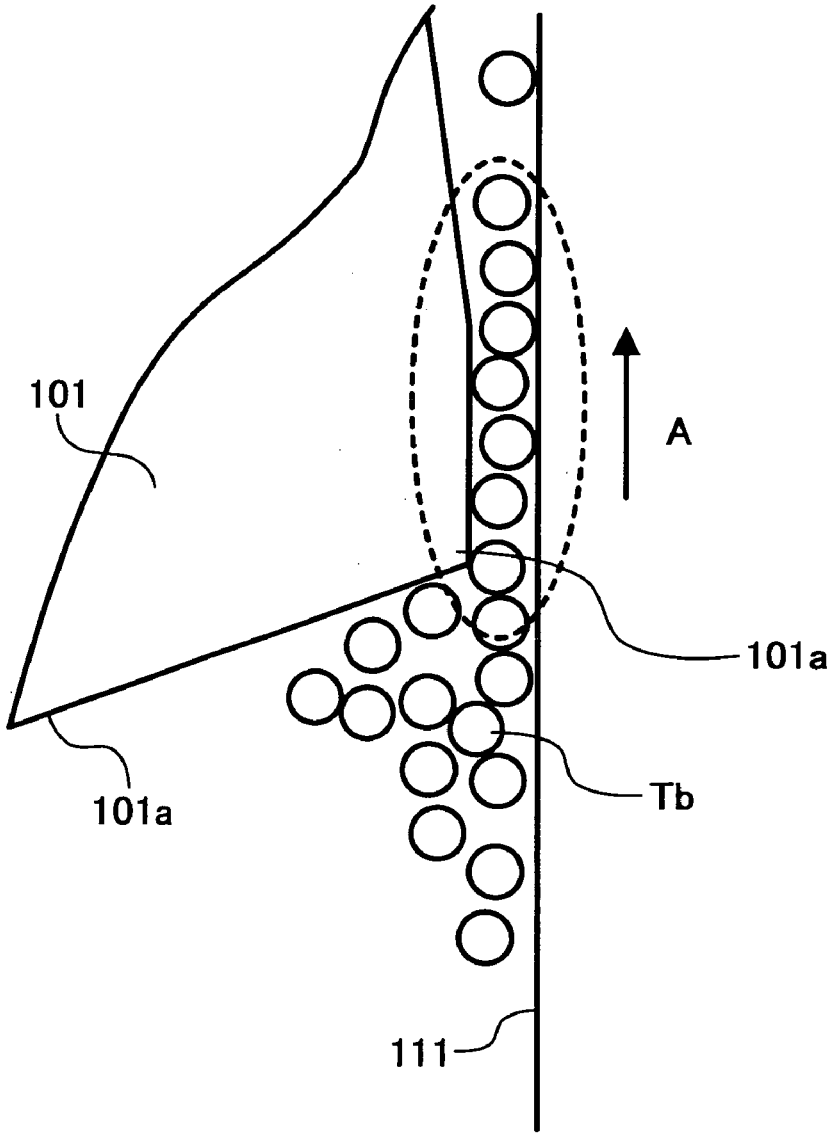
BACKGROUND ART FIG. 58
FIG. 58 illustrates a mechanism of occurrence of faulty cleaning for spherical toner when the same cleaning blade is used.

The inventors realized that there was condition of eliminating the "curling" of the cut face 1*a* of the blade member 1, which occurred in the conventional system. The condition is such that the vibration of the blade member 1 is transmitted also from the blade member 1 to the image carrier 11 and the frictional force between the blade member 1 and the image carrier 11 is thereby reduced. The "curling of the cut face" mentioned here means that the cut face is deformed as the image carrier moves and is brought into contact with the surface of the image carrier (the above-mentioned state shown in FIG. 57), although a blade member as follows is generally used, that is the member is obtained by cutting a molded elastic member in the thickness direction, and finishing the member being sharp in shape with the edge thereof having neither burr nor chipped portion.

By eliminating the occurrence of curling of the cut face, the stress from the blade member 1 to the image carrier 11 is reduced. Thus, it has been also found that an extremely advantageous effect is obtained, that is, the durability of the blade member 1 and the image carrier 11 is significantly improved.

Figure 2:
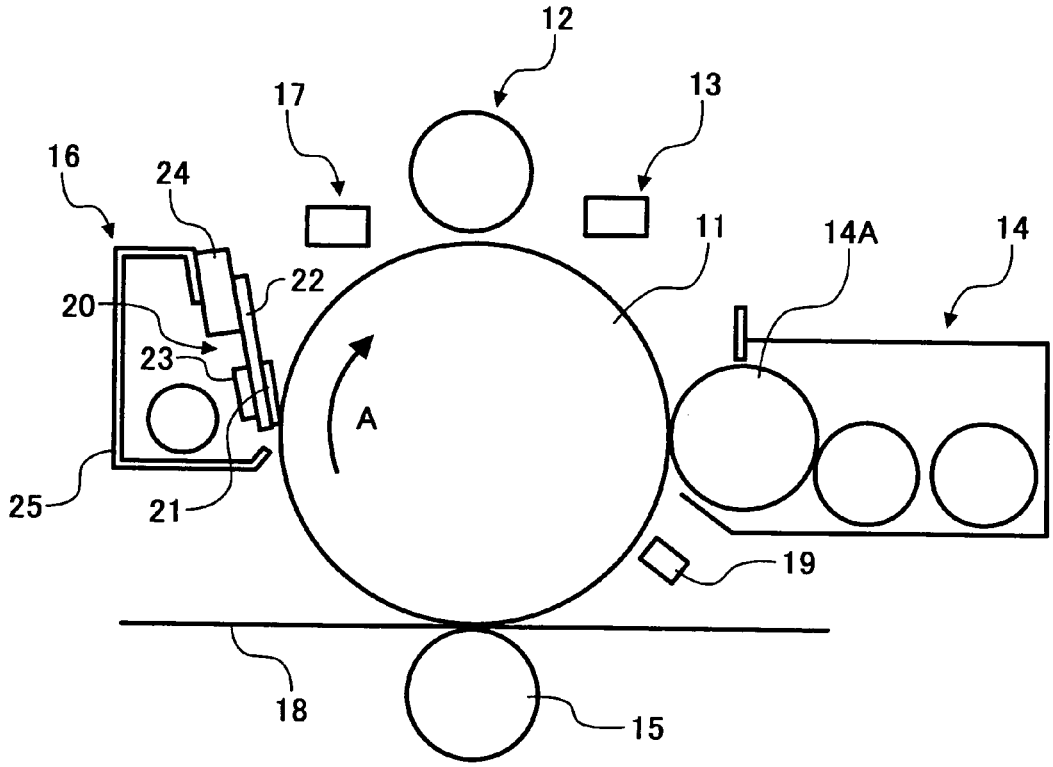
FIG. 2 illustrates a schematic structure of an image forming apparatus having a cleaning device according to a first embodiment of the present invention.

FIG. 2 illustrates the image forming apparatus having the cleaning device of the present invention. This image forming apparatus includes the image carrier 11 that rotates in the direction of the arrow A. A charging unit 12, an exposing unit 13, a developing unit 14, a transfer unit 15, a cleaning device 16, and a decharging unit 17 are arranged around the image carrier 11. A fixing unit, which has not been shown here, fixes a toner image on a transfer material 18 to which the image is transferred from the image carrier 11.

The charging unit 12 is movable so as to make a contact with the surface of the image carrier 11 or separate from the image carrier 11 at a predetermined distance. The charging unit 12 applies a bias voltage to the image carrier 11 to electrically charge the image carrier 11 with a predetermined potential to a predetermined polarity.

The exposing unit 13 includes a laser diode (LD) or a light-emitting diode (LED). The exposing device 13 radiates light, on the image carrier 11, in accordance with the image data. As a result, an electrostatic latent image is formed on the image carrier 11.

The developing unit 14 includes a magnetic roller and a rotatable developer carrier 14A that carries the developer. The developer may be a two-component developer that includes toner and carrier or a one-component developer that includes only toner.

A bias source (not shown) applies a bias voltage to the developer carrier 14A. The developer (i.e., the toner) in the developer carrier 14A gets charged because of this voltage. There is a difference in the bias voltage of the image carrier 11 and the developer carrier 14A. Because of this voltage difference, the charged toner in the developer carrier 14A gets stick to the electrostatic latent image on the surface of the image carrier 11. The toner stuck electrostatic latent image is called as a toner image.

The toner image is then transferred. When transferring the toner image, the transfer unit 15 is pressed against the surface of the image carrier 11 while a medium 18 is sandwiched between the transfer unit 15 and the image carrier. The transfer unit 15 is charged. As a result, the toner image is transferred to the medium 1 8. The transfer unit 15 may be a roller, a colotron, or a belt.

The cleaning device 16 includes a blade member 21, a vibratable member 22, and a vibrating unit 23, and a section formed with these members is referred to as "vibrating blade 20". The blade member 21 is vibrated to remove residual toner from the surface of the image carrier 11. The removed toner is conveyed with a conveying mechanism to container (not shown). A service person collects the container to recycle the toner. The toner in this container may be transported to a developer carrier 14A and used again.

The decharging unit 17 decharges the image carrier 11 after the toner image has been transferred to the medium 18. A photo-decharging system employing an LED may be used to decharge the image carrier 11.

Figure 3:
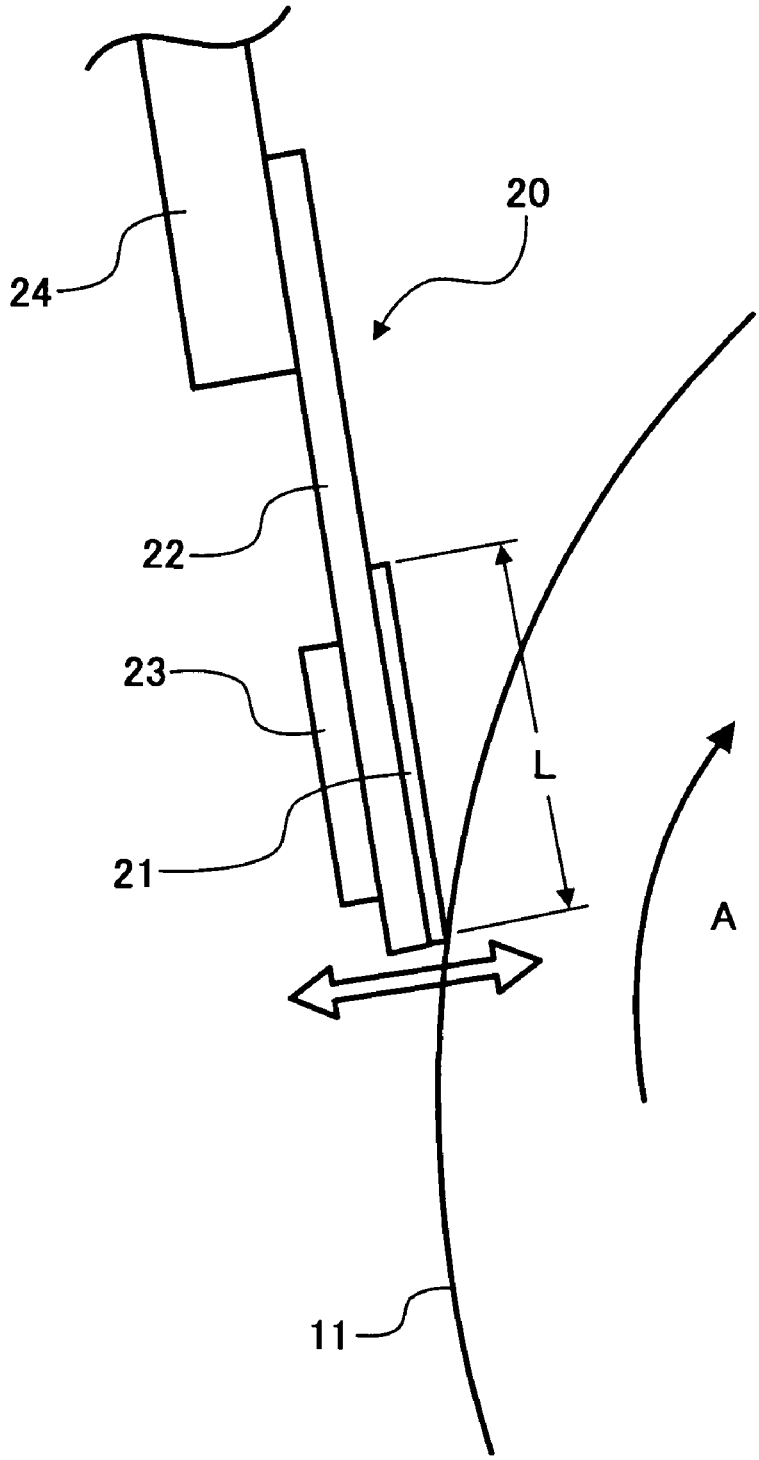
FIG. 3 illustrates a key structure of a vibrating blade in the cleaning device according to a first embodiment of the present invention.
Figure 4:
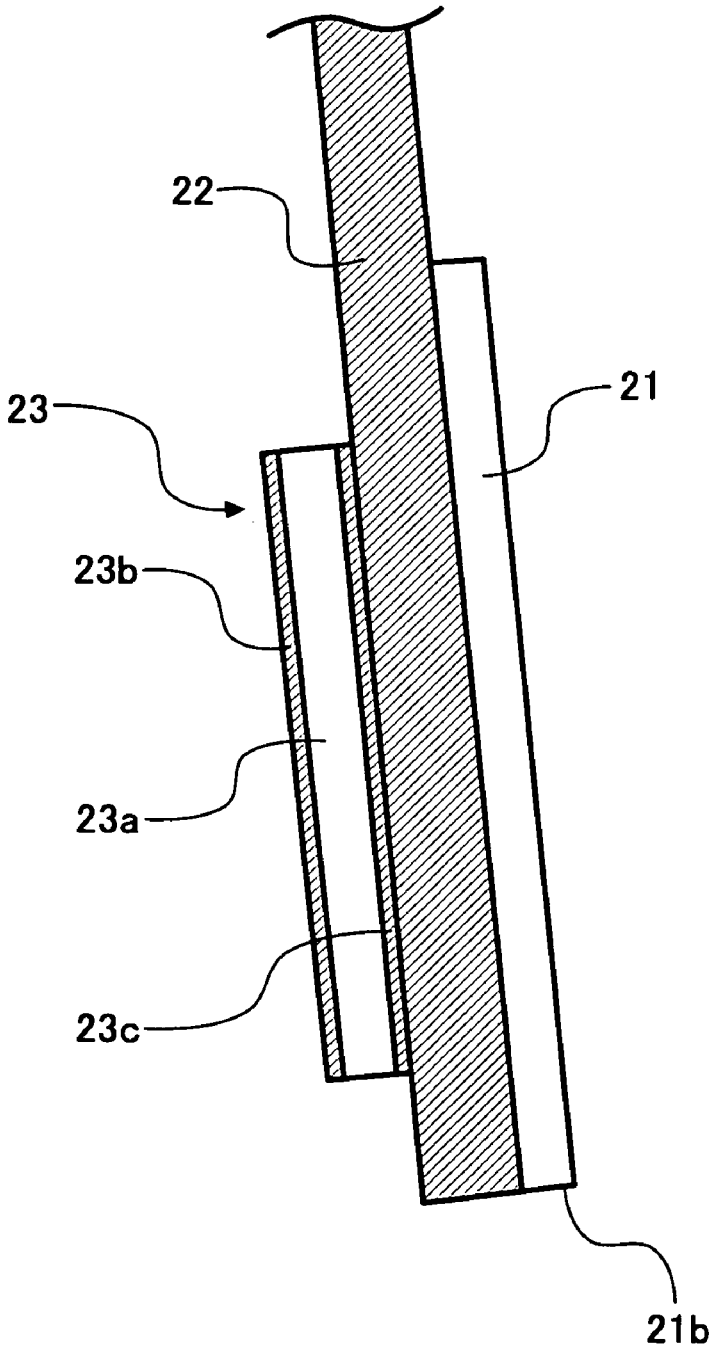
FIG. 4 illustrates a structure of a front part of the vibrating blade of FIG. 3.
Figure 5:
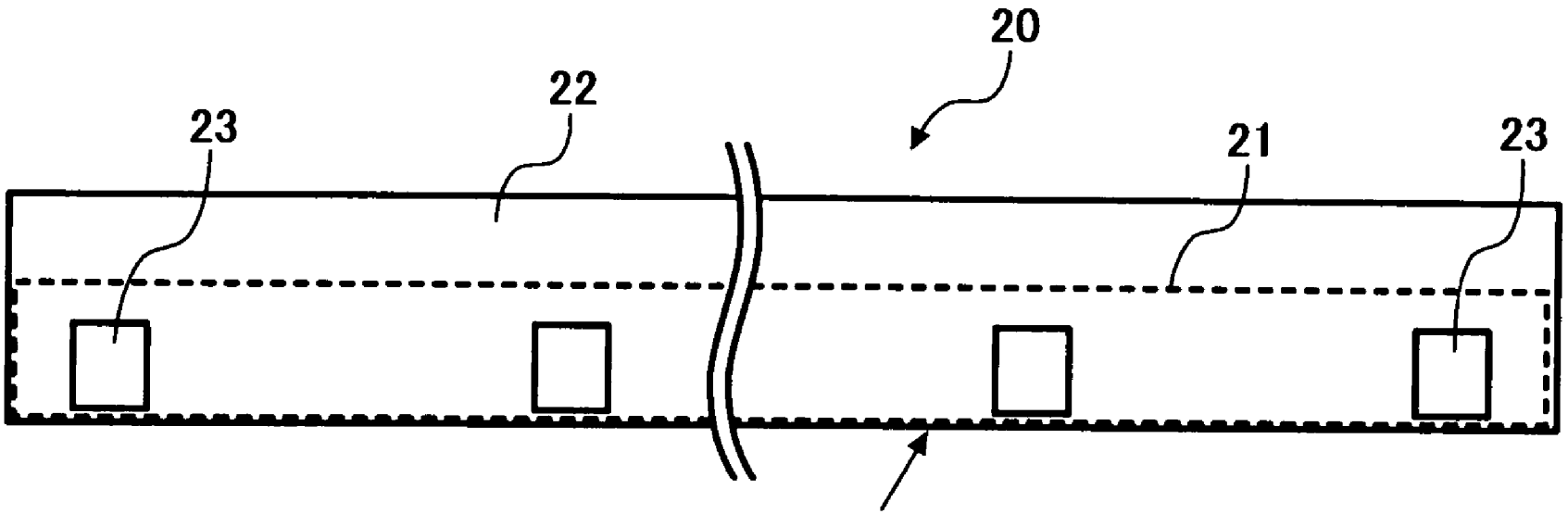
FIG. 5 is a plan view of a structure of the vibrating blade of FIG. 3.
Figure 6:
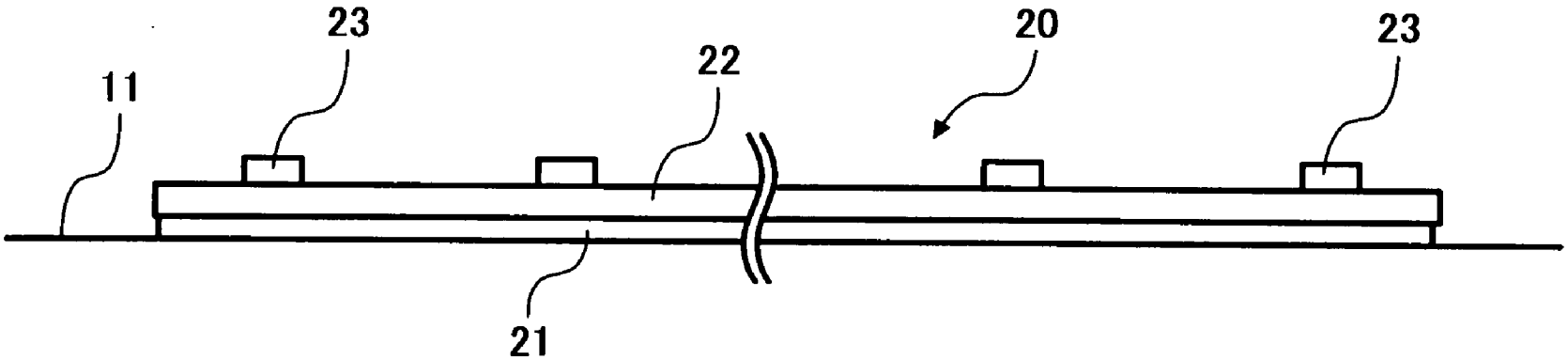
FIG. 6 illustrates the vibrating blade of FIG. 3 when viewed from the edge side thereof.

A first embodiment of the cleaning device 16 will be explained below with reference to FIG. 3 to FIG. 6. FIG. 3 is an enlarged view of the vibrating blade 20, FIG. 4 is an enlarged view of the blade member 21, FIG. 5 is a front view of the vibrating blade 20, and FIG. 6 is a side view of the vibrating blade 20.

The blade member 21 is fixed to the vibratable member 22, and the vibrating unit 23 is fixed to the vibratable member 22.

The blade member 21 is made of elastic material such as polyurethane rubber. The blade member is 50 micrometers to 1500 micrometers thick, and preferably 100 micrometers to 500 micrometers thick. If the blade member 21 is too thin, then the blade member 21 can not be pressed against the image carrier 11 with a desired force. If the blade member 21 is too thick, then the blade member 21 does not vibrate as desired, which results into faulty cleaning. It is preferable that the blade member 21 is made of a material having a JISA hardness of from 85 degrees to 100 degrees, because such a material vibrates very effectively.

Another material may be provided in one or more layer between the blade member 21 and the vibratable member 22 depending on the producing method of a thin urethane blade. For example, when the thin urethane blade is to be molded, the blade and an existing resin film are molded in one piece. This resin film is made of polyethylene terephthalate (PET) having a hardness higher than that of urethane. By thus doing, handling capability of cutting the nip part of the blade member 21, which requires a sharp edge, is improved. In this case, the molded material of PET and urethane is cut, and then the PET side is bonded to the vibratable member 22.

The vibratable member 22 is formed of a material capable of vibrating and having stiffness higher than the elastic blade member 21, such as a metal member like a mild steel plate and an SUS plate, or a resin molded member mixed with carbon or glass fiber. One end of the vibratable member 22 is fixed to a fixed part 24 and the other end is a free end 22*a*, and the blade member 21 is fixed to the free end. The fixed part 24 is fixed to a casing 25 of the cleaning device as illustrated in FIG. 2.

The vibratable member 22 functions as a holder of the blade member 21, that is, the vibratable member 22 determines a pressing force and an abutting angle of the blade member 21 against the image carrier 11. In other words, in the conventional blade, the pressing force of the blade nip part against the image carrier is imparted by repulsive force of the elastic blade itself. In contrast, in the present invention, the blade member 21 is a thin material in order to increase a propagation efficiency of the vibration. Because of this, the pressing force cannot be ensured by the blade member 21 as a single unit, and therefore, in the embodiment, the vibratable member 22 is structured to impart the pressing force against the image carrier 11 to the blade member 21.

Accordingly, it is possible to increase the propagation efficiency of the vibration while using the thin elastic blade member, and to stably form a nip that copes with warping of the blade member and waving of the surface of the image carrier, thus obtaining reliable cleaning performance.

The vibrating unit 23 vibrates the vibratable member 22, and herein uses a piezoelectric element as a transducer to convert mechanical signals to electric signals, particularly a plate-like (single plate) piezoelectric element. By using the plate-like piezoelectric element as the vibrating unit 23, it is possible to form the vibrating unit that can easily obtain a displacement amount at a low cost.

As illustrated in FIG. 5 and FIG. 6, a plurality of the vibrating units 23 are arranged in an axial direction (lateral direction) of the image carrier 11. As the vibrating unit 23, one unit is sufficient, but by arranging a plurality of units at predetermined intervals, uniformity of vibration in the lateral direction of the vibratable member 22 can easily be obtained. It is also conceivable to provide one elongated piezoelectric element, but if a plate-like piezoelectric element is used, it is preferable to arrange a plurality of units at intervals because the plate-like piezoelectric element uses deflection due to elongation and shrinkage thereof in a direction along the plate face.

The vibrating unit 23 is provided on the side opposite to the fixed face of the blade member 21 in the free end 22*a* of the vibratable member 22, that is, in the front part of the member 22 closer to the image carrier 11. A fixed position of the vibrating unit 23 is not particularly specified depending on the structure of the vibratable member 22 if the vibratable member 22 can be vibrated between the fixed end of the vibratable member 22 and the front part (free end) of the blade.

As illustrated in FIG. 4, the single-plate piezoelectric element forming the vibrating unit 23 has electrodes 23*b* and 23*c* formed of printed and baked Ag or the like on both sides of a piezoelectric layer 23*a* formed of titanic acid zircon acid lead or the like, that is, on a junction face with the vibratable member 22 and the opposite face. The piezoelectric element (piezoelectric layer 23*a*) having a thickness of from 0.3 to 0.5 millimeters obtained by being polarized by the electrodes 23*b* and 23*c* is applied with 100 to 300 volts, and shrinkage is thereby generated in the plate face direction. Consequently, the vibratable member 22 can be deflected by the deflective vibration. The deflective vibration is effective in deformation when the stiffness of the piezoelectric element (vibrating unit 23) is almost the same as that of the vibratable member 22. Therefore, it is preferable to use a metal vibratable member 22 having a thickness of, for example, 0.2 to 0.4 millimeters, or a resin vibratable member having a thickness of 0.3 to 1.0 millimeters.

Figure 7:
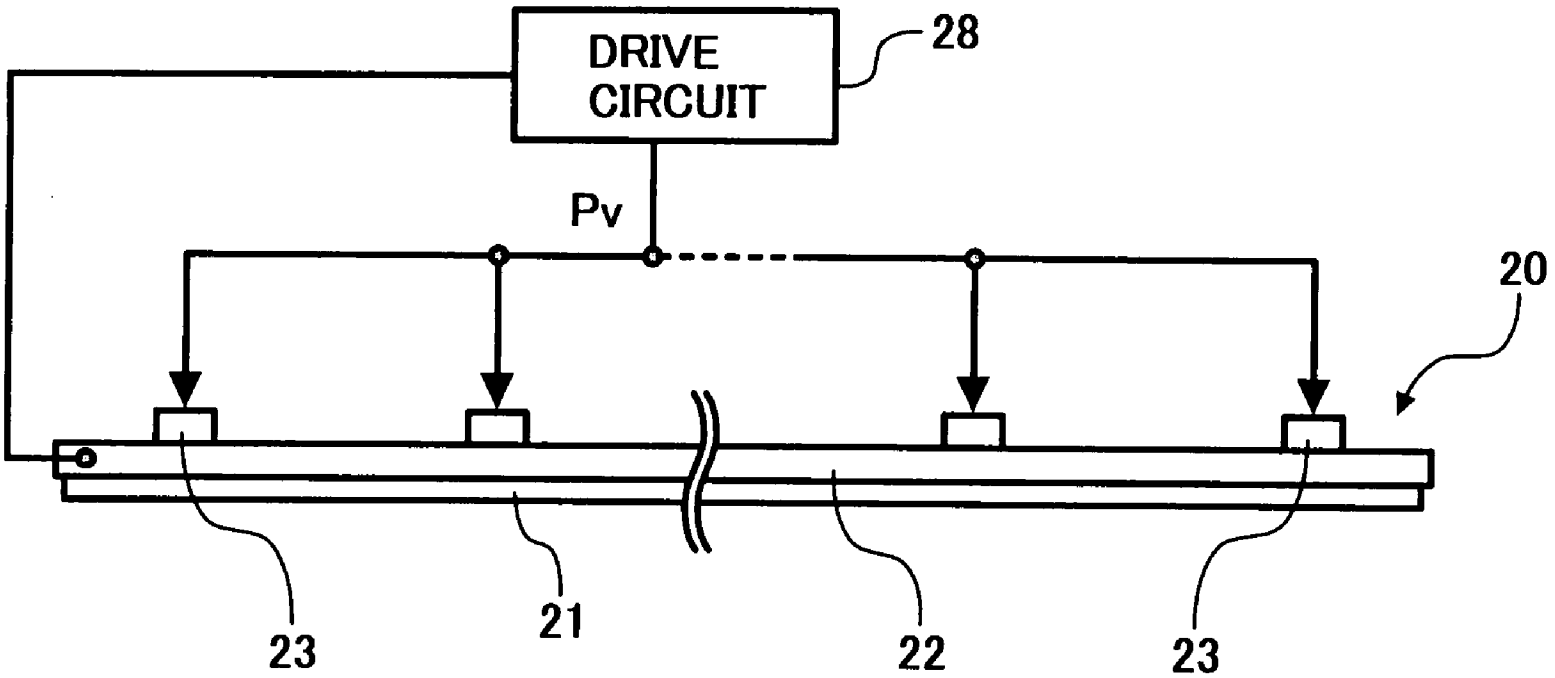
FIG. 7 illustrates an example of a drive system for the cleaning device according to the first embodiment.

As illustrated in FIG. 7, the cleaning device 16 has a drive circuit 28 that commonly applies a drive signal Pv to the piezoelectric element forming the vibrating units 23 of the vibrating blade 20. As explained above, when the vibrating units are provided in the lateral direction of the blade member, the common drive circuit 28 drives the units, and it is thereby possible to increase uniformity of the vibration in the lateral direction of the blade member.

The drive circuit 28 is formed with a drive control unit of the image forming apparatus, and supplies the drive signal Pv to the vibrating unit 23 at a predetermined timing. In the embodiment, one unit of the vibrating blade 20 performs cleaning in the whole width of the lateral direction of the image carrier 11. However, plural units of the vibrating blade 20 may be disposed to cover the whole width of the lateral direction. In this case also, it is preferable that the common drive circuit drives the respective vibrating units of the vibrating blades 20.

In the first embodiment, by using a metal member (conductive member) as the vibratable member 22, each electrode 23*c* of the piezoelectric elements forming the vibrating units 23 is in direct contact with the vibratable member 22 to make an electrical connection, and thereby the electrodes 23*c* of the vibrating units 23 are commonly connected to each other through the vibratable member 22. Accordingly, application of the drive signal can be performed with a simple circuit configuration. The direct contact can be easily obtained by finishing the junction face of the electrode 23*c* as a rough face and joining it with the vibratable member 22 with a thin adhesive layer. In addition to this method, junction may be made using a conductive adhesive.

In the cleaning device 16 thus structured, the drive circuit 28 supplies the drive signal Pv having a required frequency to the plurality of vibrating units 23, and thereby the piezoelectric elements forming the vibrating units 23 are deflected to vibrate the vibratable member 22. This vibration of the vibratable member 22 allows the blade member 21 to vibrate.

The vibrating unit 23 vibrates the vibratable member 22 in such a manner that curling of the edge of the blade member 21 is prevented to occur in the moving direction (direction of the arrow A) of the image carrier 11. Accordingly, it is possible to prevent the spherical toner and the fine toner from entering into the blade nip part, thus eliminating faulty cleaning for the spherical toner and the fine toner. Furthermore, the stress from the blade member to the image carrier is reduced, and it is thereby possible to obtain an extremely advantageous effect that the durability of the blade member and the image carrier is improved.

If the blade member 21 that is thin or harder than a conventional material is joined to the vibratable member 22 with high stiffness, the vibration of the vibrating unit 23 can be effectively transmitted to the blade nip part. It is thereby possible to perform cleaning based on the new mechanism without curling of the cut face and improve the cleaning performance without occurrence of faulty cleaning for the fine or spherical toner.

Figure 8:
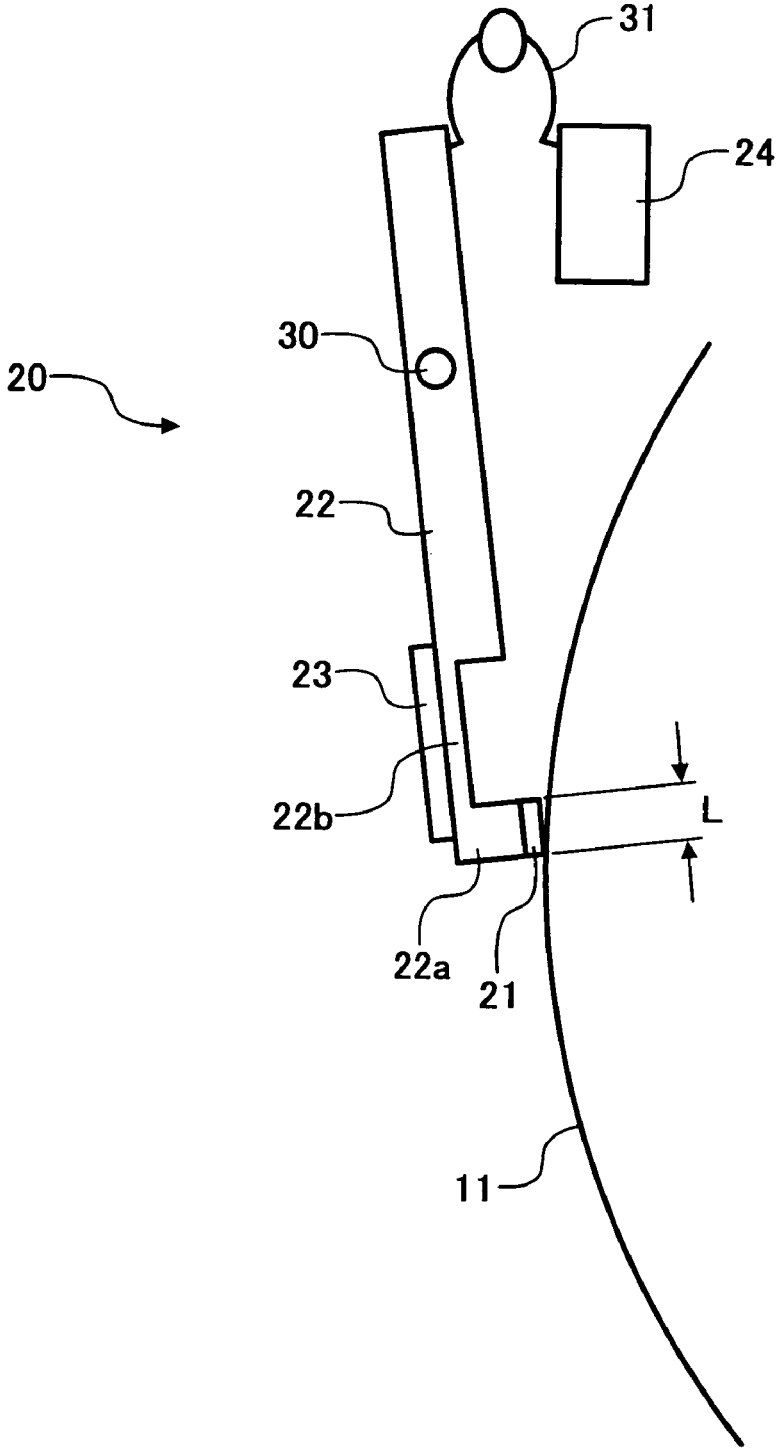
FIG. 8 illustrates another example of the structure of the cleaning device according to the first embodiment.

Another structure of the vibrating blade 20 in the cleaning device 16 is explained below with reference to FIG. 8. The vibratable member 22 is supported by a support 30 so as to be vibratable. A thin wall part 22*b* is formed on the support side of a free end 22*a* of the vibratable member 22, and the vibrating unit 23 is provided on the outer side (the opposite side to the image carrier 11 side) of the thin wall part 22*b*. A spring pressuring unit 31 as an auxiliary unit is provided between another free end of the vibratable member 22 and the fixing unit 24, and urges the free end 22*a*, to which the blade member 21 of the vibratable member 22 is fixed, toward the image carrier 11.

As explained above, the pressing force of the blade member 21 against the image carrier 11 may be given by the spring pressuring unit 31. The auxiliary unit is not limited to the spring, and therefore an elastic member such as rubber may be used. Accordingly, the propagation efficiency of vibration is increased while the thin elastic blade member is used as explained above, and the nip that copes with the warping of the blade member and the waving of the surface of the image carrier can be stably formed, thus obtaining reliable cleaning performance.

Figure 9:
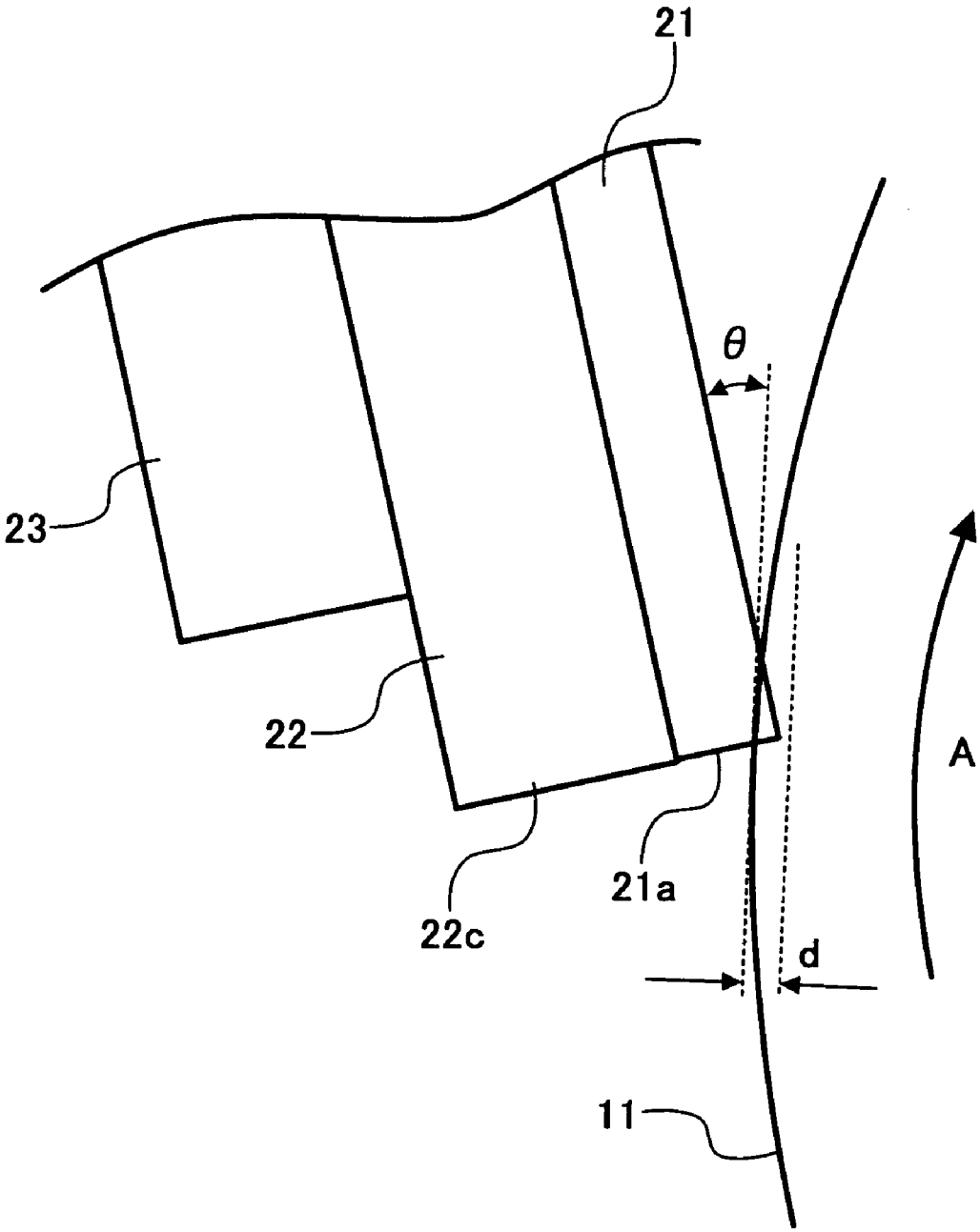
FIG. 9 illustrates an abutting angle and a pressing amount of a blade member according to the first embodiment.

The pressing amount and the abutting angle of the blade member 21 against the image carrier 11 will be explained below with reference to FIG. 9. FIG. 9 is an enlarged diagram illustrating a contact state between the blade member 21 and the image carrier 11.

The blade member 21 abuts the image carrier 11 in counter direction with respect to the rotating direction (direction of the arrow A) of the image carrier 11. That is, the image carrier 11 is set to rotate in a direction in which the abutting angle θ between the blade member 21 and the image carrier 11 is made wider.

With this setting, curing of the cut face 21*a* of the blade member 21 is eliminated, and even if a wedge-like nip is formed, the nip can be maintained to an extremely small size, and entering of toner into the nip part can be prevented.

The blade member 21 is pressed against the image carrier 11 by the pressing force at the edge of the nip part. A pressing amount d is defined by a depth indicating how the surface of the image carrier 11 is pressed down by the blade member 21. In other words, the pressing state of the blade member 21 against the image carrier 11 by the depth as the pressing amount d is obtained by further pressing the edge of the blade member 21 against the image carrier 11 from its contact state. This pressing state is set as initial setting. The initial setting mentioned here is a blade pressing amount in a state where vibration is not given. In the vibrating blade 20 using the single plate piezoelectric element for the vibrating unit 23, the pressing amount d corresponds to a total amount of a deformation of the elastic blade nip part and a deflection of the vibratable member 22 including the piezoelectric element.

The value of the pressing amount d is preferably within a range 10 and 100 micrometers if the thickness of the blade member 21 is from 100 to 300 micrometers and JISA hardness is from 75 to 100 degrees, depending on the thickness and the hardness of the blade member 21. If the blade member 21 is thin and hard, then the pressing amount d is set small, but if the member is thick and less hard, then the pressing amount d is set large.

If the abutting angle θ of the blade member 21 with respect to the image carrier 11 is within a range of from 0 to 50 degrees, then it is possible to eliminate curling of the cut face 21*a* of the blade member 21 and maintain a wedge-like nip to be extremely small size even if the nip is formed. It is thereby possible to prevent toner from entering the nip part, thus obtaining sufficient cleaning performance.

If the abutting angle θ is from 0 to 10 degrees, the length L (see FIG. 3 and FIG. 8) of the blade member 21 adhered to the vibratable member 22 is short such as 2 to 5 millimeters, this is preferable to employ this length to the case where the actual length of the blade member 21 in contact with the image carrier 11 is made short. If the length L of the blade member 21 is 5 millimeters or longer, then it is preferable to incline the blade member 21 at an angle from 10 to 50 degrees so that a blade edge part 21*b* (see FIG. 4) thereof comes in contact with the image carrier 11.

In the example shown in FIG. 9, the stiffness of the vibratable member 22 is higher than that of the blade member 21, and an edge projection amount of the blade member 21 is almost the same as that of the vibratable member 22, or the edge of the blade member 21 is shorter than that of the vibratable member 22, i.e., is recessed from the edge of the vibratable member 22.

Although the propagation of vibration of the vibratable member 22 generated by the vibrating unit 23 is attenuated at the nip part, the attenuation can be suppressed, and almost the same level of the vibration is conveyed to the blade nip part that directly acts the cleaning of toner. Thus, more efficient cleaning can be performed.

Figure 10:
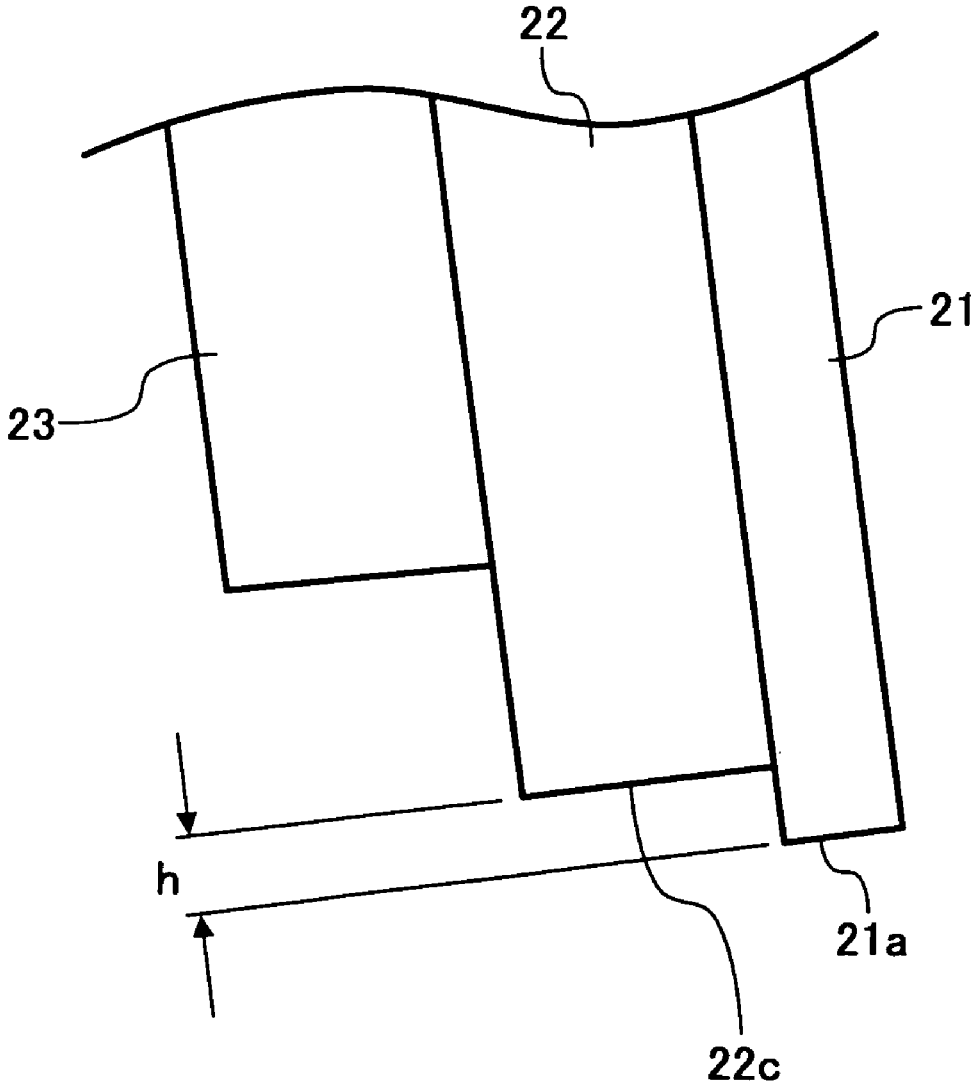
FIG. 10 illustrates a vibratable member and a projection amount of the blade member according to the first embodiment.

In the example shown in FIG. 10, the stiffness of the vibratable member 22 is higher than that of the blade member 21, and the edge of the blade member 21 is projected by a projection amount h from the edge of the vibratable member 22. However, a small amount of vibration of a high frequency is easily absorbed by the blade made of rubber elastic material. As a result of experiments, it has been identified that the projection amount h of the edge of the blade member 21 with respect to the vibratable member 22 may be set to a value of twice or less of the blade thickness, in order to reduce the attenuation of a displacement amount at the nip part to 70% or less on condition that the blade having JISA hardness of from 80 to 100 degrees is used.

Accordingly, it is possible to suppress the attenuation, that occurs at the nip part, of the propagation of vibration through the vibratable member 22 generated by the vibrating unit 23, and to convey almost the same level of the vibration to the blade nip part that directly acts the cleaning of toner. Thus, it is possible to perform more efficient cleaning, set drive conditions of the vibrating unit 23 to a voltage and a frequency within a range such that a heating value of the piezoelectric element is insignificant, and cleans the fine or spherical toner.

Experiments on the drive conditions of the piezoelectric element and the cleaning performance were conducted. The experiments were carried out by using a piezoelectric element having a thickness of from 0.3 to 1.0 millimeters, with dimensions within a range of from 5 to 20 millimeters as the piezoelectric element forming the vibrating unit 23, and also using the vibratable member 22 and the blade member 21.

As a result, the drive conditions of the piezoelectric element were set so that the frequency of the drive signal was set to 17 to 50 kilohertz and a range from 0.1 to 4 micrometers at the nip part of the blade edge would be obtained as a vibration displacement amount. Consequently, it has been identified that the vibrations of compression and relaxation were transmitted to the blade nip part, and that cleaning performance for the spherical or fine toner is obtained by the cleaning mechanism as explained with reference to FIG. 1.

Accordingly, the vibration amount given to at least the nip part is set to a value smaller than the pressing amount d, and it is thereby possible to obtain a stable effect. That is, the vibration of the blade member 21 allows the vibration to transmit from the blade member 21 to the image carrier 11, and therefore the frictional force between the blade member 21 and the image carrier 11 is lowered, and curling of the cut face of the blade member 21 is eliminated. Consequently, it is possible to prevent entering of the spherical or fine toner into the blade nip part, and also prevent occurrence of faulty cleaning for these toners.

Moreover, the vibration of the blade member 21 or the vibration to be transmitted from the blade member 21 to the image carrier 11 makes the spherical toner itself vibrate, and the toner actively vibrate on the image carrier 11, and thereby the toner looses an absorptive force to the image carrier 11, thus improving the cleaning performance.

Further, a toner group vibrating in the vicinity of the nip part acts like a burrier (vibrating toner wall) to prevent entering of subsequent toners on the image carrier 11 into the nip part. Therefore, faulty cleaning does not occur even if the toner is perfectly spherical.

An average particle size of toners is generally 8 to 10 micrometers, and recently, toner of about 5 micrometers has been used because the shape of toner is more spherical and the size thereof is smaller by the producing method using the polymerization method. In order to obtain the cleaning effect, the displacement amount of vibration at the nip part of the blade edge may be an average particle size of the toner or less. Furthermore, it has been identified that even if the vibration amount is 1/10 of the toner average particle size or less, a sufficient effect can be obtained, depending on a drive frequency.

The case where curling of the cut face can be avoided by transmitting vibration through the blade member 21 also to the image carrier 11, has been mentioned above. At the same time, the vibration of the image carrier 11 is transmitted to the toner on the image carrier 11 near the blade. It has been identified that by obtaining a displacement amount of the vibration of from 0.1 to 4 micrometers at the nip part of the blade edge assuming that the frequency of the drive signal for the piezoelectric element is 17 to 50 kilohertz, as illustrated in FIG. 1, vibration can be imparted over the region of several number of toners that are not in direct contact with the blade member 21 but near the member 21.

As explained above, the vibrating unit vibrates the vibratable member by an amount smaller than the pressing amount of the blade member against the image carrier, which does not cause curling at the edge of the blade member to occur. Furthermore, the vibration of the blade member is directly transmitted to the toner and is further transmitted from the blade member to the image carrier. Therefore, the toners near the blade actively vibrate on the surface of the image carrier, and thereby the toners loose absorptive force, thus improving cleaning performance. Moreover, a barrier is formed by the vibration to prevent the toners from passing through the nip, thus obtaining reliable cleaning performance.

In this case, the vibration amount is made smaller than the average particle size of the toner, and it is thereby possible to more reliably form the barrier by the vibration and prevent toner from passing through the nip.

Furthermore, the vibration of the blade member is imparted to toners that are not in direct contact with the blade member, it is thereby possible to perform cleaning in a region of a fast linear velocity of the image carrier. Thus, it is possible to obtain the high-speed and high-quality image forming apparatus using the spherical or fine toner in particular.

Figure 11:
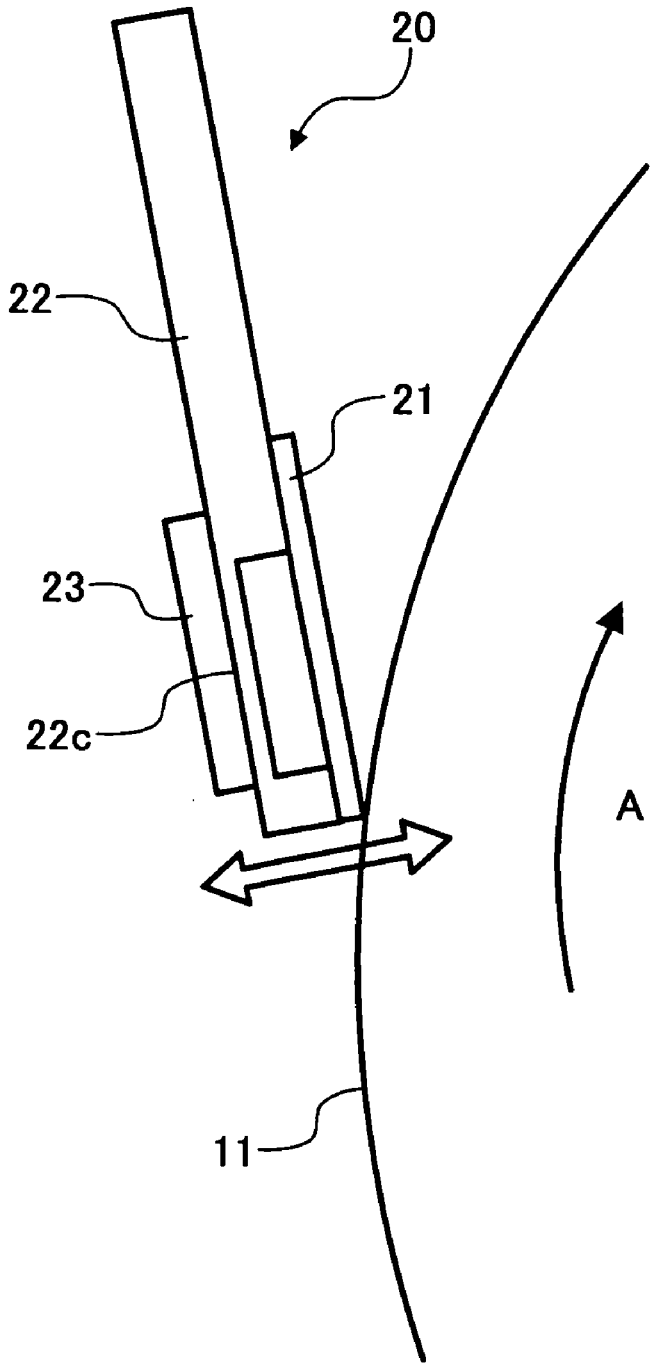
FIG. 11 illustrates a structure of a cleaning device according to a second embodiment of the present invention.
Figure 12:
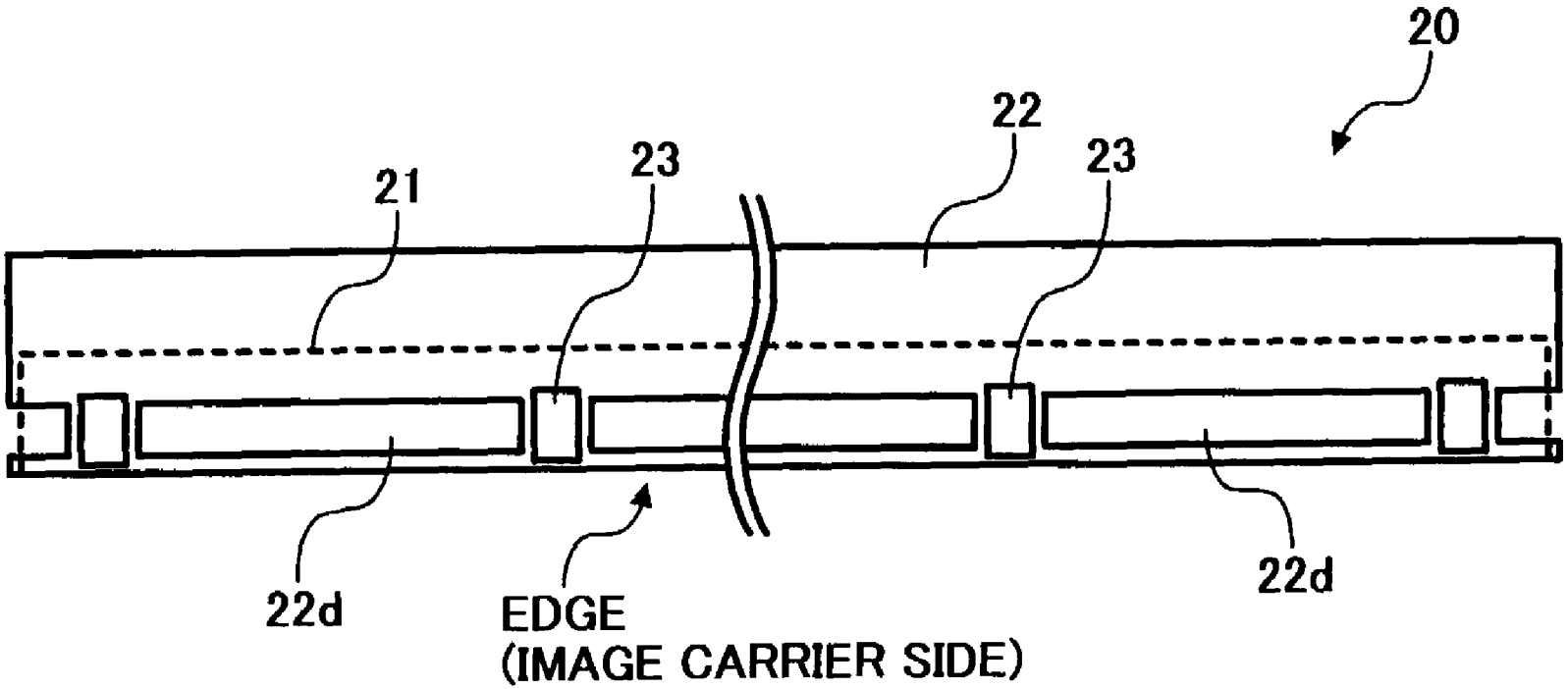
FIG. 12 is a plan view of a structure of the cleaning device in FIG. 11 in the lateral direction of the image carrier.

A second embodiment of the vibrating blade 20 in the cleaning device 16 will be explained below with reference to FIG. 11 and 12. In the second embodiment, the plate-like piezoelectric element is used as the vibrating unit 23 in the same manner as the first embodiment. The vibratable member 22 has the thin wall part 22*b* obtained by thinning a portion corresponding to a joint region with the piezoelectric element so that only the portion is easy to be elastically deformable. The blade member 21 is a urethane blade member, and is joined to the vibratable member 22 at the edge region to determine an abutting angle θ and an engaging amount (pressing amount) d of the blade member 21 against the image carrier 11. This structure is the same as that of FIG. 9.

This structure allows increase in the stiffness of the edge region to which the blade member 21 of the vibratable member 22 is fixed, and also allows setting of a natural frequency of the region to be high. Therefore, the edge part of the vibratable member 22 can be uniformly vibrated in a region as far as a high frequency in the lateral direction of the blade member 21, and high cleaning performance without any cleaning failure can be achieved. Further, since the vibratable member 22 is thinned only at a portion corresponding to the joint region with the piezoelectric element, the natural frequency of the whole vibrating blade 20 can be kept high, and therefore the vibration up to high frequency can be imparted.

The vibratable member 22 has a plurality of through regions (lightening portions) 22*d* provided between the vibrating units 23 in the lateral direction. Accordingly, deflective efficiency of the vibratable member 22 toward the edge direction by the piezoelectric element (vibrating unit 23) is increased more, and the blade member 21 can be vibrated more efficiently.

Figure 13:
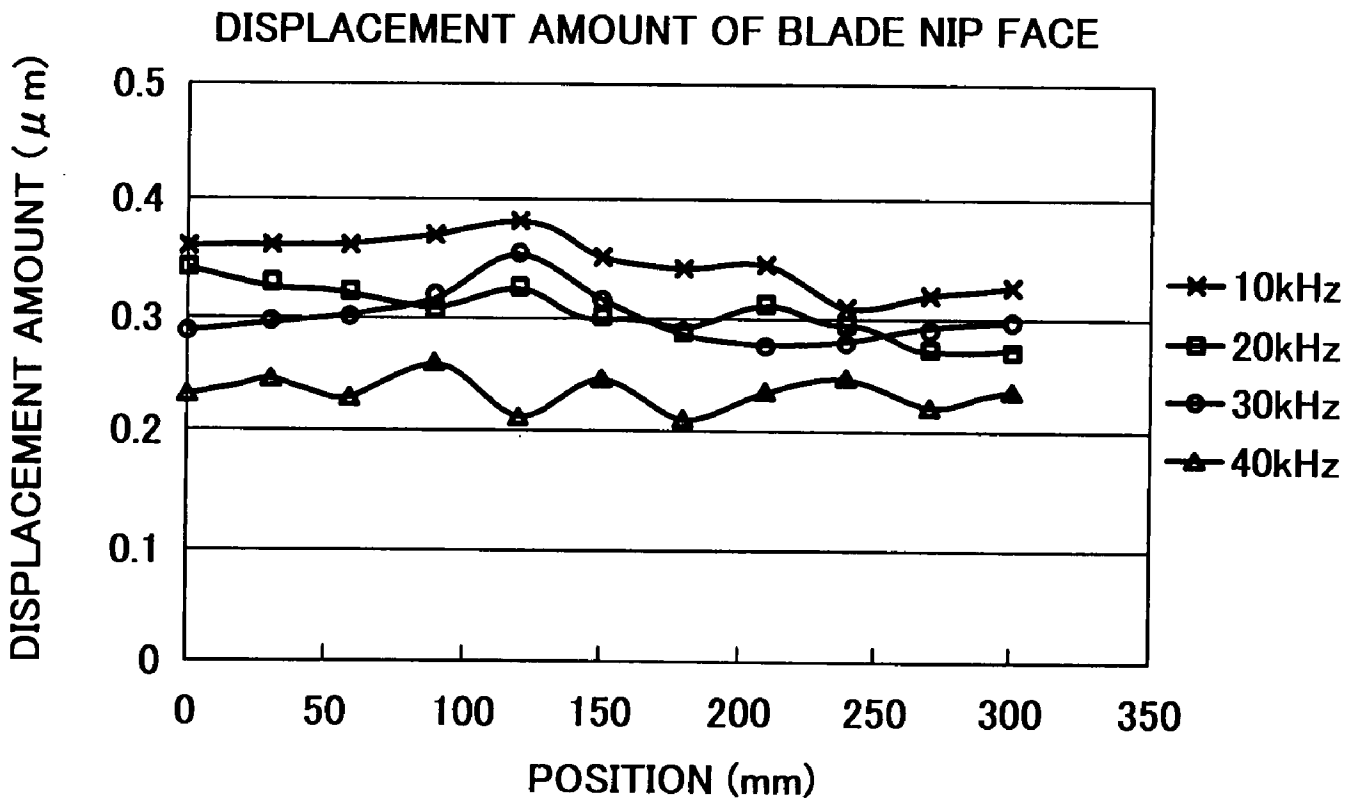
FIG. 13 illustrates results of measuring displacement amounts of a blade nip part in the cleaning device in FIG. 11.

As conditions of measuring the displacement amount of the blade nip face as illustrated in FIG. 13, the width of the blade member 21 was set to an A3-size lateral width, the pressing amount d of the nip part against the image carrier 11 was 50 micrometers, a common drive signal Pv was applied to the piezoelectric elements (vibrating units 23), and the drive signal Pv had a voltage of 220 volts and frequencies of from 10 to 40 kilohertz as four stages. The piezoelectric element in use had a thickness of 0.3 millimeter, with dimensions of 7×10 millimeters. A vibration displacement gage used in measurement was AT 0021 laser Doppler vibration meter produced by Graphtech Co. with a beam diameter ϕ of 12 micrometers.

It has been found from the results that almost uniform displacement was obtained in the lateral direction for the A3-width compatible cleaning blade, and it is therefore possible to clean the spherical of fine toner without occurrence of curling at the cut face of the blade.

Figure 14:
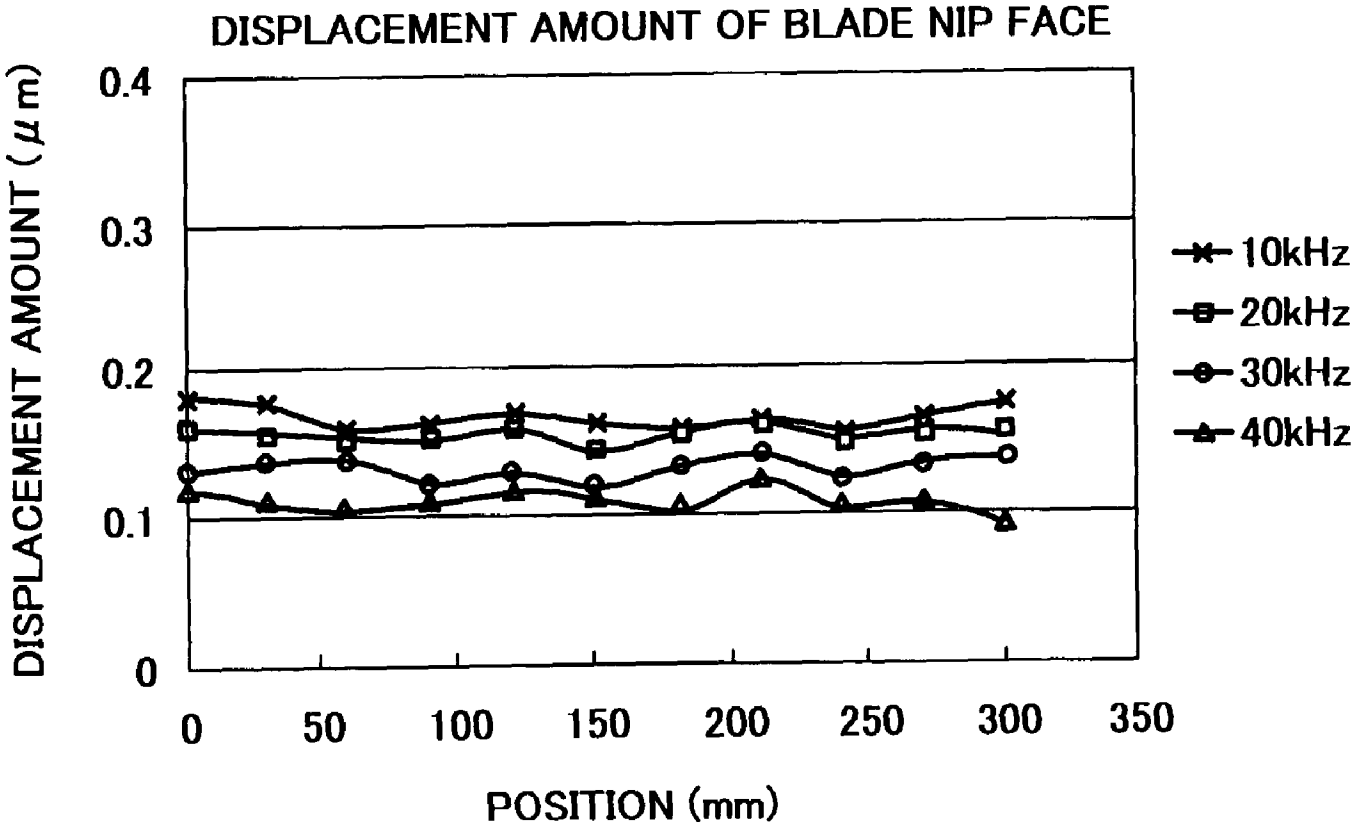
FIG. 14 illustrates other results of measuring displacement amounts of the blade nip part in the cleaning device in FIG. 11.

FIG. 14 illustrates results of measurement in the same manner as that of FIG. 13, in which the drive voltage of the drive signal Pv applied to the piezoelectric element is set to 80 volts. In this case, also, the vibrating blade 20 has a sufficient performance for reducing the frictional force if the linear velocity of the image carrier is comparatively slow, although the displacement amount is less than the case using the voltage of 220 volts.

Figure 15:
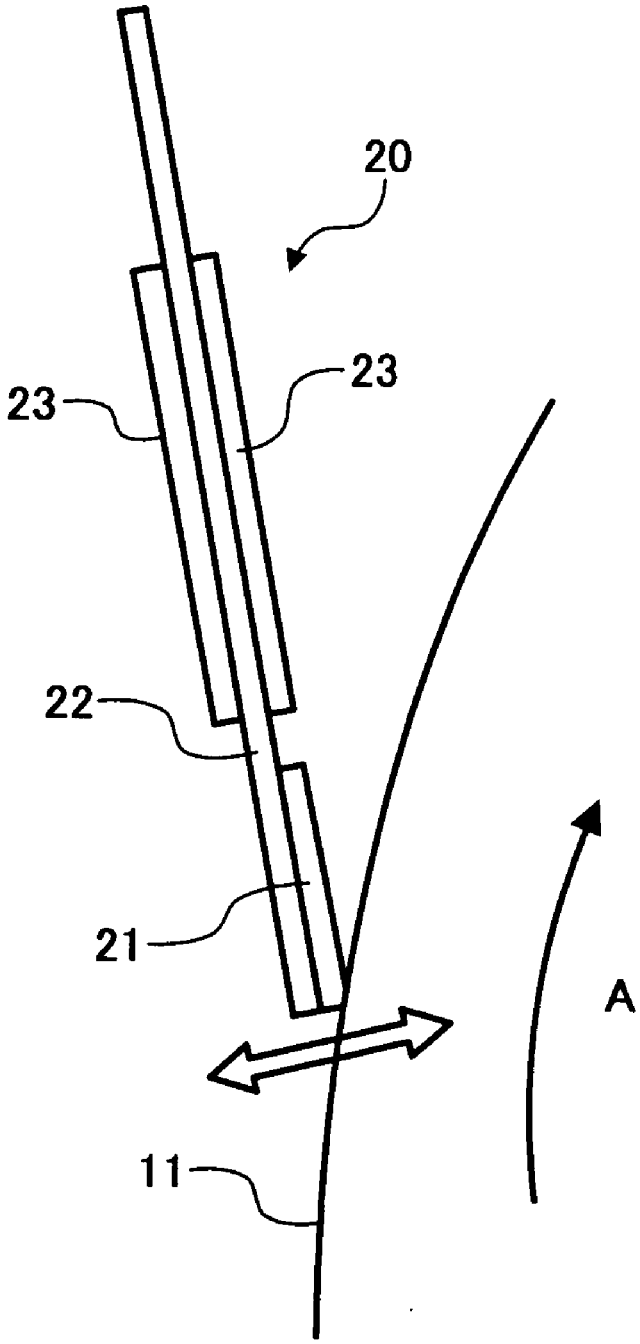
FIG. 15 illustrates a structure of a cleaning device according to a third embodiment of the present invention.

A third embodiment of the vibrating blade 20 in the cleaning device 16 will be explained below with reference to FIG. 15. In the third embodiment, the plate-like piezoelectric element is used as the vibrating unit 23, and two piezoelectric elements (vibrating unit 23) are provided on both sides of the vibratable member 22. The voltage is set so that application of the voltage to the two piezoelectric elements allows the elements to deform in such a manner that one of the elements is elongated along its face direction and the other element is shrunk along the face direction.

With this setting, the vibratable member 22 can be deflected by the force as twice as much, and the natural frequency can be increased because the stiffness of the whole is enhanced.

Figure 16:
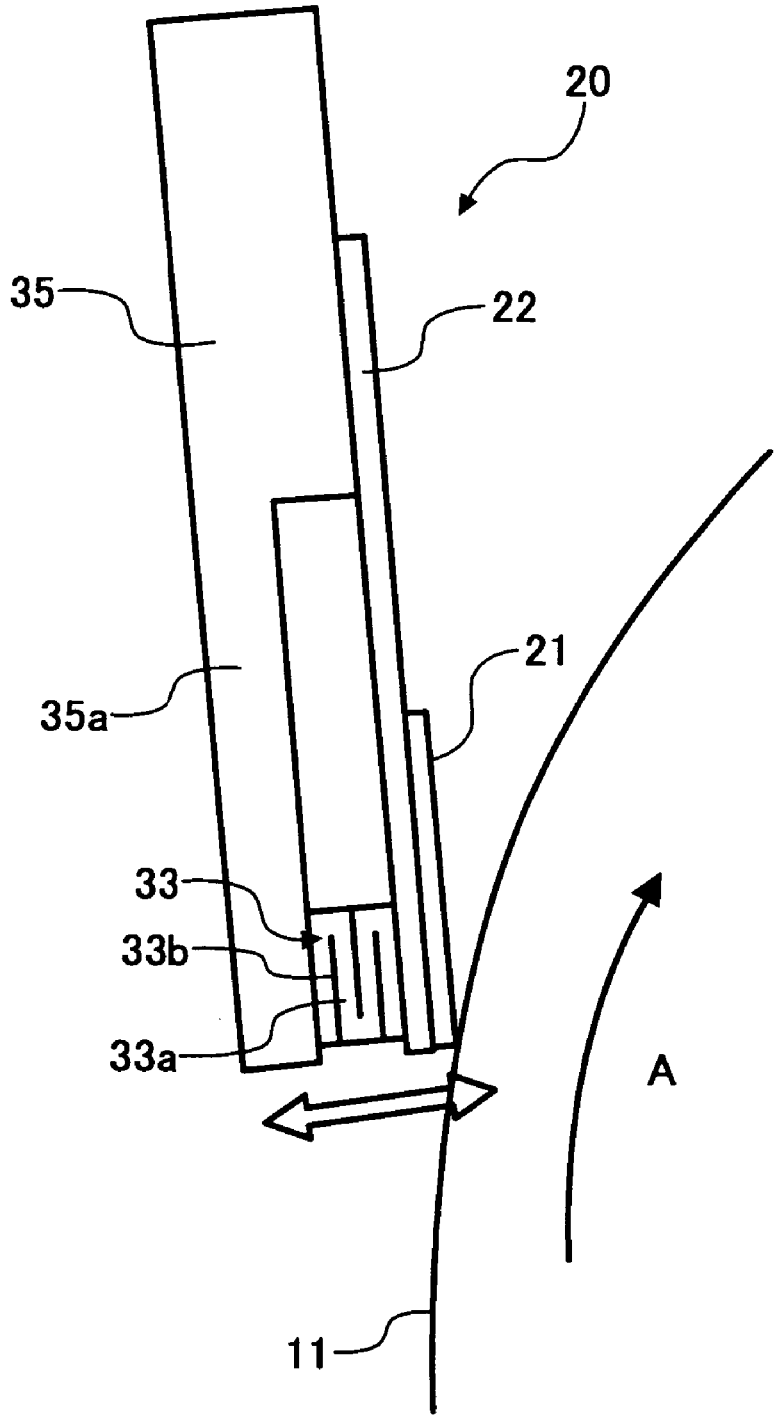
FIG. 16 illustrates a structure of a cleaning device according to a fourth embodiment of the present invention.

A fourth embodiment of the vibrating blade 20 in the cleaning device 16 will be explained below with reference to FIG. 16 and FIG. 17. In the fourth embodiment, a laminated type piezoelectric element is used as a vibrating unit 33 that vibrates the vibratable member 22. The laminated type piezoelectric element has a high natural frequency of 50 to 100 kilohertz and a generated displacement force is extremely large. Therefore, by using such a laminated type piezoelectric element, response to a frequency as far as a high frequency is easily realized even if the plate thickness of the vibratable member 22 is increased.

The laminated type piezoelectric element forming the vibrating unit 33 here is obtained by alternately laminating piezoelectric layers 33*a* each of 100 micrometers and internal electrodes 33*b* and alternately pulling out both ends of the internal electrodes 33*b* to be connected to end electrodes (external electrodes). The piezoelectric element is structured to utilize displacement in d-33 direction as displacement in the laminating direction.

The piezoelectric element is also structured to utilize displacement in a face direction, i.e., in d-31 direction, perpendicular to the laminating direction in which a plurality of layers are laminated using the laminated type piezoelectric element. In this case, it is possible to allow the displacement amount to be a wider range, achieve a lower voltage, and reduce a driver (drive circuit) cost. When this structure is employed, the rest of the components other than the laminated type piezoelectric element forming the vibrating unit 33 are the same as those of FIG. 16.

The vibratable member 22 is formed with a elastically deformable thin plate, a fixed end of the vibratable member 22 is fixed to a fixed member 35 as a high-stiffness holder having a support part 35*a* facing the vibratable member 22, and a laminated type piezoelectric element as the vibrating unit 33 is provided between the support part 35*a* of the fixed member 35 and the vibratable member 22. The blade member 21 is arranged in the front region of the vibratable member 22 on the side opposite to the vibrating unit 33 so that vibration from the vibrating unit 33 is transmitted to the blade member 21 through the vibratable member 22.

As explained above, the vibrating unit is provided between the fixed part and the vibratable member, thus efficiently transmitting the vibration to the vibratable member.

Figure 17:
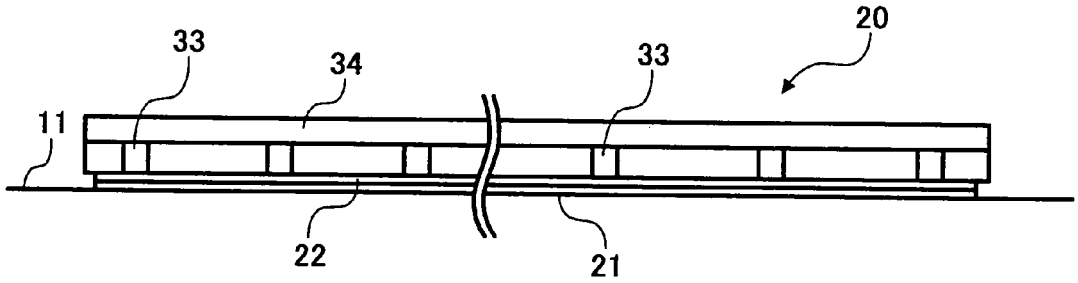
FIG. 17 is a plan view of a structure of the cleaning device in FIG. 16 in the lateral direction of the image carrier.

The vibrating units 33 are arranged in the lateral direction of the image carrier 11 as illustrated in FIG. 17. When the blade member 21 having a comparatively narrow width is used, the vibrating unit 33 may be structured as a single unit if a laminated type piezoelectric element having a large cross-sectional area is used.

Figure 18:
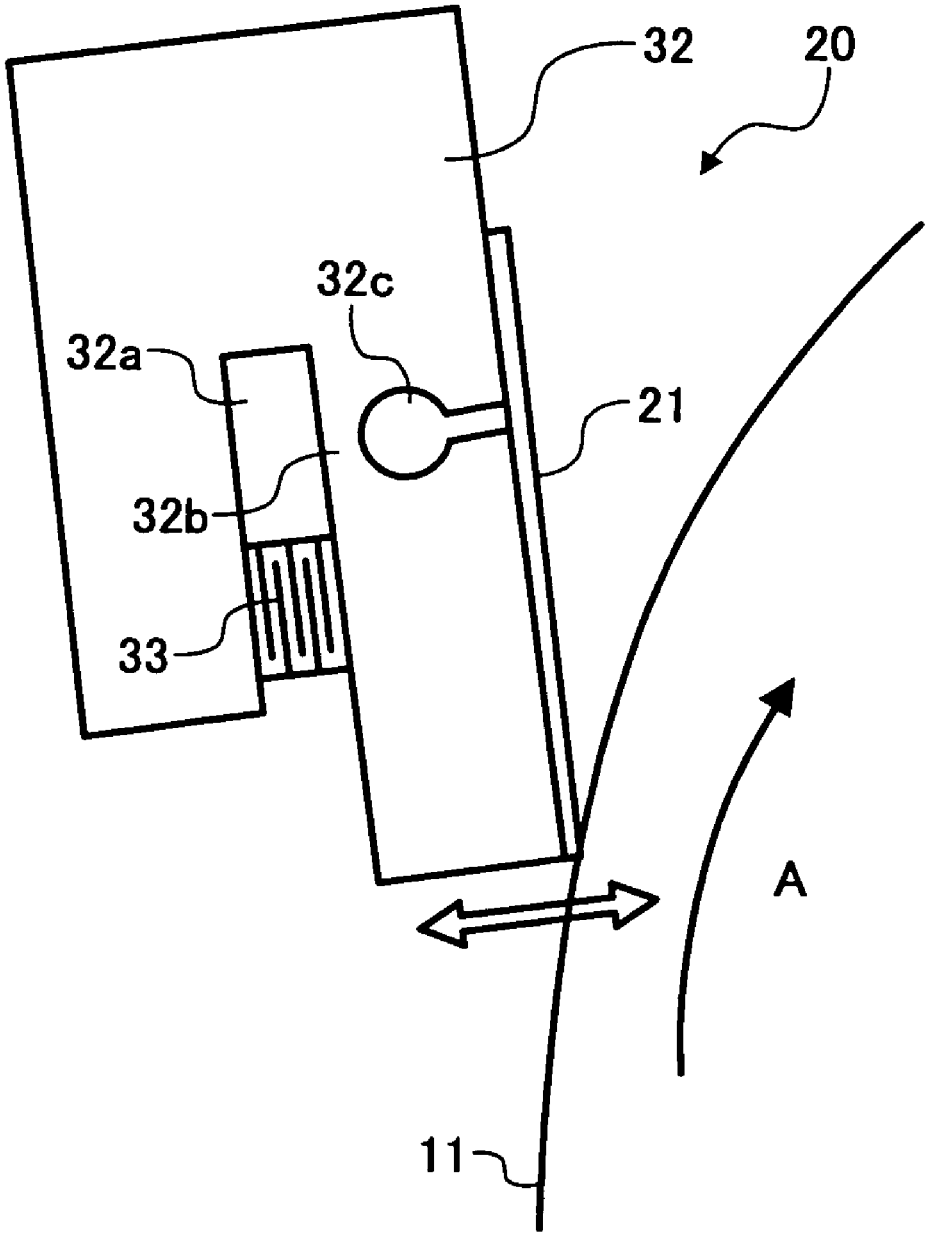
FIG. 18 illustrates a structure of a cleaning device according to a fifth embodiment of the present invention.

A fifth embodiment of the vibrating blade 20 in the cleaning device 16 will be explained below with reference to FIG. 18. In fifth embodiment, the thickness of a vibratable member 32 is increased to enhance the stiffness, and a concave part 32*a* having a character U shape is formed so as to sandwich the vibrating unit 33 using a laminated type piezoelectric element. The laminated type piezoelectric element utilizes displacement in the d-33 direction the same as that in the fourth embodiment.

A vibratable groove 32*c* is provided in the vibratable member 32 so as to form a thin part 32*b* in the member 32 so that the edge part of the vibratable member 32 efficiently vibrates by the vibrating unit 33. Further, the blade member 21 is thinned so that the vibration from the vibratable member 32 can easily be transmitted.

In such a structure, it is possible to increase the stiffness of the portion of the vibratable member 32 to which the blade member 21 is fixed, and more efficiently propagate the vibration to the blade member 21.

Figure 19:
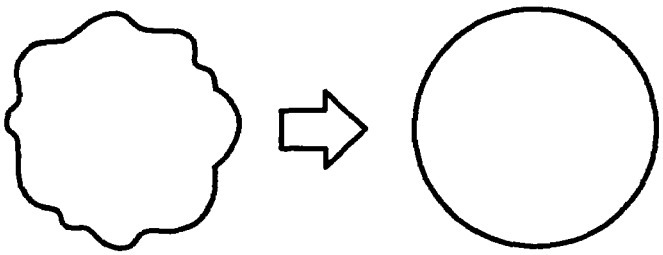
FIG. 19 is to explain a sphericity of toner.

Experiments were conducted using the cleaning device according to the first to fifth embodiments. In these experiments, spherical toner having a sphericity of 0.98 or more, in other words, perfect sphericity, was used. The sphericity is expressed by definition shown in FIG. 19, that is, the sphericity is obtained by dividing "a circumferential length L2 of a circle having the same area as a particle projected image area S" by "a circumferential length L1 of a particle projected image".

Evaluation was conducted while a displacement amount at the blade edge part was measured using a halftone image with a toner deposition of 0.1 mg/cm$^2$ on the image carrier 11 and using a drive voltage applied to the vibrating unit 33 and a drive frequency as parameters.

If the vibrating unit 33 was not driven, that is, did not vibrate the vibratable member, then it was natural that cleaning could not be performed in an initial stage. However, if the displacement amount was 0.1 micrometer or more and a vibration period was twice or three times or less than a passage period of toner that was to be removed from the image carrier 11, then cleaning was possible in all the embodiments. Furthermore, if the frequency was 17 kilohertz or less, this frequency is in an audible range, and therefore noise due to vibration was concerned. However, if the frequency was 17 kilohertz or higher, then the noise problem was eliminated and cleaning capability was excellent.

As it was clear that even the perfectly spherical toner can be scrapped off properly, then evaluation on durability was performed.

Figure 54:
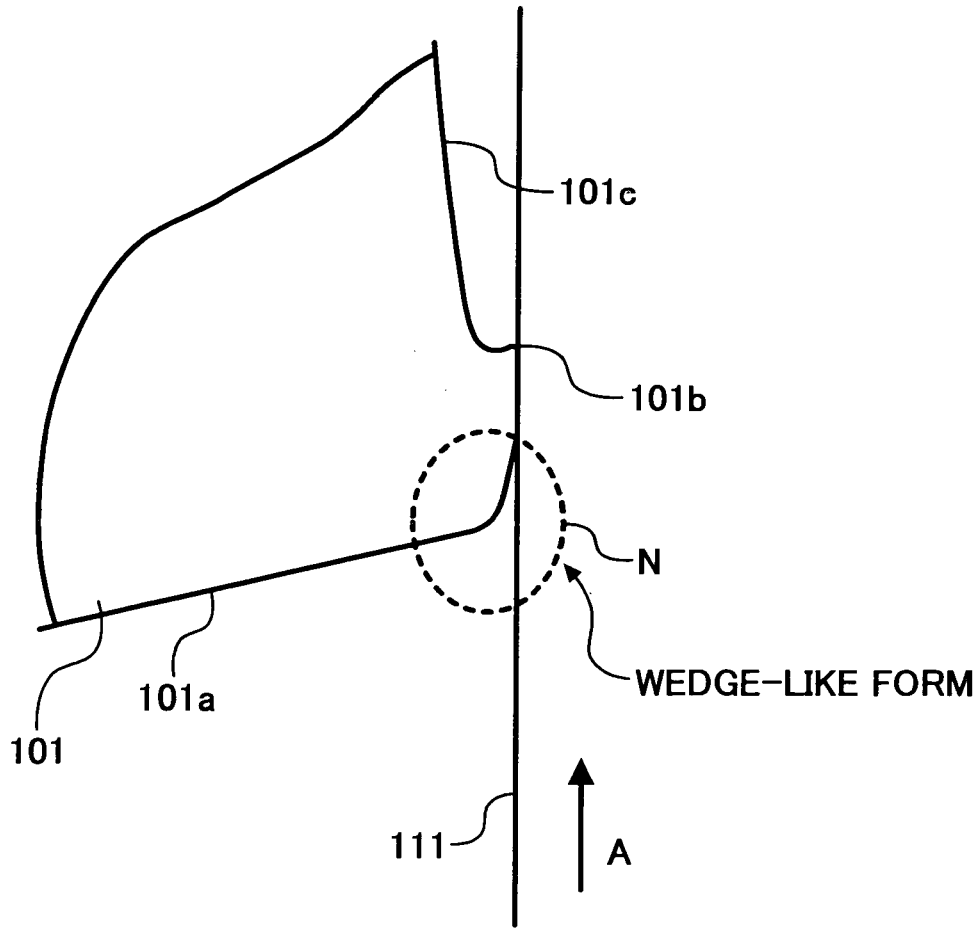
BACKGROUND ART FIG. 54
FIG. 54 illustrates how the front edge face of the doctor blade is pulled along the rotating direction of the image carrier when the conventional blade is used.

Comparative evaluation on cleaning capability and damage of an image carrier was performed, using the image forming apparatus provided with the cleaning device according to the first to fifth embodiments and an image forming apparatus using the conventional type blade cleaning (structure of FIG. 54).

Pulverized toner and spherical toner were used for evaluation to measure a number of sheets with which faulty cleaning would occur and a film scraped amount of the image carrier at a time at which 50,000 sheets of paper were fed.

The spherical toner having the sphericity of 0.98 was used. The sphericity was defined as explained with reference to FIG. 19. An A3-size paper was used in its portrait orientation, and a halftone image was used. This image was made with developing toner deposited, by 0.1 mg/cm$^2$, on the image carrier 11 to be blade-cleaned. Evaluation was performed under a temperature of 10° C. and a humidity of 30%. Evaluation results are illustrated in Table 1.

TABLE 1

| | Cleaning capability (number of sheets) | | Amount of |
|---|---|---|---|
| Blade | Pulverized toner | Spherical toner | film scraped (μm) |
| First Embodiment | 50,000 ○ | 50,000 ○ | 2.2 |
| Second Embodiment | 50,000 ○ | 50,000 ○ | 2.2 |
| Third Embodiment | 50,000 ○ | 50,000 ○ | 2.1 |
| Fourth Embodiment | 50,000 ○ | 50,000 ○ | 1.8 |
| Fifth Embodiment | 50,000 ○ | 50,000 ○ | 2.4 |
| Conventional | about 30000 x | at the initial stage | 4.4 |

It was found that cleaning is possible also for spherical toner by the cleaning method of giving vibration based on the structure of the present invention and that damage to the image carrier is less than half, as compared with that in the conventional blade cleaning method.

Figure 20:
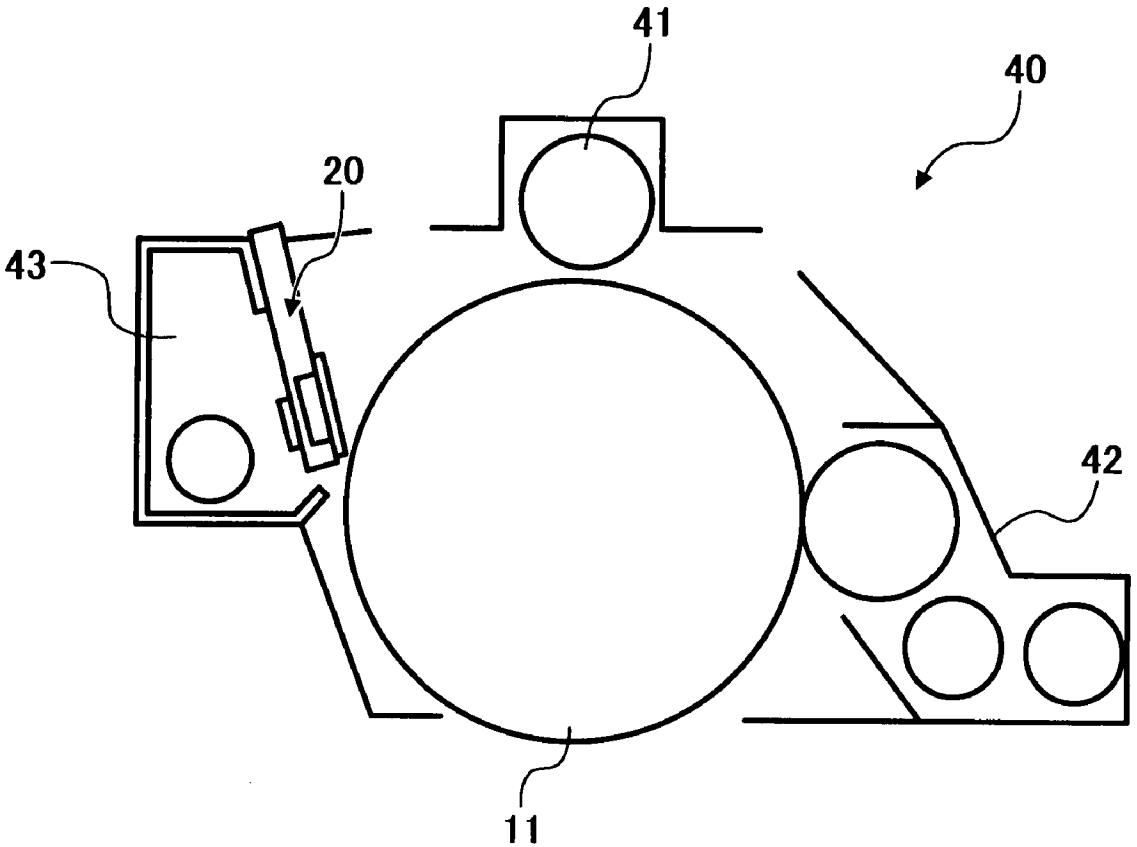
FIG. 20 illustrates a process cartridge according to the first embodiment of the present invention.

A process cartridge, according to the present invention, that includes the cleaning device of the present invention, will be explained below with reference to FIG. 20. FIG. 20 is a cross section of the schematic structure of a process cartridge 40. The process cartridge 40 is formed by integrating a plurality of components, into one unit, selected from among the image carrier 11, a charging unit 41, a developing unit 42, and a cleaning device 43 according to the present invention. This process cartridge 40 is detachably formed to a main body of an image forming apparatus such as a copier and a printer.

The cleaning device 43 is provided in the detachable process cartridge to enable improvement of maintenance and easy replacement with another cleaning device as an integral unit.

Figure 21:
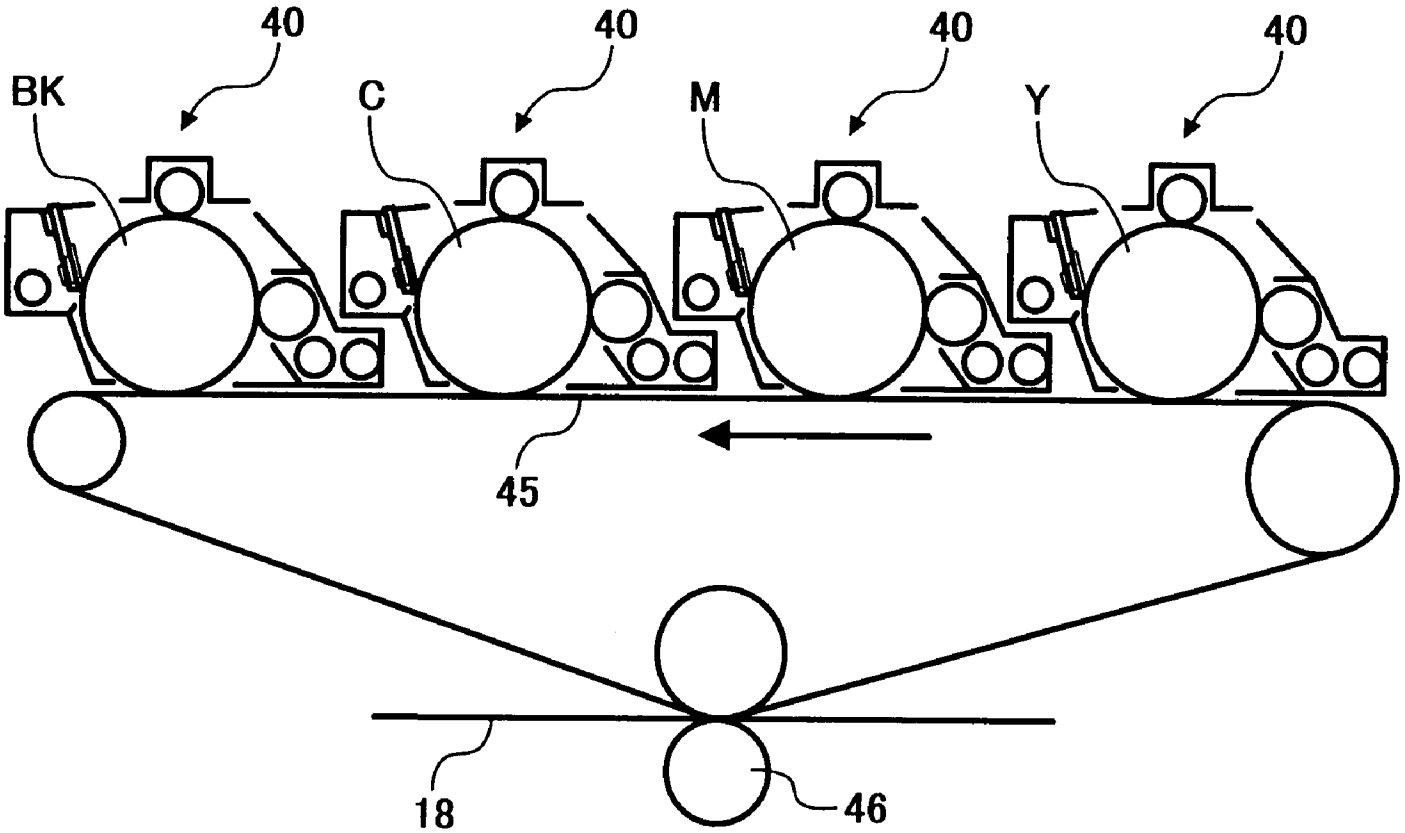
FIG. 21 illustrates a schematic structure of an image forming apparatus having the process cartridge according to the first embodiment.

A color image forming apparatus using the process cartridge of the present invention will be explained below with reference to FIG. 21.

The image forming apparatus is a color type in which the process cartridges 40 of each color are arranged in a row along a transfer belt (image carrier) 45 that horizontally extends.

Four process cartridges 40 of yellow (Y), magenta (G), cyan (C), and black (Bk) are arranged. Toner images on the image carriers 11 obtained by being developed in the process cartridges 40 are sequentially transferred on the horizontally extending transfer belt 45 that is applied with a transfer voltage.

Images of yellow, magenta, cyan, and black are formed in the above-mentioned manner and superposedly transferred on the transfer belt 45, and the superposed images are collectively transferred on a transfer material 18 by a transfer unit 46. The superposed toner images on the transfer material 18 are fixed by a fixing unit (not shown). The process cartridges 40 are explained in order of yellow, magenta, cyan, and black, but the order is not specified, and therefore any arrangement may be provided.

Generally, the color image forming apparatus includes a plurality of image forming units, which causes its size to be large. Further, if units for cleaning, charging, or the like are out of order individually or if a time to replace the units due to end of their lives comes, because the device is complicated, a lot of time is required to exchange the units.

To solve the problem, the components of the image carrier, charging unit, and the developing unit are integrated into one unit as the process cartridge 40 to provide the color image forming apparatus that is compact in size with increased durability and includes a user-exchangeable process cartridge.

Explanation has been given above using the spherical toner, and the same goes for the fine toner.

A cleaning device according to a sixth embodiment is basically the same as that of the first embodiment. Therefore, explanation will be given with reference to FIGS. 1 and 2.

In the cleaning device, as illustrated in FIG. 1, the blade member 1 vibrates toners T near the wedge-like nip formed with the blade member 1 and the image carrier 11 to prevent the toners T from rotation by frictional force, thus preventing occurrence of faulty cleaning for the spherical toner.

The image forming apparatus according to sixth to tenth embodiments includes, as illustrated in FIG. 2, a density sensor 19 that optically detects how much toner is deposited on the image carrier 11. The density sensor 19 outputs a detection signal in accordance with the amount of toner on the image carrier to a main control unit. The amount of toner on the image carrier is detected based on optical reflectivity. The mail control unit, which includes a CPU, calculates the amount of toner on the image carrier from the detection signal.

As for operation timing, the control is performed such that the operation is previously determined so as to output a set patch (a pattern of 1 cm×1 cm) right under the density sensor 19 when an image is not formed and the patch is periodically detected so that the developing condition becomes the best in the subsequent image forming process. The patch has preferably a size required for being detected by the density sensor 19, that is, as small area as possible because toner consumption becomes a large amount if the whole surface of the image carrier 11 is detected.

If the image carrier 11 is small in size, the density sensor 19 comprised of an optical sensor may not be disposed therein. In this case, a part of developer is passed through a tube, and a sensor for detecting a change in transmittance is disposed in the passage to estimate a toner amount to be consumed. The detection signal of this sensor is input into the main control unit to reduce it as an amount of toner consumption.

Further, if the sensor is not disposed or if reduction in detecting precision is insignificant, the amount of toner consumption can be estimated, for example, by counting a number of sheets to be output (a number of images to be formed) without provision of any sensor.

Although not shown, a temperature-humidity sensor for detecting environmental conditions is provided since the developer changes according to environmental conditions. An output of the temperature-humidity sensor is input into the main control unit to change an agitating condition of the developer and change a developing bias based on the environmental conditions.

The vibrating unit 23 in the cleaning device 16 is controlled by feedback based on the results of detection by the sensors to change a vibration amount of the blade member 21. Accordingly, the blade member 21 can be controlled to set optimal cleaning conditions according to such a state that an edge of the blade is degraded depending on an input toner amount (image area) or on a state of sliding contact (a number of output sheets). Furthermore, the optimal cleaning conditions can also be set according to a change in the mechanical abutting condition of the blade member 21 due to the environmental conditions.

Detailed structure of the cleaning device 16 will be explained below. This structure is basically the same as that of FIG. 3 to FIG. 6, and therefore characteristic points of the structure will be explained.

As explained above, the vibrating blade 20 includes the blade member 21, the vibratable member 22 to which the blade member 21 is fixed, and the vibrating unit 23 fixed to the vibratable member 22.

In the second embodiment, it is preferable to form at least a surface of the blade member 21 with a material having less affinity for toner to be used. Therefore, it is possible to prevent the toner from being deposited on or fixed to the surface of the blade member 21, thus reducing occurrence of faulty cleaning with time.

In this case, even by using a material, having less affinity for the surface of the blade member 21, as an external additive to be added to the outside of toner, it is possible to prevent the toner from being deposited on or fixed to the surface of the blade member 21 by the effect of the external additive, thus reducing occurrence of faulty cleaning with time. Further, if wax required for fixing is externally added to the surface of the toner, then it is possible to reduce such a phenomenon, so-called filming, that a thin film is deposited on the surface of the image carrier 11 caused by the wax.

As illustrated in FIG. 5 and FIG. 6, a plurality of vibrating units 23 are arranged in an axial direction (lateral direction) of the cleaning blade. Although the vibrating unit 23 may be formed with one unit, by arranging a plurality of units at intervals, uniform vibration in the lateral direction of the vibratable member 22 can easily be obtained. It is also conceivable to provide one elongated piezoelectric element, but if a plate-like piezoelectric element is used, it is preferable to arrange a plurality of units at intervals because the plate-like piezoelectric element uses deflection due to elongation and shrinkage thereof in a direction along the plate face.

The vibrating unit 23 is provided on the front part of the vibratable member 22 close to the image carrier 11, that is, in the free end 22*a* of the vibratable member 22 and on the side opposite to the fixed face of the blade member 21. A fixed position of the vibrating unit 23 is not particularly specified depending on the structure of the vibratable member 22 if the vibrating unit 23 can vibrate the vibratable member 22 between the fixed end of the vibratable member 22 and the blade edge (free end).

As illustrated in FIG. 4, the single-plate piezoelectric element forming the vibrating unit 23 has the electrodes 23*b* and 23*c* formed of printed and baked Ag or the like on both sides of the piezoelectric layer 23*a* formed of titanic acid zircon acid lead or the like, that is, on a junction face with the vibratable member 22 and the opposite face. The piezoelectric element (piezoelectric layer 23*a*) having a thickness of from 0.3 to 0.5 millimeters obtained by being polarized by the electrodes 23*b* and 23*c* is applied with a voltage of 100 to 300 volts, and shrinkage is thereby generated in the plate face direction. Consequently, the vibratable member 22 can be deflected by the deflective vibration. The deflective vibration is effective in deformation when the stiffness of the piezoelectric element (vibrating unit 23) is almost the same as that of the vibratable member 22. Therefore, it is preferable to use a metal vibratable member 22 having a thickness of, for example, 0.2 to 0.4 millimeters, or a resin vibratable member having a thickness of 0.3 to 1.0 millimeters.

Figure 22:
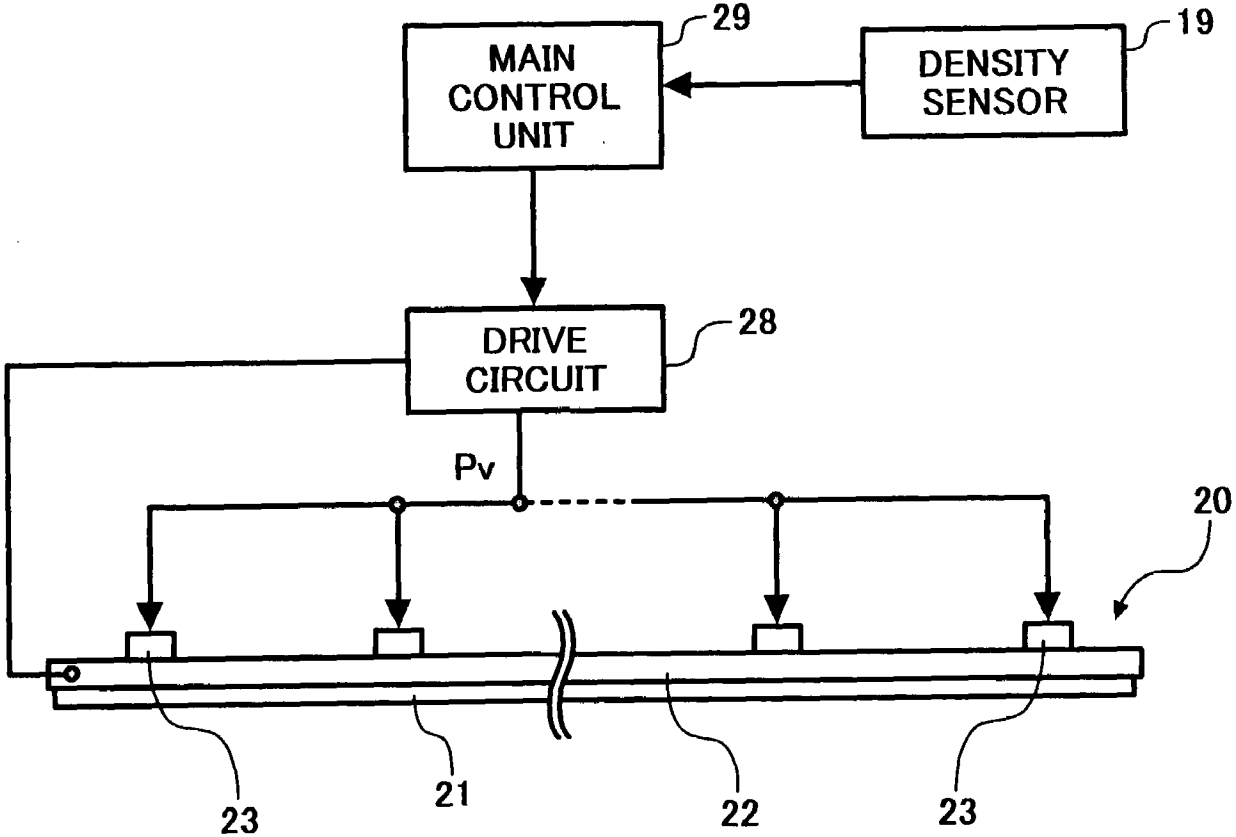
FIG. 22 illustrates an example of a drive system for the cleaning device according to a sixth embodiment of the present invention.

As illustrated in FIG. 22, the cleaning device 16 has a drive circuit 28 that commonly applies a drive signal Pv to the piezoelectric elements forming the vibrating units 23 of the vibrating blade 20. As explained above, when the vibrating units are provided in the lateral direction of the blade member, the common drive circuit 28 drives the units, and it is thereby possible to increase uniformity of the vibration in the lateral direction of the blade member.

The drive circuit 28 is controlled by a main control unit 29 of the image forming apparatus, and issues the drive signal Pv to the vibrating unit 23 at a predetermined timing. In the embodiment, one unit of the vibrating blade 20 performs cleaning in the whole width of the lateral direction of the image carrier 11. However, plural units of the vibrating blade 20 may be disposed to cover the whole width of the lateral direction. In this case also, the common drive circuit can drive the respective vibrating units of the vibrating blades 20.

In the sixth embodiment, by using a metal member (conductive member) as the vibratable member 22, each electrode 23*c* of the piezoelectric elements forming the vibrating units 23 is in direct contact with the vibratable member 22 to make an electrical connection, and thereby the electrodes 23*c* of the vibrating units 23 are commonly connected to each other through the vibratable member 22. Accordingly, the drive signal can be applied with a simple circuit configuration. The direct contact can be easily obtained by finishing the junction face as a rough face and joining it with the vibratable member 22 with a thin adhesive layer. In addition to this method, junction may be made using a conductive adhesive.

In the cleaning device 16 thus structured, the drive circuit 28 issues the drive signal Pv having a required frequency to the plurality of vibrating units 23, and thereby the piezoelectric elements forming the vibrating units 23 are deflected to vibrate the vibratable member 22. This vibration of the vibratable member 22 allows the blade member 21 to vibrate.

The vibrating unit 23 vibrates the vibratable member 22 to allow the edge of the blade member 21 to vibrate. Through this vibration, it is possible to prevent rotation of the spherical toners by the frictional force, vibrate the toners near the blade nip part to form a vibrating toner wall, and eliminate occurrence of curling of the blade member 21 in the moving direction (in the direction of arrow A) of the image carrier 11. It is thereby possible to prevent the spherical or fine toners from entering into the blade nip part, thus preventing faulty cleaning of the spherical or fine toners. Furthermore, the stress from the blade member to the image carrier is reduced, and it is thereby possible to obtain an extremely advantageous effect that the durability of the blade member and the image carrier is improved.

In the configuration shown in FIG. 22, the main control unit 29 is configured to detect an amount of toner deposition on the surface of the image carrier 11 based on the detection signal of the density sensor 19, control to drive the drive circuit 28 based on the detected result, and change the vibration amount of the blade member 21. In this case, toner conditions near the edge of the blade member 21 can be detected, and therefore cleaning conditions can be optimized so as to maintain a sufficient cleaning state.

As explained above, by allowing the vibration amount of the blade member 21 to be changed, for example, by changing the vibration amount depending on whether an image is formed, foreign matter such as paper dust or toner deposited on the blade member 21 can be removed.

Further, the vibration amount is changed based on a number of output sheets (number of images formed), environmental conditions, and an amount of replenished toner in addition to the toner deposition amount on the image carrier 11. Therefore, optimal cleaning conditions can be maintained.

In this case, by changing the vibration amount of the blade member 21 based on a count value indicating the number of output sheets (number of formed images), it is possible to predict degradation of the blade member 21 with a simple configuration, thus optimizing the cleaning conditions. Further, by changing the vibration amount based on the result of detecting the environmental conditions, it is possible to change a mechanical abutting condition of the blade member 21 and optimize the cleaning conditions. Furthermore, by changing the vibration amount based on the result of detecting the replenished toner amount, it is possible to optimize the cleaning conditions without any sensor disposed near the image carrier.

Figure 23:
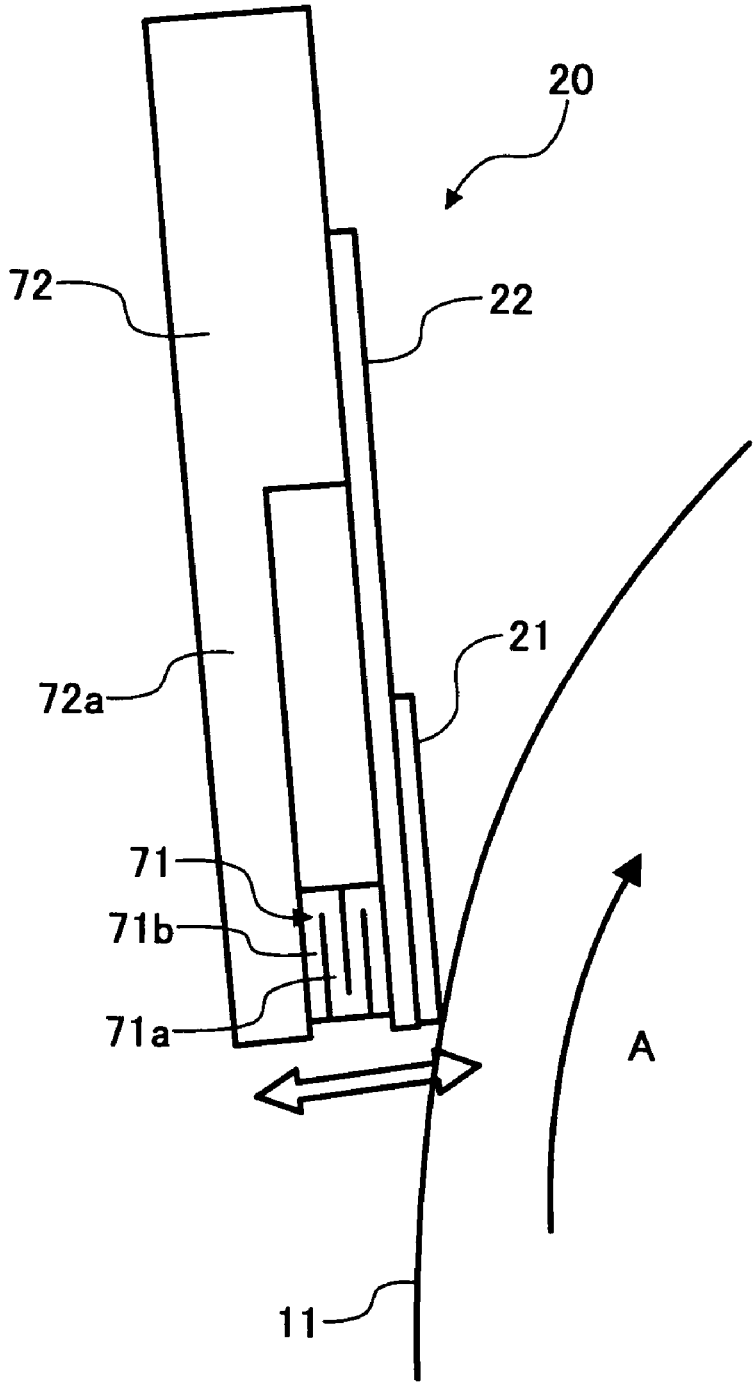
FIG. 23 illustrates a structure of a vibrating blade in the cleaning device according to a seventh embodiment of the present invention.

A seventh embodiment of the vibrating blade 20 in the cleaning device 16 will be explained below with reference to FIG. 23 and FIG. 24. In the seventh embodiment, a laminated type piezoelectric element is used as a vibrating unit 71 that vibrates the vibratable member 22. The laminated type piezoelectric element has a high natural frequency of 50 to 100 kilohertz and a generated displacement force is extremely large. Therefore, by using such a laminated type piezoelectric element, response to a frequency as far as a high frequency is easily realized even if the plate thickness of the vibratable member 22 is increased.

The laminated type piezoelectric element forming the vibrating unit 71 here is obtained by alternately laminating piezoelectric layers 71*a* each of 100 micrometers and internal electrodes 71*b*, and alternately pulling out both ends of the internal electrodes 71*b* to be connected to end electrodes (external electrodes). The piezoelectric element is structured to utilize displacement in d-33 direction as displacement in the laminating direction.

The piezoelectric element is also structured to utilize displacement in a face direction, i.e., in d-31 direction, perpendicular to the laminating direction in which a plurality of layers are laminated using the laminated type piezoelectric element. In this case, it is possible to allow the displacement amount to be a wider range, reduce a voltage to be lower, and reduce a driver (drive circuit) cost. When this structure is employed, the rest of the components other than the laminated type piezoelectric element forming the vibrating unit 71 are the same as those of FIG. 22.

The vibratable member 22 is formed with an elastically deformable thin plate, a fixed end of the vibratable member 22 is fixed to a fixed member 72 as a high-stiffness holder having a support part 72*a* facing the vibratable member 22, and a laminated type piezoelectric element as the vibrating unit 71 is disposed between the support part 72*a* of the fixed member 72 and the vibratable member 22. The blade member 21 is arranged in the front region of the vibratable member 22 on the side opposite to the vibrating unit 71 so that vibration from the vibrating unit 71 is transmitted to the blade member 21 through the vibratable member 22.

As explained above, the vibrating unit 71 is provided between the fixed part 72 and the vibratable member 22, thus efficiently transmitting the vibration to the vibratable member 22.

Figure 24:
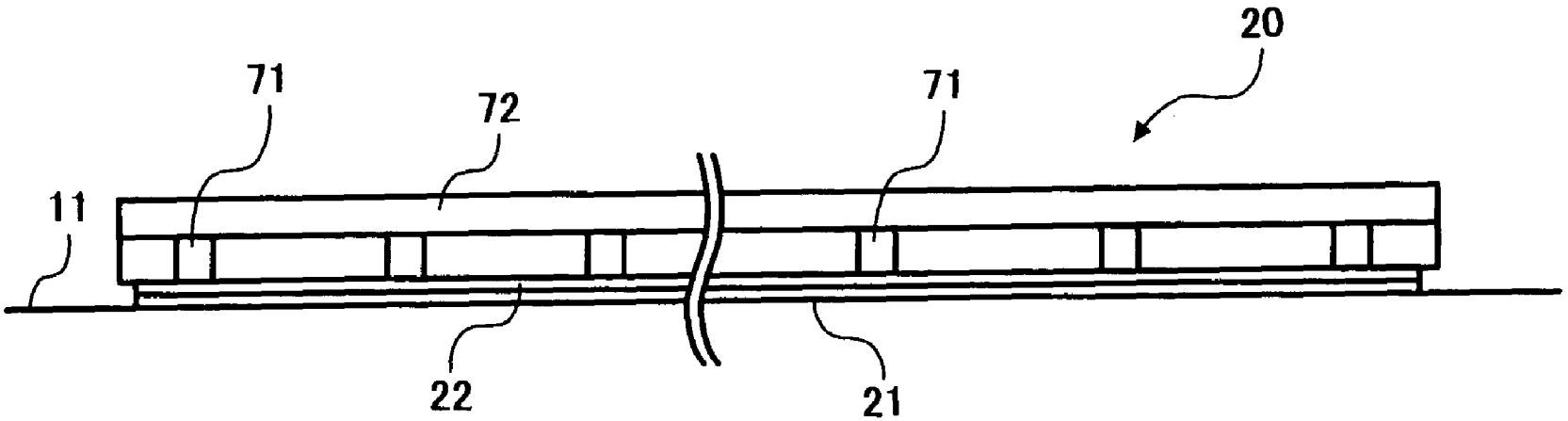
FIG. 24 is a plan view of a structure of the vibrating blade in FIG. 23 in the lateral direction of the image carrier.

The vibrating unit 71 is provided in plurality arranged in the lateral direction of the image carrier 11 as illustrated in FIG. 24. When the blade member 21 having a comparatively narrow width is used, the vibrating unit 71 may be structured as a single unit if a laminated type piezoelectric element having a large cross-sectional area is used.

Figure 25:
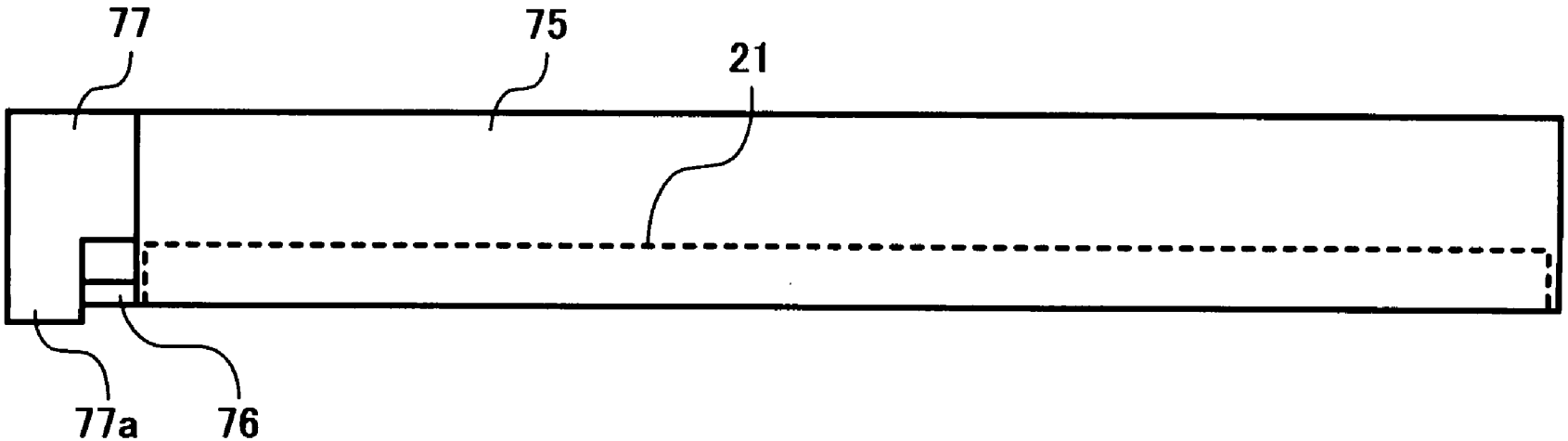
FIG. 25 illustrates another structural example of the vibrating blade in the cleaning device according to an eighth embodiment of the present invention.
Figure 26:
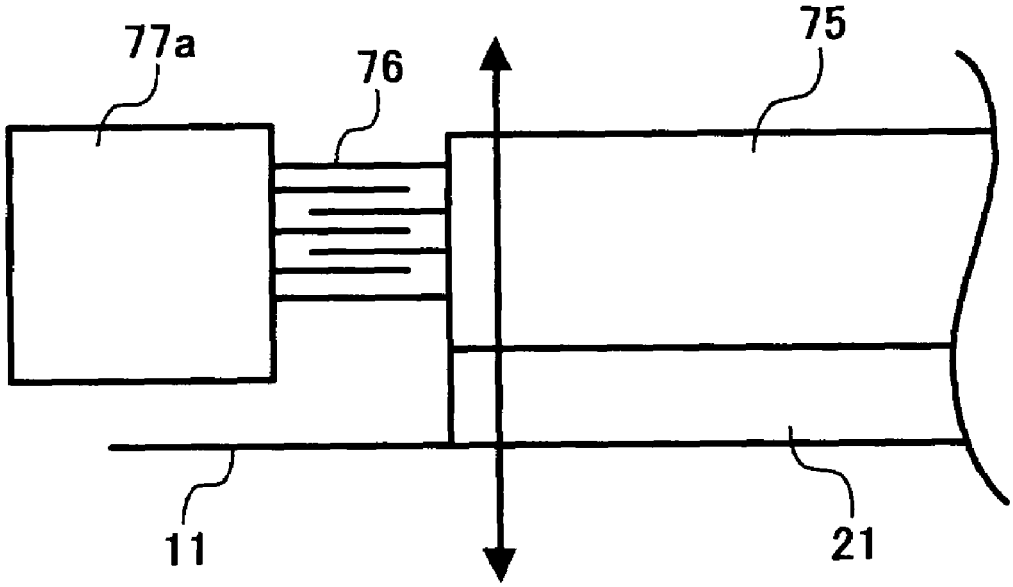
FIG. 26 illustrates the vibrating blade of FIG. 25 when viewed from the front side thereof.

An eighth embodiment of the vibrating blade 20 in the cleaning device 16 will be explained below with reference to FIG. 25 and FIG. 26. In the eighth embodiment, a holder 77 is fixed to a side end of a vibratable member 75 to which the blade member 21 is fixed, and a laminated type piezoelectric element 76 is fixed between a support part 77*a* of the holder 77 and the side end of the vibratable member 75. The laminated type piezoelectric element 76 is displaced in the direction of arrows in FIG. 26, and thereby the vibratable member 75 vibrates in the same direction.

A common drive circuit is provided to apply a drive signal to the vibrating units 23 and 71 and the laminated type piezoelectric element 76 according to the sixth to eighth embodiments. The drive circuit can be formed with a function generator that generates a pulse signal and a power source (driver) that amplifies the generated signal.

As explained above, if a plurality of piezoelectric elements are arranged to be operated or if image carriers for a plurality of colors and cleaning blades need to be arranged like a tandem machine, then a plurality of function generators and power sources may be used, or one and the same power source is branched into a plurality of lines and the piezoelectric elements are applied with signals from the lines, respectively. However, if a large number of lines are to be branched, then a power source having a higher capacity for output is preferred.

When the power source is used in the image forming apparatus or the process cartridge explained later, it is preferable to use a driver in which the function generator and the power source are integrated into one because a space-saving power source is preferred. In this case, drive control is performed by the main control unit for controlling the whole image forming apparatus and the process cartridge.

Therefore, the operating condition can be changed according to situations of the drive conditions, or the operation of the piezoelectric elements can be controlled in synchronization with the operation sequence for image formation or for non-image formation.

Toner as image visualizing particles used in the present invention will be explained below.

The sphericity of the toner is explained first. In order to form a high quality image in the image forming apparatus using spherical toner, it is important that the toner has a particular shape. If the toner has an average sphericity of less than 0.95 and the shape of the particles is irregular, as against spherical, then it is impossible to obtain a high quality image with toner having high transfer capability without dust (that is, toner splashes deposited on a non-image portion). Therefore, the sphericity of spherical toner is preferably 0.95 or more.

An appropriate method of measuring the shape of toner is a method using an optical detection band. The method is realized by passing a suspension containing particles through a detection band of an imaging unit on a plate, optically detecting a particle image by a charge-coupled device (CCD) camera, and analyzing the detected image. In this method, an average sphericity is a value obtained by dividing "a circumferential length of a circle equivalent to an image projected area of a particle obtained by this method" by "a circumferential length of an actual particle". It is found that toner having the average sphericity of 0.95 or more is effective in formation of a high-resolution image with appropriate density reproducibility. It is noted that the definition of the sphericity has been explained with reference to FIG. 19.

It is preferable that the sphericity of the toner is 0.960 to 0.998. This value can be measured as an average sphericity using a flow system particle image analyzer FPIA-2000 (product name, produced by Toa Iyodenshi Co.). The concrete measuring method is as follows. A container that contains 100 to 150 milliliters of pure water is kept ready. A surface-active agent as a dispersant, preferably, 0.1 to 0.5 milliliter of alkyl benzene sulfonate is added in the container, and about 0.1 to 0.5 gram of measurement sample is also added to the water. The sphericity is obtained by subjecting a suspension into which the sample is dispersed to dispersion for about 1 to 3 minutes by a supersonic disperser, and measuring a shape of toner and a distribution of the toner particles by the analyzer based on the concentration of the dispersant of 3,000 to 10,000 pieces per microliter.

A toner particle size can be measured as follows. That is, an average particle size of toner and a size distribution of particles were subjected to data analysis by Coulter Multi-Sizer III (product name, produced by Coulter Co.) with a personal computer (produced by IBM) connected thereto, using dedicated analysis software produced by Coulter Co. A Kd value was set using a standard particle of 10 micrometers, and an aperture current was automatically set. An electrolyte was obtained by preparing 1% of NaCI aqueous solution using primary sodium chloride. In addition to them, ISOTON-II (product name, produced by Coulter Scientific Japan Co.) can be used.

The measuring method is as follows. That is, a surface-active agent as a dispersant, preferably, 0.1 to 5.0 milliliters of alkyl benzene sulfonate is added to the 100 to 150 milliliters of electrolytic water, and 2 to 20 grams of measurement sample is also added to the water. The electrolyte with the sample suspended therein was subjected to dispersion for about 1 to 3 minutes by a supersonic disperser, and 50,000 counts of toner particles of 2 micrometers or more were measured using a 100-micrometer aperture tube to determine a weight average particle size.

A method of producing polymerized spherical toner will be explained below.

The method of producing toner having a sphericity of 0.960 to 0.998 used in the image forming apparatus includes producing methods based on wet granulation such as a suspension polymerization method, an emulsion polymerization method, a dispersion polymerization method, an interfacial polymerization method, a dissolved suspension polymerization method, and a phase-inversion emulsifying method. Further, toner obtained through pulverization and classification of a fused and kneaded mixture can be produced as toner having a high sphericity by being heated, but this method is not preferable from a viewpoint of energy efficiency.

Among the methods as the wet granulation method, the suspension polymerization method and the dispersion polymerization method are excellent in points that toner having high sphericity is stably obtained, that a sharp size distribution of particles is obtained, and that charging of toner is controlled. Further, the dissolved suspension polymerization method is excellent in a point that polyester resin is used. This resin is effective in that toner can be fixed at a low temperature. The suspension polymerization method, the emulsion polymerization method, the dispersion polymerization method, and the dissolved suspension polymerization method will be explained in detail below.

Suspension Polymerization Method

A dispersion stabilizer and a colorant, further a crosslinking agent, a charge control agent, and a parting agent, if necessary, were uniformly dispersed into a particular monomer explained later, by a ball mill, and a polymerization initiator was added thereto to obtain a monomer phase. The monomer phase and an aqueous dispersion medium phase prepared by agitation in advance were input into a agitating vessel, were agitated by a homogenizer or the like to obtain a suspension. The suspension is nitrogen-substituted and heated to complete polymerization reaction. Thereby, colored resin particles were obtained, and the particles were cleaned and dried to obtain toner particles having a high sphericity.

A polymerizable monomer used for suspension polymerization is a monomer having a vinyl group. More specifically, the monomer includes styrenic monomers and derivatives thereof such as styrene, o-methyl styrene, m-methyl styrene, p-methyl styrene, 2,4-dimethyl styrene, butyl styrene, and octyl styrene. Among these, a styrene monomer is most preferable.

Another vinyl monomer includes an ethylene type unsaturated monoolefin group such as propylene, butylene, and isobutylene; a vinyl halide group such as vinyl chloride, vinylidene chloride, vinyl bromide, and vinyl fluoride; a vinyl ester group such as vinyl acetate, vinyl propionate, vinyl benzoate, and vinyl butyrate; an α-methylene aliphatic monocarboxylate group such as methyl acrylate, ethyl acrylate, n-butyl acrylate, isobutyl acrylate, propyl acrylate, n-octyl acrylate, dodecyl acrylate, 2-ethyl hexyl acrylate, stearyl acrylate, 2-chloroethyl acrylate, phenyl acrylate, α-chloromethyl acrylate, methyl methacrylate, ethyl methacrylate, propyl methacrylate, n-butyl methacrylate, isopropyl methacrylate, n-octyl methacrylate, dodecyl methacrylate, 2-ethyl hexyl methacrylate, stearyl methacrylate, phenyl methacrylate, and diethylaminoethyl methacrylate; acrylic or methacrylic derivatives such as acrylonitrile, methacrylonitrile, and acrylamide; a vinyl ether group such as vinyl methyl ether, and vinyl isobutyl ether; a vinyl ketone group such as vinyl methyl ketone, vinyl hexyl ketone, methyl isopropenyl ketone; and an N-vinyl compound group such as N-vinyl pyrrole, N-vinyl carbazole, N-vinyl indole, and N-vinyl pyrrolidone; and vinyl naphtalene. These monomers can be used singly or in admixture.

In the suspension polymerization method, to generate a crosslinked polymer in a monomer composition, such a crosslinking agent as explained below is used for suspension polymerization. The crosslinking agent includes divinylbenzene, divinylnaphtalene, polyethylene glycol diacrylate, diethylene glycol diacrylate, triethylene glycol diacrylate, 1,3-butylene glycol diacrylate, 1,6-hexane glycol dimethacrylate, neopentyl glycol diacrylate, dipropylene glycol dimethacrylate, polypropylene glycol dimethacrylate, 2,2'-bis(4-methacryloxydiethoxyphenyl) propane, 2,2'-bis (4-acryloxydiethoxyphenyl) propane, trimethylolpropane trimethacrylate, trimethylolmethane tetraacrylate, dibromneopentyl glycol dimethacrylate, and diallyl phthalate.

If the crosslinking agent is used too much, toner is hard to be fused by heat, and thermal fixability and thermal pressure fixability are degraded. On the other hand, if the crosslinking agent is used too less, characteristics required for toner such as blocking resistant capability and durability are lowered. Therefore, a part of toner particles is not perfectly fixed to a sheet of paper when fixing is performed by a heating roller, but is deposited on the surface of the roller. Consequently, the toner deposited on the surface is transferred to the next sheet, that is, cold offset occurs. Therefore, an amount of the crosslinking agent in use is 0.001 to 15 weight parts, preferably 0.1 to 10 weight parts in 100 parts by weight of polymerizable monomer.

A dispersion stabilizer that can be used in the suspension polymerization method includes those as follows. That is, water-soluble polymers such as polyvinyl alcohol, starch, methyl cellulose, carboxymethylcellulose, hydroxymethylcellulose, sodium polyacrylate, and sodium polymethacrylate; barium sulfate; calcium sulfate; barium carbonate; magnesium carbonate; calcium phosphate; talc; clay; diatomaceous earth; and metal oxide powder. Any of these stabilizers is preferably used in a range of from 0.1 to 10 parts by weight in water.

The polymerization initiator in the suspension polymerization method may be added into a dispersant containing the monomer composition after granulation, but it is preferable to contain the polymerization initiator in the monomer composition before granulation from the viewpoint of uniformly distributing the polymerization initiator to each particle of the monomer composition. Such a polymerization initiator includes those as follows: azo or diazo polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methyxy-2,4-dimethylvaleronitrile, and azobis butyronitrile; and peroxide type polymerization initiators such as benzoyl peroxide, methyl ethyl ketone peroxide, isopropyl peroxide, 2,4-dichloryl benzoyl peroxide, and lauryl peroxide.

In the suspension polymerization method, a magnetic body containing type of magnetic toner can be used. The magnetic toner is obtained by adding magnetic particles to a monomer composition. The magnetic body that can be used in the present invention includes powder of ferromagnetic metal such as iron, cobalt, and nickel; or powder of alloys and compounds of magnetite; hematite, and ferrite.

The magnetic particle having a particle size of from 0.05 to 5 micrometers, preferably 0.1 to 1 micrometers is used. If fine toner is to be generated, a magnetic particle having a particle size of 0.8 micrometer or less is preferable. This type of magnetic particles is preferably contained at 10 to 60 weight parts in 100 parts by weight of monomer composition. Further, these magnetic particles may be treated by a surface treatment agent such as a silane coupling agent and a titanium coupling agent, or a resin having appropriate reactivity. In this case, sufficient dispersibility into the monomer composition can be obtained through treatment by the surface treatment agent generally containing 5 weight parts or less, preferably 0.1 to 3 weight parts in 100 parts by weight of magnetic particles. This type of agent does not exert an effect on properties of toner.

Emulsion Polymerization Method

A method of producing spherical toner particles using the emulsion polymerization method will be explained below.

The emulsion polymerization method is a method of capable of producing toner particles having an appropriate particle size by aggregating particles of submicron order while being controlled. The toner particles produced by this method are characterized in that a distribution of particle size (toner particle diameter) tends to be quite narrow. As a method of forming spherical toner, a method of producing toner particles having a perfect sphericity in shape by spray-drying latex obtained by the emulsion polymerization method, has been proposed.

Dispersion Polymerization Method

A polymeric dispersant that dissolves in a hydrophilic organic solvent is added into the hydrophilic organic solvent. Then, one or more types of vinyl monomer is added to the obtained hydrophilic organic solvent and polymerized to obtain toner. More specifically, the vinyl monomer is dissolved in the hydrophilic solvent but a polymer to be generated is swollen by the hydrophilic solvent or is hardly dissolved therein. A reaction as follows is also included in the method. That is, polymer particles those are smaller than a target particle size and whose distribution is narrow, are used to grow polymers previously in the system. A monomer used in growing reaction may be the same monomer as that from which seed particles are produced, or another monomer, but the polymer should not be dissolved in the hydrophilic organic solvent.

A hydrophilic organic solvent as a diluent for a monomer used at the time of forming the particles and at the time of growing and reacting the seed particles includes those as follows as typical ones: an alcohol group such as methyl alcohol, ethyl alcohol, denatured ethyl alcohol, isopropyl alcohol, n-butyl alcohol, isobutyl alcohol, t-butyl alcohol, s-butyl alcohol, t-amyl alcohol, 3-pentanol, octyl alcohol, benzyl alcohol, cyclohexanol, furfuryl alcohol, tetrahydrofurfuryl alcohol, ethylene glycol, glycerol, and diethylene glycol; and an ether alcohol group such as methyl cellosolve, Cellosolve, isopropyl cellosolve, butyl cellosolve, ethylene glycol monomethyl ether, ethylene glycol monoethyl ether, diethylene glycol monomethyl ether, and diethylene glycol monoethyl ether.

These organic solvents can be used singly or in admixture. By using any organic solvent, other than the alcohol group and the ether alcohol group, in combination with the alcohol group and the ether alcohol group, it is possible to suppress the size of generated particles, aggregation of seed particles, and occurrence of new particles by changing solubility parameter (SP) values of the organic solvent to various values and polymerizing under the condition that the organic solvent does not allow the generated polymer particles to have dissolubility.

Organic solvents in combination with each other in this case include a hydrocarbon group such as hexane, octane, petroleum ether, cyclohexane, benzene, toluene, and xylene; a hydrocarbon halide group such as a carbon tetrachloride, trichlorethylene, and tetrabromethane; an ether group such as ethyl ether, dimethyl glycol, siloxane, and tetrahydrofuran; an acetal group such as methylal, and diethylcetanol; a ketone group such as acetone, methyl ethyl ketone, methyl isobutyl ketone, and cyclohexane; an ester group such as butyl formate, butyl acetate, ethyl propionate, and cellosolve acetate; an acid group such as formic acid, acetic acid, and propionic acid; a sulfur or nitrogen containing organic compound group such as nitropropene, nitrobenzene, dimethylamine, monoethanolamine, pyridine, dimethyl sulfoxide, and dimethyl formamide; and water.

By changing a type and a composition of a combined solvent according to an initial stage of polymerization, a middle stage thereof, and a last stage thereof, it is possible to adjust an average particle size, a size distribution, and a drying condition of polymer particles to be generated.

An appropriate example of the polymeric dispersant used in producing seed particles or in producing particles to be grown includes an acid group such as an acrylic acid, methacrylic acid, α-cyanoacrylic acid, α-cyanomethacrylic acid, itaconic acid, crotonic acid, fumaric acid, maleic acid, or maleic unhydride; acryl type monomers containing a hydroxyl group such as acrylic acid β-hydroxyethyl, methacrylic acid β-hydroxyethyl, acrylic acid β-hydroxypropyl, methacrylic acid β-hydroxypropyl, acrylic acid γ-hydroxypropyl, methacrylic acid γ-hydroxypropyl, acrylic acid 3-chloro-2-hydroxypropyl, methacrylic acid 3-chloro-2-hydroxypropyl, diethylene glycol monoacrylic ester, diethylene glycol monomethacrylic ester, glycerol monoacrylic ester, glycerol monomethacrylic ester, N-methylol acrylamide, and N-methylol methacrylamide; vinyl alcohol or an ether group with vinyl alcohol such as vinyl methyl ether, vinyl ethyl ether, and vinyl propyl ether; an ester group of a compound containing vinyl alcohol and a carboxyl group such as vinyl acetate, vinyl propionate, vinyl butyrate, acrylamide, methacrylamide, diacetone acrylamide, or a methylol compound of these components; an acid chloride group such as chloride acrylate, and chloride methacrylate; homopolymers or copolymers having a nitrogen atom or heterocyclic of the atom such as vinyl pyridine, vinyl pyrrolidine, vinyl imidazole, and ethyleneimine; an polyoxyethylene series such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester, and polyoxyethylene nonylphenyl ester; a cellulose group such as methyl cellulose, hydroxyethyl cellulose, and hydroxypropyl cellulose; monomers having a benzene nucleus or derivatives thereof such as the hydrophilic monomer, styrene, α-methyl styrene, and vinyl toluene; copolymers with acrylic acid or a methacrylic acid derivative such as acrylonitrile, methacrylonitrile, acrylamide; and copolymers with a crosslinking monomer such as ethylene glycol dimethacrylate, diethylene glycol dimethacrylate, aryl methacrylate, and divinylbenzene.

These polymeric dispersants are selected as required according to a hydrophilic organic solvent to be used, a seed of target polymer particle, and according to whether a seed particle is produced or a particle for growth is produced. Any appropriate one of the polymeric dispersants is selected based on a purpose that aggregation of polymer particles is mainly prevented in a multilevel. The selected one should have an affinity for the surface of the polymer particle, high absorption capability, an affinity for the hydrophilic organic solvent, and have a high solubility. Further, in order to enhance repulsion of particles against each other, a particle with a particle chain having a certain length, preferably with a molecular weight of 10,000 or more is selected. However, if the molecular weight is too high, the viscosity of the liquid is extremely increased, and therefore operability and agitating performance are decreased. The decrease causes the generated polymer deposited on the particle surface to be variable, and therefore the selection must be performed with care. Further, it is effective in stability that a part of the monomers of the polymeric dispersant is made coexist with a monomer forming a target particle.

It is further possible to enhance improvement of stability of generated polymer particles and a size distribution of the particles by using those as follows together with these polymeric dispersants. That is, metal or metal alloys (a particle size of 1 micrometer or less is particularly preferable) such as cobalt, iron, nickel, aluminum, copper, tin, zinc, and magnesium; fine powder of inorganic compound of oxide such as iron oxide, copper oxide, nickel oxide, zinc oxide, titanium oxide, and silicone oxide; anion surface-active agents such as higher alcohol sulfate, alkyl benzene sulfonate, α-olefin sulfonate, and phosphate; cation surface-active agents of an amine salt type such as. alkylamine salt, an aminoalcohol fatty acid derivative, a polyamine fatty acid derivative, and imidazoline, or of a quaternary ammonium salt type such as alkyltrimethyl ammonium salt, dialkyldimethyl ammonium salt, alkyldimethyl benzyl ammonium salt, pyridium salt, alkylisoquinolium salt, and benzetonium chloride; non-ion surface-active agents such as a fatty acid amide derivative, and a polyhydric alcohol derivative; and amino acid type or betaine type duplex surface-active agents such as an alanine type (e.g., dodecyl di (aminoethyl) glycine, and di (octyl aminoethyl) glycine.

Generally, an amount of polymeric dispersant to be used when seed particles are produced is 0.1 to 10 percent by weight, preferably 1 to 5 percent by weight in a hydrophilic organic solvent although the amount is different depending on a type of polymerizable monomer for formation of a target polymer particle. If the concentration of the polymer dispersion stabilizer is low, the size of generated polymer particles is comparatively larger, and if the concentration is high, the size of generated polymer particles is comparatively smaller. However, even if concentration exceeds 10 weight %, there is little effect on size reduction.

The vinyl monomer is soluble in a hydrophilic organic solvent, and indicates a single monomer or a mixture of those as follows, or a mixture of monomers that contain those at 50 weight % or more and can copolymerize with those. That is, the vinyl monomer includes, for example, a styrene group such as styrene, o-methyl styrene, m-methyl styrene, p-methyl styrene, α-methyl styrene, p-ethyl ethylene, 2,4-dimethyl styrene, p-n-butyl styrene, p-tert- butyl styrene, p-n-hexyl styrene, p-n-octyl styrene, p-n-nonyl styrene, p-n-decyl styrene, p-n-dodecyl styrene, p-methoxy styrene, p-phenyl styrene, p-chlorostyrene, and 3,4-dichlorostyrene; α-methyl fatty acid monocarboxylate group such as methyl acrylate, ethyl acrylate, n-butyl acrylate, isobutyl acrylate, propyl acrylate, n-octyl acrylate, dodecyl acrylate, lauryl acrylate, 2-ethyl hexyl acrylate, stearyl acrylate, 2-chloroethyl acrylate, phenyl acrylate, α-chloromethyl acrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethyl hexyl methacrylate, stearyl methacrylate, phenyl methacrylate, dimethylaminoethyl methacrylate, and diethylaminoethyl methacrylate; acrylic or methacrylic derivatives such as acrylonitrile, methacrylonitrile, and acrylamide; and a vinyl halide group such as vinyl chloride, vinylidene chloride, vinyl bromide, and vinyl fluoride.

The polymer in the present invention may be a polymer having at least two polymerizable double bonds, i.e., being polymerized under the presence of a so-called crosslinking agent, in order to increase offset resistance. The preferable crosslinking agent includes aromatic divinyl compounds such as divinylbenzene, divinylnaphtalene, and derivatives thereof; diethylene carboxylates such as ethylene glycol dimethacrylate, diethylene glycol methacrylate, triethylene glycol methacrylate, trimethylolpropane triacrylate, aryl methacrylate, tert-butylaminoethyl methacrylate, tetraethylene glycol dimethacrylate, and 1,3-butanediol dimethacrylate; all types of divinyl compounds such as N,N-divinyl aniline, divinyl ether, divinyl sulfide, divinyl sulfone; and compounds having at least three vinyl groups. These can be used singly or in admixture.

As explained above, when growth polymerization reaction is continuously performed using the crosslinked seed particles, the internal side of growing polymer particles is crosslinked. On the other hand, when the crosslinking agent is contained in the vinyl monomer solution used for growth reaction, a polymer having particles with hardened surface is obtained.

In order to adjust an average molecular weight, compounds having a large chain transfer constant are made coexist to be polymerized. The compounds include, for example, a low molecular compound having a mercapto group, carbon tetrachloride, and carbon tetrabromide.

Those as follows to be used as the polymerization initiator for the monomer include azo polymerization initiators such as 2,2'-azobisisobutyronitrile, and 2,2'-azobis-(2,4-dimethylvaleronitrile); peroxide type polymerization initiators such as lauryl peroxide, benzoyl peroxide, and t-butyl peroxtoate; persulfate compound type polymerization initiators such as potassium persulfate; and a combination type of sodium thiosulfate and amine with the agents. The concentration of the polymerization initiator is preferably 0.1 to 10 weight parts in the 100 parts by weight of vinyl monomer.

As polymerizing conditions for obtaining seed particles, a polymeric dispersant in a hydrophilic organic liquid, a concentration of a vinyl monomer, and a mixing ratio of the monomers are determined according to a target average particle size and a target size distribution of polymer particles. Generally, if the average particle size is made smaller, the concentration of the polymeric dispersant is set higher, while the concentration of the polymeric dispersant is set lower if the average particle size is made larger. On the other hand, if the particle size distribution is made sharper, the concentration of the vinyl monomer is set lower, while the concentration of the vinyl monomer is set higher if the particle size distribution may be comparatively wider.

The particles are produced by processes as follows. That is, after the polymer dispersion stabilizer is fully dissolved in a hydrophilic organic liquid, one or more types of vinyl monomers, polymerization initiator, and, if required, inorganic fine powder, a surface-active agent, a dye, and a pigment are added into the liquid, the liquid is agitated generally at 30 to 300 rpm, preferably at a speed as low as possible. The liquid is heated at a temperature according to a polymerizing speed of the polymerization initiator and polymerized while agitated at a speed so that the flow in the vessel is uniform using a turbine type impeller that is better than a paddle type.

Since the temperature at the initial stage of the polymerization largely affects the particle seeds to be grown, it is preferable that the temperature is increased up to a temperature required for polymerization after monomers are added, the polymerization initiator is dissolved in a small amount of solvent to be charged into the liquid. It is necessary for polymerization to sufficiently purge oxygen in the air from a reactor using inactive gas such as nitrogen gas or argon gas. If the oxygen is insufficiently purged, fine grains are easily produced. The time for polymerization requires 5 to 40 hours to perform polymerization in a high conversion. However, it is possible to increase a polymerizing speed by stopping the polymerization at a state where a desired particle size and a desired size distribution are obtained, sequentially adding the polymerization initiators, or performing reaction under high pressure.

After the polymerization is finished, the polymerized particles may be used in a dyeing process as they are. Alternatively, dyeing may be performed by removing unnecessary fine grains, residual monomers, and polymer dispersion stabilizer through operation such as sedimentation, centrifugation, and decantation, and recovering the solvent as polymer slurry. However, a method without removing the dispersion stabilizer is higher in dyeing stability, and unnecessary aggregation is suppressed.

Dyeing in the dispersion polymerization method is such as follows. The method of producing dyed toner includes steps of dispersing resin particles in an organic solvent that does not dissolve the resin particles, dissolving a dye in the solvent before or after the dispersion, penetrating the dye into the resin particles to dye them, and removing the organic solvent. In this method, the dye as follows is selectively used. More specifically, the dye has a relation between a solubility (D1) of the dye in the organic solvent and a solubility (D2) of the dye in the resin of the resin particle A is $(D1)/(D2)<0.5$. Therefore, it is possible to efficiently produce toner in which the dye is penetrated (diffused) into the depths of the resin particles.

The solubility in the present invention is measured at a temperature of 25° C. The solubility of the dye in the resin mentioned here is defined in the same manner as that of the solubility of the dye in the solvent, and indicates a maximum possible amount at which the dye can be contained in the resin in a compatible state. The soluble state or the dye precipitated state can be easily observed by a microscope. In order to study the solubility of a dye in resin a method of indirect observation may be used instead of the method of direct observation. In the indirect method, a liquid having a solubility coefficient approximate to that of resin, i.e., a solvent for sufficiently dissolving the resin is used, and the solubility of the dye in the solvent may be determined as a solubility in resin by using the solvent.

The dye should be such that, the ratio (D1)/(D2) is 0.5 or less, and preferably 0.2 or less. The dye is not particularly limited if it satisfies the solubility properties. However, a water-soluble dye such as a cationic dye and an anion dye may cause environment to be largely varied, and electric resistance of toner is decreased and transfer rate may thereby be reduced. Therefore, it is preferable to use a vat dye, a disperse dye, and oil color, and the oil color is particularly preferable. Furthermore, several types of dyes can be used together according to desired color tone.

A ratio (weight) between a dye for coloring and a resin particle is selected arbitrarily according to a tinctorial strength. Generally, it is preferable that these components are used in the proportions of 1 to 50 parts by weight of dye to 1 part by weight of resin particle. For example, if the alcohol group such as methanol or ethanol having a high SP value is used for a dyeing solvent and a styrene-acrylic type resin having an SP value of about 9 is used as a resin particle, dyes to be used include those as follows.

C. I. SOLVENT YELLOW (6, 9, 17, 31, 35, 1, 102, 103, 105)

C. I. SOLVENT ORANGE (2, 7, 13, 14, 66)

C. I. SOLVENT RED (5, 16, 17, 18, 19, 22, 23, 143, 145, 146, 149, 150, 151, 157, 158)

C. I. SOLVENT VIOLET (31, 32, 33, 37)

C. I. SOLVENT BLUE (22, 63, 78, 83–86, 91, 94, 95, 104)

C. I. SOLVENT GREEN (24, 25)

C. I. SOLVENT BROWN (3, 9)

As commercially available dyes, those as follows can be used, that is, Aizen SOT dyes Yellow-1, 3, 4, Orange-1, 2, 3, Scarlet-1, Red-1, 2, 3, Brown-2, Blue-1, 2, Violet-1, Green-1, 2, 3, Black-1, 4, 6, 8, produced by Hodogaya Chemical Co. Ltd.; Sudan dyes Yellow-140, 150, Orange-220, Red-290, 380, 460, Blue-670, produced by BASF Ltd.; Diaresin Yellow-3G, F, H2G, HG, HC, HL, Orange-HS, G, Red-GG, S, HS, A, K, H5B, Violet-D, Blue-J, G, N, K, P, H3G, 4G, Green-C, Brown-A, produced by Mitsubishi Chemical Corp.; Oil color Yellow-3G, GG-S, #105, Orange-PS, PR, #201, Scarlet-#308, Red-5B, Brown-GR, #416, Green-BG, #502, Blue-BOS, HN, and Black-HBB, #803, EE, EX, produced by Orient Chemical Industries, Ltd.; Sumiplast Blue-GP, OR, Red-FB, 3B, Yellow-FL7G, GC, produced by Sumitomo Chemical Co., Ltd.; Kayaron Polyester Black EX-SH3, Kayaset Red-B, Blue-A-2R, produced by Nippon Kayaku Co., Ltd. It is needless to say that the dyes are not limited to the examples because the dyes are selected as required according to a combination of particle resin and a solvent used for dyeing.

As an organic solvent in the use for dyeing a dye into a resin particle, any of those as follows is used, such as a solvent in which resin particles are not dissolved and a solvent in which resin particles are slightly swollen. More specifically, a solvent in which a difference between solubility parameters (SP values) is 0.1 or more, preferably 2.0 or more, is used. For example, for styrene-acrylic type resin particles, an alcohol type such as methanol, ethanol, n-propanol each of which has a high SP value, or n-hexane and n-heptane each of which has a low SP value, are used. If the difference between the SP values is too large, wetting of the solvent to the resin particle gets worse and sufficient dispersion of the resin particles cannot be obtained. Therefore, an optimal difference between the SP values is preferably 2 to 5.

It is preferred that the resin particles are dispersed in the organic solvent with the dye dissolved, a liquid temperature is kept to a glass transfer temperature of the resin particles or less, and the solution is agitated. Accordingly, it is possible to dye the resin particles while the resin particles are prevented to be aggregated. A method of agitating the particles may be realized by agitating using a commercially available agitator such as a homomixer and a magnetic stirrer. Further, a dye may be directly added to slurry obtained when polymerization in the dispersion polymerization is finished, that is, to a dispersant such that polymerized resin particles are dispersed in the organic solvent and are heated and agitated under the conditions. If the heating temperature exceeds the glass transfer temperature, fusing occurs between the resin particles. A method of drying the dyed slurry is not particularly limited, and therefore the slurry may be dried under reduced pressure after filtering or may be directly dried under reduced pressure without separation through filtering. In the present invention, the colored particles obtained by being subjected to air drying or drying under reduced pressure after the separation through filtering, are hardly aggregated and are reproduced with avoidance of damage to a size distribution of charged resin particles.

Dissolved Suspension Polymerization Method

A method of producing spherical toner particles using the dissolved suspension polymerization method will be explained below. This method is realized by dissolving resin into a solvent to prepare an oil phase, emulsifying the resin in an aqueous phase composed of an aqueous medium, and removing the solvent from an emulsified dispersion element to obtain resin particles.

The aqueous medium may contain water as a single element, but may also contain a water-mixable solvent in combination with water. The water-mixable solvent includes alcohol (methanol, isopropanol, or ethylene glycol), dimethylformamide, tetrahydrofuran, a cellosolve group (methyl cellosolve, etc.), and a lower ketone group (acetone, methyl ethyl ketone, etc.).

Resin to be used includes styrene and styrene-substituted polymers such as polystyrene, poly p-chlorostyrene, and polyvinyl toluene; styrenic copolymers such as styrene-p-chlorostyrene copolymer, styrene-propylene copolymer, styrene-vinyl toluene copolymer, styrene-vinyl naphtalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic-acid copolymer, and styrene-maleate copolymer; polymethyl methacrylate; polybutyl methacrylate; polyvinyl chloride; polyvinyl acetate; polyethylene; polypropylene; polyester; epoxy resin; epoxy polyol resin; polyurethane; polyamide; polyvinyl butyral; polyacrylic resin; rosin; denatured rosin; terpene resin; aliphatic or alicyclic hydrocarbon resin; aromatic type petroleum resin; chlorinated paraffin; and paraffin wax. These may be used either singly or as a mixture.

It is preferable that a solvent usable for preparing an oil phase has volatile capability whose boiling point is less than 100° C. in terms of easy removal. As the solvent, those as follows can be used singly or as a mixture, that is, toluene, xylene, benzene, carbon tetrachloride, methylene chloride, 1, 2-dichloroethane, 1, 1, 2-trichloroethane, trichloroethane, chloroform, monochlorobenzene, dichloroethylidene, methyl acetate, ethyl acetate, methyl ethyl ketone, methyl isobutyl ketone. Particularly, aromatic type solvents such as toluene and xylene; methylene chloride; 1, 2-dichloroethane; chloroform; and hydrocarbon halide such as carbon tetrachloride are preferable. The amount of the solvent to be used in 100 parts of toner composition is generally 10 to 900 parts.

The preparation of oil phase may be realized by adding a colorant (or colorant master batch), a parting agent, and a charge control agent as another toner compositions, into an aqueous medium simultaneously when a dispersion element is formed in the aqueous medium, and mixing those compositions. However, it is more preferable to previously mix them in the solvent for preparing the oil phase.

Another toner compositions such as the colorant, the parting agent, and the charge control agent are not necessarily mixed when particles are formed in the aqueous medium. The toner compositions may be added after the particles are formed. For example, particles are formed without colorant, and then the colorant can also be added thereto in a known dyeing method.

Any type of ordinary mixers based on stirring can be used for dispersion of the oil phase and aqueous phase. More preferably, however, a homogenizer having a high-speed rotor and a stator, a high pressure homogenizer, and any disperser using a medium such as a ball mill, a bead mill, or a sand mill are used.

The method of dispersion is not particularly limited, but, it is possible to employ a known facility using a system such as a low speed shearing system, a high speed shearing system, a frictional system, a high pressure jet system, or supersonic system. Among these, the high speed shearing system is preferable for preparing a dispersion element having a particle size of 2 to 20 micrometers. An emulsifier having a rotatable blade is not particularly limited, and any of commercially available ones as a emulsifier and a disperser can be used. For example, it includes continuous emulsifiers such as Ultra-Turrax (produced by IKA Japan, Co., Ltd.), Polytron (produced by Kinematica), TK Auto Homomixer (produced by Tokushu Kika Kogyo Co.), Ebara Milder (produced by Ebara Corp.), TK Pipeline Homomixer, TK Homomic Line Flow (produced by Tokushu Kika Kogyo Co.), Colloid Mill (produced by Shinko Pantech Co.), Slasher and Trigonal Wet Mill (produced by Mitui Miike Kakoki Co.), Cavitron (produced by Eurotech Co., Ltd.), and Fine Flow Mill (Pacific Machinery Co.); and batch or continuous compatible emulsifiers such as Cleamix (produced by M-Tech Co. Ltd.) and Filmix (produced by Tokushu Kika Kogyo Co.).

When the high speed shearing system disperser is used, the number of revolutions is not particularly limited, and it is normally 1,000 to 30,000 rpm, preferably 5,000 to 20,000 rpm. A dispersion time is not particularly limited, but if the batch system is employed, the time is normally 0.1 to 5 minutes. A temperature when dispersed is normally 0 to 150° C. (under pressure), preferably 10 to 98° C. The condition of high temperature is preferable in terms of easy dispersion because the viscosity of the dispersion element is reduced moderately.

In the dissolved suspension polymerization method, a method of dispersing solid particles in an aqueous medium in advance is used for stabilizing dispersed oil phase.

Further, in order to adjust absorption of a solid particle dispersant to droplets, some other dispersant can be used together with the dispersant. The other dispersant can be added thereto before toner compositions are emulsified or when volatile components are removed after emulsified.

The toner obtained through the pulverizing and classifying method is irregular with the sphericity varying between 0.930 and 0.950 depending on pulverizing methods. Therefore, the sphericity of the toner is not possibly made to 0.960 to 0.998. However, it is possible to enhance the sphericity through mechanical spherical processing or heat treatment, with which toner having the sphericity of 0.960 to 0.998 can be obtained.

It is possible to form pulverized toner to a spherical shape by a method using Turbo Mill (produced by Turbo Kogyo) as described in Japanese Patent Application Laid Open No. HEI 09-085741, or by performing continuous processing using Crypton (produced by Kawasaki Heavy Industries, Ltd.), Q-type mixer (produced by Mitsui Mining Co., Ltd.), Hybridizer (produced by Nara Kikai), and Mechanofusion Apparatus (produced by Hosokawa Micron, Ltd.).

By semi-fusing the surface of toner particles by hot air at a temperature of 100 to 300° C. using Thermal Fusion System (produced by Nihon Newmatic Kogyo), it is possible to form pulverized toner to a spherical shape.

By soaking the toner obtained by a pulverizing method into a liquid at a high temperature (about 200° C.) at which the toner is made elastic, it is possible to form pulverized toner to a spherical shape.

Even the two-component developer may be used. In this case, the toner may be mixed with magnetic carrier, and a content ratio between the carrier and toner in the developer is preferably 1 to 10 parts by weight of toner to 100 parts by weight of carrier.

As the magnetic carrier, conventionally known carrier such as iron powder, ferrite powder, magnetite powder, and magnetic resin carrier, each having a particle size of 20 to 200 micrometers, can be used.

A coating material includes amino type resins such as urea-formaldehyde resin, melamine resin, benzoguanamine resin, urea resin, polyamide resin, and epoxy resin. Those as follows can also be used, that is, polyvinyl and polyvinylidene type resins such as acrylic resin, polymethyl methacrylate resin, polyacrylonitrile resin, polyvinyl acetate resin, polyvinyl alcohol resin, and polyvinyl butyral resin; polystyrene type resins such as polystyrene resin, and styrene-acrylic copolymer resin; olefin halide resin such as polyvinyl chloride; polyethylene type resin such as polyethylene terephthalate resin, and polybutylene terephthalate resin; polycarbonate type resin; copolymers of acrylic monomer with any of polyethylene resin, polyvinyl fluoride resin, polyvinylidene fluoride resin, polytrifluoroethylene resin, polyhexafluoropropylene resin, and vinylidene fluoride; vinylidene fluoride-vinyl fluoride copolymer; fluoroterpolymer such as terpolymer of tetrafluoroethylene, vinylidene fluoride, and non-fluoridated monomer; and silicone resin.

In addition, conductive powder may be contained in coated resin as required. As the conductive powder, those as follows can be used, that is, metal powder, carbon black, titanium oxide, tin oxide, and zinc oxide. An average particle size of the conductive powder is preferably 1 micrometer or less. If the average particle size becomes larger than 1 micrometer, it is difficult to control electric resistance.

In the sixth to eight embodiments, the toner can be also used as magnetic toner for one-component developer in which carrier is not used, or as non-magnetic toner.

Evaluation of cleaning capability according to the second embodiment will be explained below. A specific example of toner used for evaluation will be explained first. The toner used in the sixth to eight embodiments is not limited to the toner in examples as follows. It is noted that in the description on toner production in the examples, each component amount (part) is described based on weight.

Toner A

Example of Suspension Polymerization: Sphericity: High 20 parts of carbon black MA 100 (produced by Mitsubishi Chemical Industries, Ltd.) and 0.5 part of 2,2'-azobisisobutyronitrile as a polymerization initiator were added to 40 parts of styrene monomer, and then the monomer was charged in a 500-millimeter four-neck-separable flask having an impeller driven by a three-one motor, a cooler, a tube for gas introduction, and a thermometer. The monomer was agitated at room temperature for 30 minutes under nitrogen gas stream, and the air in the flask was substituted with nitrogen. Then, the monomer was agitated in hot water of 70° C. for 6 hours at 60 rpm to obtain graft carbon black.

Subsequently, a mixture as follows was dispersed by a ball mill for 10 hours.

| | |
|---|---|
| Styrene monomer | 50.0 parts |
| n-butyl methacrylate | 14.5 parts |
| 1,3-butanediol dimethacrylate | 0.5 part |
| t-butyl-acrylamido-sulfonic acid | 3.0 parts |
| Low molecular weight polyethylene (Mitsui High Wax 210P, produced by Mitsui Petrochemical Industries, Ltd.) | 2.0 parts |
| The graft carbon black | 30.0 parts |

Each 1 part of the 2,2'-azobisisobutyronitrile and sodium nitrite were dissolved in the dispersant, the dispersant was added to 25 parts of 2% aqueous solution of polyvinyl alcohol, and the solution was agitated by TK homomixer at 6,000 rpm for 10 minutes to obtain a suspension.

The suspension was charged into the 500-millimeter four-neck-separable flask, was agitated at room temperature for 30 minutes under nitrogen gas stream, and the oxygen in the flask was substituted with nitrogen. Then, the suspension was agitated in hot water of 70° C. at 90 rpm for 8 hours to complete polymerization, and then suspension-polymerized particles are produced. 100 parts of the particles were dispersed again in the mixed solution of water/methanol which is a weight ratio of 1/1 so that a solid portion is made to 30%. 3 parts of di-tertiary-butyl zinc salicylate as a charge control agent was added to the solution, the solution was agitated, filtered, and dried to obtain colored particles.

95 parts of the obtained colored particles were added with 3 parts of silica and 2 parts of titanium oxide particles, and the particles were mixed by a Henschell mixer for 2 minutes and filtered to obtain toner. This toner is referred to as "toner A". The sphericity of the toner A was 0.985. The weight average particle size of the toner A was 5.18 micrometers.

5 parts of the toner A were mixed with 95 parts of silicone coat carrier (magnetite core material) having a weight average particle size of 50 micrometers by a rocking mixer to obtain two-component developer.

Toner B

Example of Dispersion Polymerization: Sphericity: High

In the 500-millimeter four-neck-separable flask having an impeller and a cooler, 3.5 parts of methyl vinyl ether-unhydride maleic acid copolymer (molecular weight 40,000, produced by GAF Co.) and 100 parts of methanol were charged. The solution was agitated at 60° C. for 2 hours, and the methyl vinyl ether-unhydride maleic acid copolymer was completely dissolved to adjust a dispersion stabilizer. Then, the solution was cooled down to room temperature, and the following mixture was added thereto.

| | |
|---|---|
| Styrene | 60.0 parts |
| methyl methacrylate | 40.0 parts |
| t-dodecyl mercaptan | 0.06 part |
| 1,3-butanediol dimethacrylate | 0.5 part |

The oxygen was purged by Nitrogen gas from the flask while the mixture was agitated, and the agitation was further smoothly continued (100 rpm) for about 1 hour until the residual oxygen concentration in the system would become 0.1 %. The temperature at a constant temperature bath was then increased up to 60° C., and polymerization was continued for 24 hours using 0.2 part of 2,2'-azobisisobutyronitrile as an initiator. After 15 minutes since heating was started, the liquid started to be turbid, and after 24-hour polymerization, the mixture was still stably dispersed in the liquid as the turbid liquid. A portion of the liquid was sampled and measurement was conducted based on an internal standard method by a gas chromatography. As a result, it was identified that the conversion was 95%.

The obtained dispersed liquid was cooled down, and was centrifuged by a centrifugal separator at 2,000 rpm. As a result, the polymer particles were perfectly settled and the upper part of the liquid was transparent. The supernatant was removed, and 200 grams of methanol was added to the particles, agitated for 1 hour, and cleaned. The operation of centrifuging and cleaning with methanol was repeated and the particles were filtered. The separated particles through filtration were dried at 50° C. for 24 hours under reduced pressure to obtain white powdery resin particles at a yield of 90%.

Subsequently, 20 parts of oil black 860 (produced by Orient Chemical Industries, Ltd.) was added to the 100 parts of methanol, dissolved by heat, cooled, and filtered by an about 1-μm filter to produce a dye solution.

30 parts of polymer particles were charged into the solution, dispersed, and agitated at 50° C. for 1 hour to obtain a dispersed solution. The dispersed solution was cooled down to room temperature, and filtered to obtain a dispersed solution of colored resin particles. Then, di-tertiary-butyl zinc salicylate as a charge control agent was added to water/methanol (1/1) mixed solvent to be dissolved, and 2 parts of solvent was charged to 100 parts of colored resin particles. The particles were agitated for 1 hour, filtered, and were dried to obtain colored particles.

95 parts of the obtained colored particles were added with 3 parts of silica and 2 parts of titanium oxide particles, and the particles were mixed by a Henschell mixer for 2 hours and filtered to obtain toner. This toner is referred to as "toner B". The sphericity of the toner B was 0.983. The weight average particle size of the toner B was 5.52 micrometers. A two-component developer was produced in the same manner as the toner A.

Toner C

Example of Dissolved Suspension Polymerization Method: Sphericity: High

In a reactor equipped with a cooling tube, agitator, and a tube for $N_2$ introduction, 724 parts of ethylene oxide (2 mol) adduct of bisphenol A, 276 parts of terephthalic acid, and 2 parts of dibutyltin oxide were charged, and the mixture was subjected to polycondensation reaction at 230° C. for 8 hours under atmospheric pressure. The mixture was reacted for 5 hours under reduced pressure by 10 to 15 mmHg to obtain polyester resin having a peak molecular weight of 5300. 100 parts of the polyester resin were charged in 100 parts of ethyl acetate, dissolved and mixed to obtain an ethyl acetate solution as a toner binder.

In a sealed pot, 200 parts of the ethyl acetate solution, 5 parts of carnauba wax, 4 parts of copper phtalocyanine blue pigment, 1 part of di-tertiary-butyl zinc salicylate were charged, and the mixture was dispersed by a ball mill using zirconia beads of a diameter of 5 mmm for 24 hours to obtain a toner composition.

In a beaker, 600 parts of ion exchanged water, 6 parts of partially saponified polyvinyl alcohol, and 0.3 part of dodecyl benzene sodium sulfonate were charged, and dissolved and dispersed uniformly.

The internal temperature at the beaker was kept at 20° C., and the toner composition was charged into the beaker while the solution was agitated by the TK-type homomixer (produced by Tokushu Kika Kogyo Co.) at 12,000 rpm, and the toner composition was further agitated for 3 minutes and emulsified. Subsequently, the mixed solution was transferred to a flask having a rabble and a thermometer, 0.3 part of lauryl sodium sulfate was added thereto, was agitated at room temperature for 30 hours and dissolved. The solvent was removed at 30° C. under a reduced pressure of 50 mmHg. As a result of analyzing the dispersed liquid by a gas chromatography, residual ethyl acetate was contained in toner particles by 50 ppm. 120 parts of hydrochloric acid with a concentration of 35% was added to the particles, tricalcium phosphate was dissolved, and the solution was filtered. The operation of dispersing again a cake obtained after filtration in distilled water and filtering the water was repeated three times, and the residual was cleaned and dried at 40° C. for 24 hours under the reduced pressure to obtain colored toners.

95 parts of the obtained colored particles were added with 3 parts of silica and 2 parts of titanium oxide particles, and the particles were mixed by the Henschell mixer for 2 hours and filtered to obtain toner.

This toner is referred to as "toner C". The sphericity of the toner C was 0.980. The weight average particle size of the toner C was 5.41 micrometers. A two-component developer was produced in the same manner as the toner A.

Toner D

Comparative Example of Pulverized toner: Sphericity: Low

The row materials explained below were sufficiently mixed by the Henschell mixer and were kneaded by two compact roll mills at 150° C. for 2 hours.

| | |
|---|---|
| Binding resin (styrene-methyl acrylate copolymer) | 100.0 parts |
| Colorant (Carbon Black #44, produced by Mitsubishi Carbon Co.) | 10.0 parts |
| Charge control agent (di-tertiary-butyl zinc salicylate) (Bontron E-84, produced by Orient Chemical Industries, Ltd.) | 2.0 parts |
| Carnauba wax | 5.0 parts |

The obtained kneaded mixture was roughly pulverized by a pulverizer with a 2-mm screen, pulverized by a laboratory jet, and classified by a 100 MZR classifier to obtain colored toners.

95 parts of the obtained colored particles were added with 3 parts of silica and 2 parts of titanium oxide particles, and the particles were mixed by the Henschell mixer for 2 minutes and filtered to obtain toner. This toner is referred to as "toner D". The sphericity of the toner D was 0.930. The weight average particle size of the toner D was 5.73 micrometers. A two-component developer was produced in the same manner as the toner A.

Toner E

Comparative Example of Pulverized toner Through Mechanical Process: Sphericity: Slightly Low The colored particles obtained in the example of producing the toner D was subjected to processing for 10 minutes at 12,000 rpm using the Hybridizer (produced by Nara Kikai) to obtain colored particles.

95 parts of the obtained colored particles were added with 3 parts of silica and 2 parts of titanium oxide particles, and the particles were mixed by the Henschell mixer for 2 minutes and filtered to obtain toner. This toner is referred to as "toner E". The sphericity of the toner E was 0.945. The weight average particle size of the toner E was 5.21 micrometers. A two-component developer was produced in the same manner as the toner A.

Toner F

Example of Pulverized toner Through Mechanical Process: Sphericity: Slightly High The colored particles obtained in the example of producing the toner D was subjected to processing for 30 minutes at 12,000 rpm using the Hybridizer (produced by Nara Kikai) to obtain colored particles.

95 parts of the obtained colored particles were added with 3 parts of silica and 2 parts of titanium oxide particles, and the particles were mixed by the Henschell mixer for 2 minutes and filtered to obtain toner. This toner is referred to as "toner F". The sphericity of the toner F was 0.968. The weight average particle size of the toner F was 5.26 micrometers. A two-component developer was produced in the same manner as the toner A.

Toner G

Example of Pulverized toner Through Heat Process: Sphericity: High

The colored particles obtained in the example of producing the toner D was subjected to processing twice at a heat process temperature of 250° C., a hot air volume of 1,000 l/min, and a supplied air volume of 100 l/min using Thermal Fusion System (produced by Nihon Newmatic Kogyo) to obtain colored particles.

95 parts of the obtained colored particles were added with 3 parts of silica and 2 parts of titanium oxide particles, and the particles were mixed by the Henschell mixer for 2 minutes and filtered to obtain toner. This toner is referred to as "toner G". The sphericity of the toner G was 0.970. The weight average particle size of the toner G was 5.56 micrometers. A two-component developer was produced in the same manner as the toner A.

Transfer capability and cleaning capability in the image forming apparatus of the present invention were evaluated using the toner A to the toner G.

The charging and developing conditions are as explained below, and the time of evaluation was constant.

| | |
|---|---|
| Operating speed: | 200 mm/sec |
| Image carrier: | Amorphous silicone type photoreceptor, film thickness: 30 μm (When a film scraped amount was evaluated, the evaluation was conducted by organic photoconductor (OPC) having the same film thickness.) |
| Charging: | Space between the charging roller and the image carrier: 50 μm |
| Applied bias: | |
| DC component | −900 V |
| AC component | Vpp 2.2 kV, |
| Frequency | 1.5 kHz |
| Waveform | Sinusoidal wave |
| Development: | Applied bias: |
| DC component | −500 V |
| AC component | Vpp 1.5 kV, |
| Frequency | 2.2 kHz |
| Waveform | Rectangular wave |
| Environmental conditions: | Temperature 23° C. Relative humidity 50% |

The drive voltage was applied to the piezoelectric element forming the vibrating unit of the vibrating blade according to the present invention through a function generator that generated pulsed signals and a power source that amplified the generated signals. In order to identify the voltage to be actually applied to the piezoelectric element, the amplified voltage was branched, and the branched voltage was monitored by an oscilloscope.

The cleaning capability as the object of present invention and the improved transfer rate when the spherical toner was used were evaluated in the following manner.

The transfer rate was evaluated (measured) by stopping the operation in the middle of outputting a solid image on the surface of the image carrier, transferring each toner image between a developing unit and a transfer part and between the transfer part and a transfer cleaning unit onto a white paper using Scotch tape (produced by Sumitomo 3M Ltd.), and measuring the images by Macbeth reflectivity densitometer RD 514.

The transfer efficiency was calculated by the equation (1):

$$\text{TRANSFEREEFFICIENCY} = \frac{(Ddt - Dref) - (Dtc - Dref)}{Ddt - Dref} \times 100 \quad (1)$$

where

D dt is density of toner image on the tape ("tape density") between the developing unit and the transfer part, D tc is tape density between the transfer part and the cleaning unit, and D ref is density obtained only by transferring the scotch tape onto the white image.

The cleaning capability was evaluated in the same manner as that of the transfer rate using the scotch tape. Toner (residual toner) remaining on the surface of the photoreceptor as the image carrier after the image transfer, was transferred onto the white paper using Scotch tape (produced by Sumitomo 3M Ltd.), and the toner was measured also by Macbeth reflectivity densitometer RD 514. If a difference between the white paper with the residual toner transferred and a blank (only the scotch tape was adhered on the white paper) was 0.01 or less, then the cleaning was sufficiently performed ("hollow circle" is described in tables for evaluation results). If the difference exceeded 0.01 (high density), then the cleaning was insufficiently performed, and NG (no good) is described therein.

Evaluation was conducted using the image forming apparatus having the vibrating blade 20 (FIG. 8 and FIG. 9) according to the seventh embodiment. The cleaning capability is difficult to be evaluated in the initial stage of the image formation. Therefore, the evaluation was conducted after 50,000 sheets of image (corresponding to A3-size paper) were transferred, using the toner A to toner G. More specifically, the above number was the number at which occurrence of faulty cleaning was clearly identified when the conventional blade cleaner and the toner C produced by the dissolved suspension polymerization were used.

The conventional blade cleaner (thickness of blade portion: 3 mm) and the vibrating blade 20 of the embodiment (thickness of vibratable member: 0.3 mm, thickness of blade member: 0.2 mm) were used, and both of the pressing pressures (abutting pressure) against the photoreceptor (image carrier 11) were standardized at 70 g/cm$^2$. Both of the blade members were formed of polyurethane rubber. The hardness as a bulk was about 70 degrees based on JISA hardness. All the laminated type piezoelectric elements 33 of the vibrating blade 20 of the embodiment were applied with a drive voltage of voltage Vpp: 20 V and frequency: 20 kHz.

An actual output was performed by preparing an image pattern so that an amount of toner deposition on the photoreceptor was 0.1 mg/cm$^2$, and outputting 50,000 sheets of the image in the portrait orientation of A3-size paper. At the stage at which 50,000 sheets were finished to be output, the image pattern as a solid image was output up to a half of it and evaluated as shown in the method of measuring the transfer rate and the cleaning rate.

The evaluation results are given in table 2. "Blade of the present invention" in the column of the cleaning capability in table 2 indicates the vibrating blade 20 of the seventh embodiment. "NG 1" indicates occurrence of background dirt due to faulty cleaning on the sheets when about 1,000 sheets were output. "NG 2" indicates occurrence of background dirt due to faulty cleaning on the sheets when about 3,000 sheets were output. "NG 3" indicates occurrence of background dirt due to faulty cleaning on the sheets when about 2500 sheets were output.

TABLE 2

| | | Particle | | Cleaning capability | | |
|---|---|---|---|---|---|---|
| Toner | Sphericity | size [μm] | Method | Transfer rate [%] | blade of invention | conventional blade |
| A | 0.985 | 5.81 | Suspension polymerization | 95 | ○ | NG 1 |
| B | 0.983 | 5.52 | Dispersion polymerization | 95 | ○ | NG 1 |
| C | 0.980 | 5.41 | Dissolved suspension polymerization | 97 | ○ | NG 1 |
| D | 0.930 | 5.73 | Pulverizing (comparative example) | 87 | ○ | ○ |
| E | 0.945 | 5.21 | Pulverizing mechanical process 1 | 90 | ○ | ○ |
| F | 0.968 | 5.26 | Pulverizing mechanical process 2 | 90 | ○ | NG 2 |
| G | 0.970 | 5.56 | Pulverizing heat treatment | 93 | ○ | NG 3 |

It is clear from the table 2 that even the conventional blade without vibration can maintain the cleaning capability for the toner D and toner E as pulverized toner. However, it is understood that the conventional blade cannot maintain the cleaning function for the toner whose sphericity was increased through mechanical process or heat treatment.

As for the transfer rate, as explained above, if the sphericity of toner is high, the transfer rate is as high as about 95%, which makes it possible to predict a high quality image. On the other hand, if the sphericity is low, the transfer rate is as low as about 90%. Although the toner D and toner E were excellent in the cleaning capability, the transfer rate of the toners is low as compared with the other toners, and therefore it is understood that both of the toners are not so good from the viewpoint of the image quality.

As is clear from the table 2, if the spherical toner has a high sphericity, it is possible to prevent occurrence of faulty cleaning because of vibration of the blade portion, unlike the conventional blade cleaning. It is further understood that the cleaning capability can be maintained even after the blade is used repeatedly.

The cleaning capability of the vibrating blades according to the sixth to eight embodiments including the conventional blade cleaning was evaluated, using the toner C produced by the dissolved suspension polymerization method in which the transfer rate was the highest in the evaluations.

The evaluation on the magnitude of voltage Vpp to be applied is explained first.

The evaluation on cleaning capability was conducted after output corresponding to 50,000 sheets was performed by the respective blades. The frequency of the drive voltage was fixed to 20 kilohertz, and each of the vibrating blades of the embodiment was evaluated by changing the voltage Vpp of the drive voltage to be applied to the piezoelectric elements to 5, 20, and 30 volts. At the same time, the displacement amount of an edge part of the blade portion was measured by a laser Doppler displacement gage.

The displacement amount of the blade being vibrated was optically measured using the laser Doppler displacement gage from above the vibratable member or from above the blade member, that is, from above the cleaning device. The measurements were conducted by using the device as follows produced by Graphtech Co.

Laser Doppler vibration demodulating unit AT 3500 Sensor unit AT 0021.

The results are given in table 3. It is noted that in the table 3, "NG 4" indicates occurrence of background dirt on paper due to faulty cleaning from the beginning of output, and "NG 5" indicates occurrence of background dirt on paper due to faulty cleaning after about 100 sheets were output.

TABLE 3

| Blade | Voltage (V) | Displacement [μm] | Cleaning capability |
|---|---|---|---|
| Bimorth | 10 | 0.03 | NG 4 |
| | 20 | 0.14 | ○ |
| | 30 | 0.19 | ○ |
| Laminated | 10 | 0.06 | NG 5 |
| | 20 | 0.15 | ○ |
| | 30 | 0.23 | ○ |
| Laminated for side vibration | 10 | 0.05 | NG 5 |
| | 20 | 0.13 | ○ |
| | 30 | 0.20 | ○ |
| conventional (comparative example) | | <0.01 | NG 4 |

As illustrated in the table 3, if the voltage applied to the piezoelectric element as the vibrating unit was low, even the vibrating blade (blade cleaning) of the present invention could not maintain the cleaning capability, and the capability became almost the same as that of the conventional blade. Further, in the case of the vibrating blades of the sixth to eight embodiments (Bimorph type, Laminated type, Laminated type for side vibration), it is clear that the displacement amount is increased as the applied voltage is increased. The displacement amount the conventional blade was measured, but it was 0.01 micrometer or less that is the lower limit for the measurement by the measuring device.

In the case of the vibrating blades of the sixth to eight embodiments, if the voltage applied to the piezoelectric element is increased, the cleaning capability can be maintained in any of the structures. This fact will be studied in correlation with the displacement amount by the laser Doppler displacement gage.

According to the previous mechanism and the known technology already filed, it is said that the stick-slip phenomenon occurred even in the conventional blade and fine vibrations contributed to cleaning capability. However, regarding the spherical toner, it is conceivable that the toner particles could pass through the nip since the vibration amount thereof is small, resulting in occurrence of faulty cleaning, because the toner wall cannot be build up.

As is clearly understood from the results obtained by the laser Doppler displacement gage, if the displacement amount due to the vibration is small, cleaning of the spherical toner is thought impossible. It is also understood from the table 3 that there is a lower limit of the vibration amount required for cleaning the spherical toner in the voltage to be applied to the piezoelectric element.

Therefore, as is clear from the table 3, by vibrating the blade portion at a certain amount or more, it is possible to prevent occurrence of faulty cleaning for the spherical toner having a high sphericity in the present invention, as compared with the conventional blade cleaning. It is also possible to maintain the cleaning capability even after the blade is repeatedly used.

Damage given to the photoreceptor (image carrier) was evaluated.

As illustrated in the experiment on the evaluations, the evaluation on cleaning capability was conducted after output corresponding to 50,000 sheets was performed by the respective blades. The applied voltage Vpp was fixed to 20 volts and the frequency of the drive voltage was also fixed to 20 kilohertz. The toner C produced by the dissolved suspension polymerization method was used as toner.

In the evaluation, the OPC was used in order that damage of the blade to the photoreceptor became more significant, and 50,000 sheets were output. After the output, a scraped amount of the photoreceptive layer of the photoreceptor was measured because the amorphous silicone type photoreceptor is hard to be scraped and therefore the damage to the photoreceptor cannot be clearly evaluated before the output. The results are given to table 4.

TABLE 4

| Blade | Change in film thickness [μm] |
|---|---|
| Bimorth | 2.1 |
| Laminated | 2.2 |
| Laminated for side vibration | 1.8 |
| Conventional blade (comparative example) | 4.4 |

It is clear from the table 4, that the vibrating blade of the present invention had a film scraped amount of about 2 micrometers whereas the conventional blade had that of about 4 micrometers, that is, the amount of the conventional blade was increased as twice as much.

The reason is considered such as follows. That is, although the conventional blade vibrates finely due to the stick-slip phenomenon, the vibration amount is small, and therefore the contact time of the blade with the photoreceptor is longer as compared with the vibrating blade according to the present invention. It is, consequently, considered that the frictional force between the blade and the photoreceptor (the frictional force may be considered as time-base integrated force) was increased, and that the film scraped amount of the photoreceptive layer was increased.

When the comparison was performed using an amorphous silicone type photoreceptor, the change in the film scraped amount in either of the vibrating blade according to the sixth embodiment and the conventional blade was 0.1 micrometer or less, which was below the measurement limit of the measuring device, and therefore the comparison was hard to be performed. However, even the amorphous silicone type photoreceptor of which surface is hard, film scraping and flaws occur although they are a small amount as compared with the conventional OPC. Therefore, the vibrating blade of the present invention is thought effective in improvement of durability of the photoreceptor as compared with the conventional cleaning blade.

As explained above, in the vibrating blade of the present invention capable of strongly vibrating a cleaning blade, the change in the film thickness of the photoreceptor, in other words, the film scraped amount is small. Therefore, the vibrating blade is effective in prevention of damage to the image carrier, thus improving durability of the photoreceptor.

The operating timing and the amplitude of vibration of the vibrating unit as the vibrating blade will be explained below. Toner on the image carrier is cleared, but the toner is accumulated at the edge of the blade member during cleaning. In this case, the problem is not the point whether cleaning for highly spherical toner is possible by the blade, which has been explained about the cleaning mechanism, but the point that the toner is accumulated in a wider range. The large amount of toner accumulation may be spread over the surface of the blade, and may restrict the movement of the blade, depending on the cases.

For example, even the toner that is hard to be stuck, the stuck of the toner may occur between the blade and the photoreceptor by press contact. In addition, the additive contained in the toner, for example, wax is spread by the blade to cause filming over the surface of the photoreceptor may occur. Therefore, it is preferable to periodically remove the toner accumulation and reduce it as less as possible in terms of elongation of durability. For this purpose, it is preferable to change a vibration amount (displacement amount) of the blade member by the vibrating unit.

As explained above, the conditions of forming an image, for example, an amount of toner consumption, environmental conditions, an amount of toner deposition on the image carrier, and a number of printed sheets (number of formed images) are detected, and the vibrating unit is controlled to drive based on the results of detection.

In this case, if the vibration amount of the piezoelectric element is changed at the timing of ordinary image formation, the cleaning conditions are disadvantageously changed. It is, therefore, predicted that faulty cleaning may occur. To solve the problem, the control is performed so as to increase the vibration amount during non-image formation, and toner accumulation is thereby removed. During image formation, the cleaning conditions are kept as they are, and the control is performed so as to reduce the vibration amount to prevent occurrence of faulty cleaning. It is noted that the vibration amount may be controlled by changing a voltage of a drive signal to be applied to the vibrating unit.

A high-speed image forming apparatus consumes more toner. Therefore, not only the blade is made to vibrate more but also some additional arrangement is provided to remove the toner. In the experiments on the evaluations, a brush (ϕ8) was disposed at the edge of the blade as the additional arrangement.

An image forming apparatus according to a ninth embodiment (FIG. 22) is configured to count an area (image area) required for visualizing an image to be output with toner and inputting a signal to estimate the amount of the toner per unit area into the main control unit 29.

The main control unit 29 receives a signal of a detecting unit that detects a rotational torque of a motor required for rotating the image carrier 11 or a signal of a detecting unit that detects a drive current for the motor.

The cleaning device 16 has that same configuration as explained in the sixth and seventh embodiments.

Further, the drive control over the vibrating unit 23 as the vibrating blade 20 forming the cleaning device 16 is as explained in the embodiments.

Maintaining and improving cleaning capability due to reduction in frictional resistance between the blade member 21 and the image carrier 11 will be explained below. These are another object of the ninth embodiment.

The toner C explained in the eighth embodiment was used. It is noted that the present invention is not limited to the image forming apparatus using spherical toner and the cleaning device for the apparatus.

Measurement of frictional resistance will be explained below. When the vibrating blade 20 of the present invention is used, the vibrating unit 23 vibrates the vibratable member 22 to thereby change the frictional resistance between the blade member 21 and the image carrier 11.

As a method of directly measuring the frictional resistance, a surface properties tester was employed for experimental evaluation. The tester in use is Surface properties measurement instrument: Tribogear HEIDON TYPE: 14DR (produced by Shinto Kagaku Co. Ltd.).

Figure 27:
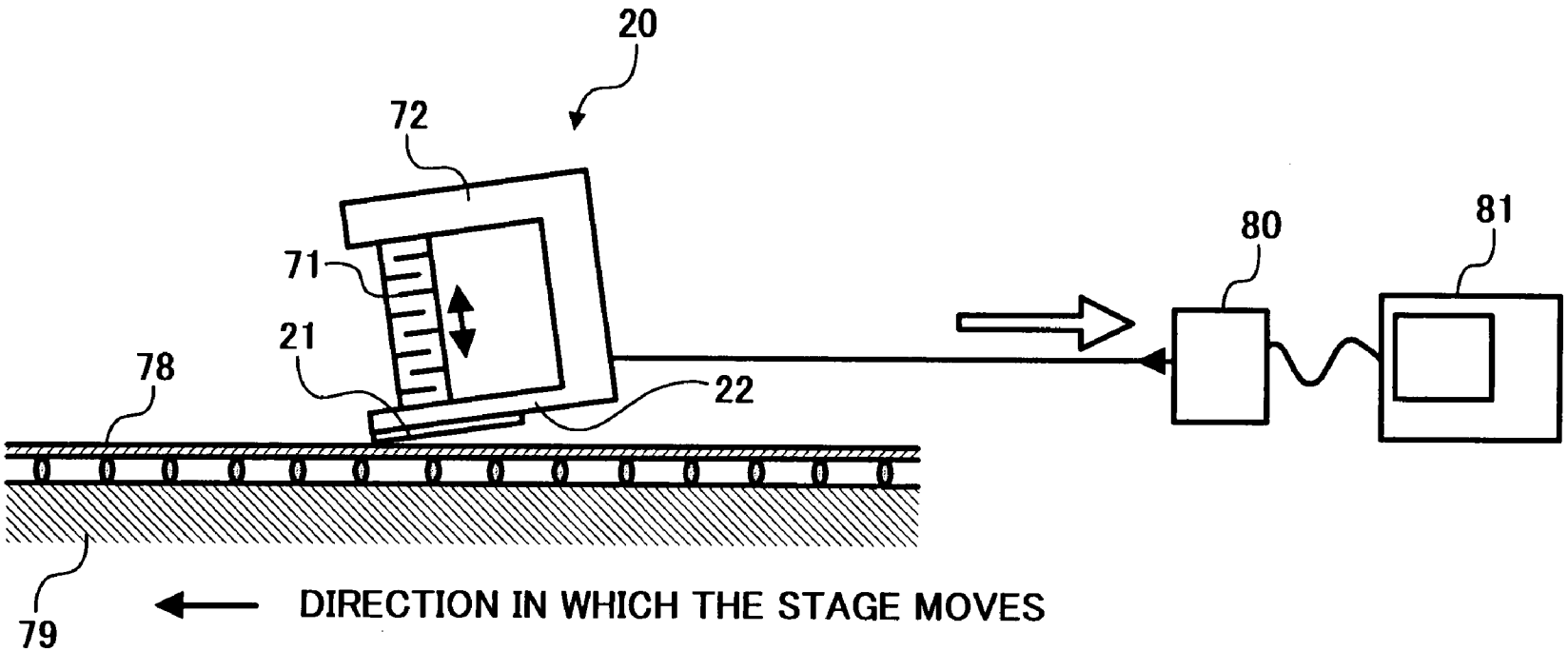
FIG. 27 illustrates a measuring experiment on frictional resistance between the blade member and the image carrier according to a ninth embodiment of the present invention.

The frictional resistance between the vibrated blade member and the image carrier 11 was measured using the tester. FIG. 27 is a schematic diagram illustrating how the experiment was going on.

As the vibrating blade 20 to be fixed to the tester, as explained in the sixth to tenth embodiments, the laminated type piezoelectric element 71 as the vibrating unit 23 fixed to the rear face of the vibratable member 22 was used. As a member in contact with the blade member 21, a glass surface 78 with a cleaned surface was used. In the ordinary image forming process, the blade member 21 and the photoreceptive layer of the image carrier 11 are in contact with each other. Therefore, in order to make clear the relation between the vibration given to the blade member 21 and frictional resistance, a glass was employed for the tester, and the frictional resistance between the blade member 21 and the glass surface 78 was measured. The glass was employed because cleaning the glass surface allows the uniform surface to be maintained, which stabilizes environments for measurement of the frictional resistance.

The surface properties tester measures the force applied in the lateral direction as frictional force by a strain gage 80 fixed to the tester. The force applied in the lateral direction is produced when a predetermined load (in a direction perpendicular to the glass surface) is applied to the blade member 21 and when a stage 79 fixed with the glass surface 78 is moved in a predetermined direction at a predetermined speed. At this time, the force applied to the strain gage 80 and the frictional resistance between the blade and the glass surface are recorded in real time in an analyzing recorder 81.

Figure 28:
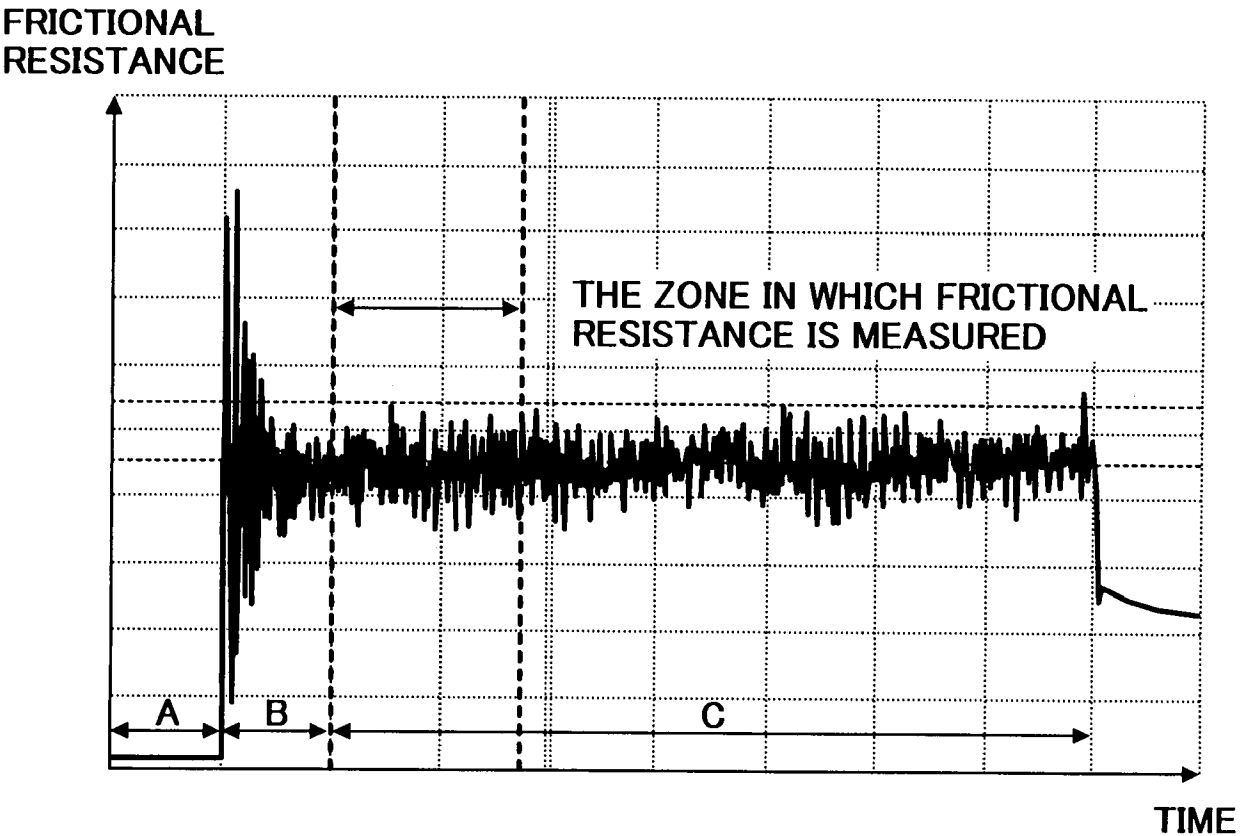
FIG. 28 is a graph (chart) illustrating an example of the measurement results of FIG. 27.

An example recorded in the analyzing recorder 81 (hereinafter, referred to as "chart") is shown in FIG. 28. FIG. 28 illustrates an example of measuring the frictional resistance from the state where the stage 79 is at rest. Initially, when the stage 79 is at rest (zone A), the frictional resistance is zero, and therefore the chart describes the state at a value 0. When the stage 79 starts moving, the stage 79 also starts moving in zone B on the chart, and the frictional resistance is also increased on the chart. In zone C, the stage 79 is moving while maintaining the frictional resistance between the blade member 21 and the glass surface 78 at an almost constant value. After a while, the stage 79 travels for a certain distance, and stops traveling.

Referring to the zones on the chart, a point, that is an initial stage of the zone B and at which the frictional resistance is the maximum, corresponds to a coefficient of static friction, and a region in which the frictional resistance is almost constant in the zone C, corresponds to a coefficient of dynamic friction.

In the actual image forming process, the blade member 21 and the image carrier 11 are relatively move, and therefore a value of the frictional force in the zone C is determined as a frictional force between the cleaning blade and the glass surface 78.

The results of measuring frictional resistances when the vibrating conditions are changed will be explained below. The measurement was conducted using the cleaning blade member 21 actually including the vibrating units 23 and 71 and the laminated type piezoelectric element 76.

The measurement conditions of the surface properties tester were as follows and the values were constant.

| | |
|---|---|
| Stage moving speed | 10 mm/sec |
| Load on blade | 25 g/cm |
| Length of blade | 3 cm (total load: 75 g) |

Figure 29:
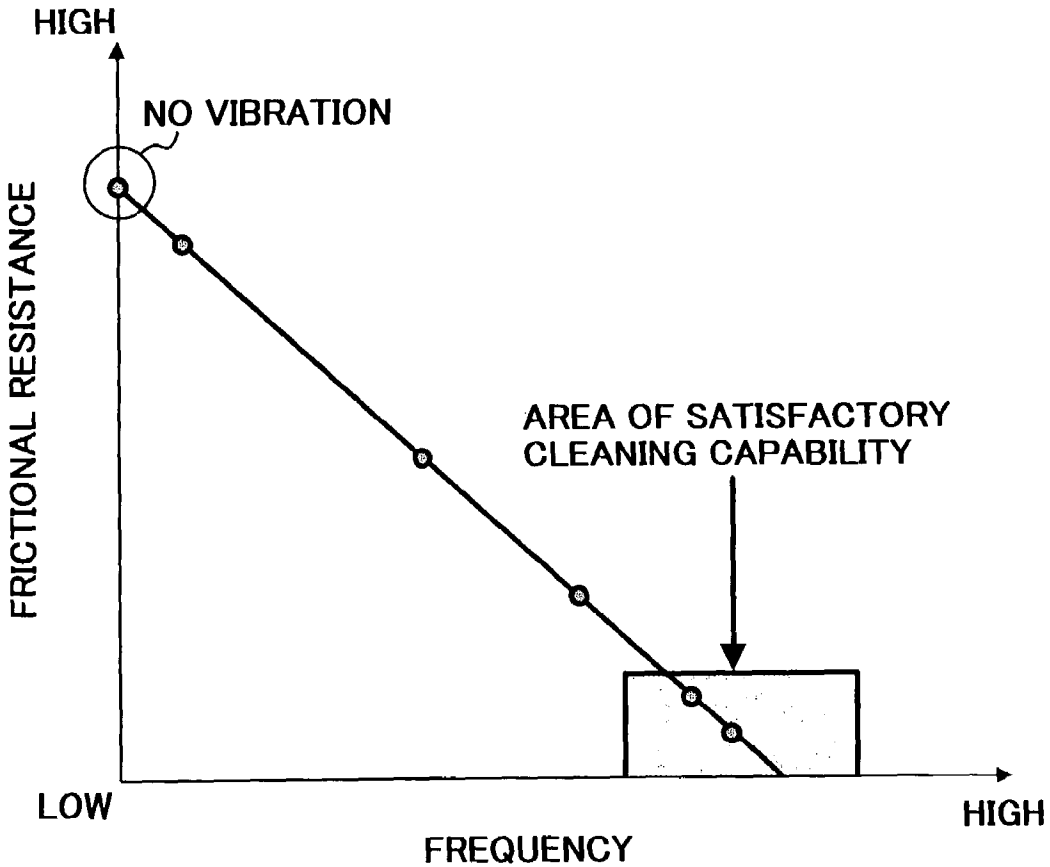
FIG. 29 is a graph illustrating a relationship between a frequency of a drive signal for the vibrating blade and frictional resistance, and cleaning capability thereof according to the ninth embodiment.
Figure 30:
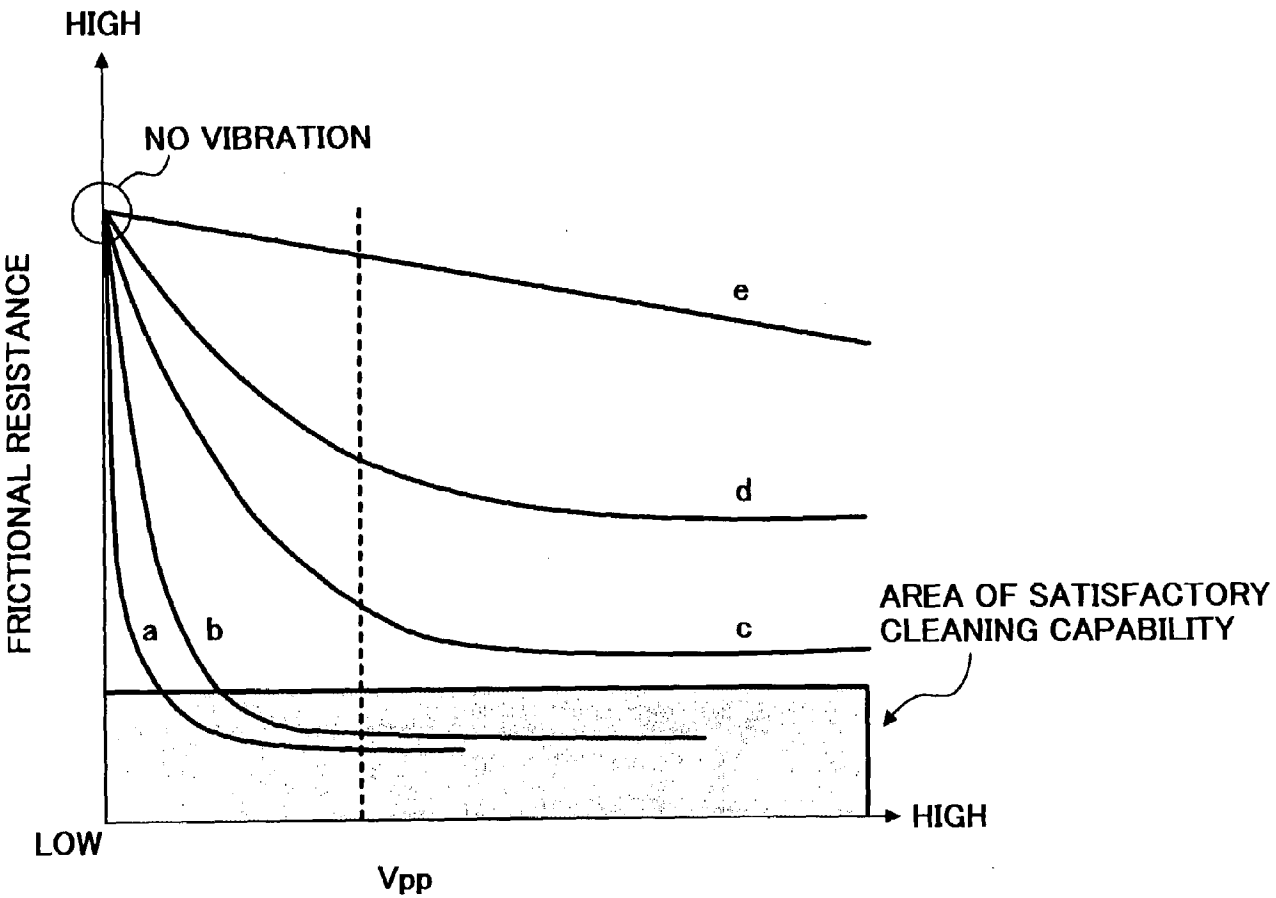
FIG. 30 is a graph illustrating a relationship among a frequency of a drive signal and a drive voltage for the vibrating blade and frictional resistance, and cleaning capability thereof according to the ninth embodiment.

FIG. 29 and FIG. 30 illustrate changes in frictional resistances in the zone C when frequency and alternating voltage (Vpp) of a bias (drive bias) applied to the piezoelectric element forming the vibrating blade 20 are changed. The value of the frictional resistance was determined as a value of time during which the stage operated stably (after 2 to 4 seconds since the stage starts moving, in FIG. 28).

As illustrated in FIG. 29, referring to changes in frequency when the voltage Vpp is kept constant, it is understood that when the frequency becomes high, the frictional resistance is decreased. When the frequency is 0, the blade is not vibrated, which is the condition of the conventional cleaning blade. It can be seen that the piezoelectric element vibrates the blade and the frictional resistance is thereby decreased as compared with the conventional blade.

FIG. 30 illustrates results obtained when the voltage Vpp is changed at each of frequencies a to e. The magnitude of the frequencies a to e is set to a relation such as a>b>c>d>e.

It is clear from FIG. 30 that the frictional resistance is decreased when the voltage Vpp is increased at any of the frequencies. Referring to the frequencies a and b, it is clear that although the frequencies are different, changes in the frequencies based on the voltage Vpp are almost the same as each other.

As a result of evaluating the frictional resistance between the blade with the vibrating unit and the glass surface using the surface properties tester, it is clear that the frictional resistance is decreased when the blade is vibrated.

It is also clear that if the blade member having the vibrating unit is used, a frequency is high in a portion indicated as a satisfactory cleaning area and cleaning capability is excellent in an area where the voltage Vpp is large in the image forming apparatus as explained below. Further, it is understood that the cleaning capability is effectively increased by decreasing the frictional resistance. The reason is presumed such that the frictional resistance between the blade member 21 and the image carrier 11 is decreased to thereby improve the cleaning capability as compared with conventional blade.

The cleaning capability in the image forming apparatus of the present invention and a relation among the blade, image carrier, and the frictional resistance will be explained below.

Evaluation and measurement were performed on transfer capability, cleaning capability, frictional resistance between the photoreceptor and the blade using the apparatus including the cleaning device provided with the vibrating blade according to the ninth embodiment (which is the same as the sixth to eight embodiments).

The charging and developing conditions are as explained below, and the time of evaluation was constant.

| | |
|---|---|
| Operating speed: | 200 mm/sec |
| Image carrier: | Amorphous silicone type photoreceptor, film thickness: 30 μm (When a film scraped amount was evaluated, the evaluation was conducted by OPC having the same film thickness.) |
| Charging: | Space between the charging roller and the image carrier: 50 μm |
| Applied bias: | |
| DC component | −900 V |
| AC component | Vpp 2.2 kV, Frequency 1.5 kHz Waveform Sinusoidal wave |
| Development: | Applied bias: |
| DC component | −500 V |
| AC component | Vpp 1.5 kV, Frequency 2.2 kHz Waveform Rectangular wave |
| Environmental conditions: | Temperature 23° C. Relative humidity 50% |
| Blade: | Vibratable member thickness: 0.3 mm Blade member thickness: 0.2 mm |
| (Comparative values on whether vibration is given are the same as each other by setting a drive bias to the piezoelectric element to zero.) | |
| Material: | Polyurethane (JISA hardness as a bulk: about 70°) |
| Load: | 25 g/cm (Pressure at the edge of the blade) |

The drive voltage was applied to the piezoelectric element forming the vibrating unit of the vibrating blade according to the present invention through a function generator that generated pulsed signals and a power source that amplified the generated signals. Further, in order to identify the voltage to be actually applied to the piezoelectric element, the amplified voltage is branched, and the branched voltage was monitored by an oscilloscope.

The transfer rate was evaluated in the same manner as explained above. That is, the evaluation (measurement) of the transfer rate was performed by stopping the operation in the middle of outputting a solid image on the surface of the image carrier, transferring each toner image between a developing unit and a transfer part and between the transfer part and a transfer cleaning unit onto a white paper using Scotch tape (produced by Sumitomo 3M Ltd.), and measuring the images by Macbeth reflectivity densitometer RD 514. The transfer efficiency was calculated using the equation (1). The conditions are the same as those on the previous evaluation.

The cleaning capability was evaluated in the same manner as that of the transfer rate using the scotch tape. Toner (residual toner) remaining on the surface of the photoreceptor as the image carrier after the image transfer, was transferred onto the white paper using Scotch tape (produced by Sumitomo 3M Ltd.), and the toner was measured by Macbeth reflectivity densitometer RD 514. If a difference between the white paper with the residual toner transferred and a blank (only the scotch tape was adhered on the white paper) was 0.01 or less, then the cleaning was sufficiently performed. If the difference exceeded 0.01 (high density), the cleaning was insufficiently performed.

An actual output was performed by preparing an image pattern so that an amount of toner deposition on the photoreceptor was 0.1 mg/cm$^2$, and outputting 50,000 sheets of the image in the portrait orientation of A3-size paper. At the stage at which 50,000 sheets were finished to be output, the image pattern as a solid image was output up to a half of it and evaluated as shown in the method of measuring the transfer rate and the cleaning rate.

The frictional resistance in the image forming apparatus was estimated in the following manner. A rotational torque meter was fixed to a shaft of the drum-like image carrier 11 that was fixed to the internal side of the image forming apparatus to measure a torque at the time of rotational operation. At the time of measurement, only the cleaning blade member 21 having the vibrating unit 23 was brought into contact with the image carrier 11, and the rotational torque was measured. In the evaluation process of the cleaning capability, as explained above, processes required for visualizing an image such as a charging process, developing process, and a transfer process were included. Incorporation of the torque meter, as a measuring device, in the image forming apparatus is most appropriate for directly measuring frictional resistance between the blade member 21 and the image carrier 11.

The drum-like OPC was used for the measurement, but the measurement is also possible using a belt-like photoreceptor. However, in order to clean toner by bringing the blade into contact with the photoreceptor, it is required to contact the photoreceptor. Therefore, the torque meter is preferably disposed at a position as close to the blade as possible. In the case of belt-like photoreceptor, a certain amount of pressure between the belt and the blade is required for cleaning. Therefore, some rollers for suspending the belt are provided in many cases, and the torque meter is preferably disposed at the shaft of any of the suspension rollers that is closest to the blade.

Figure 31:
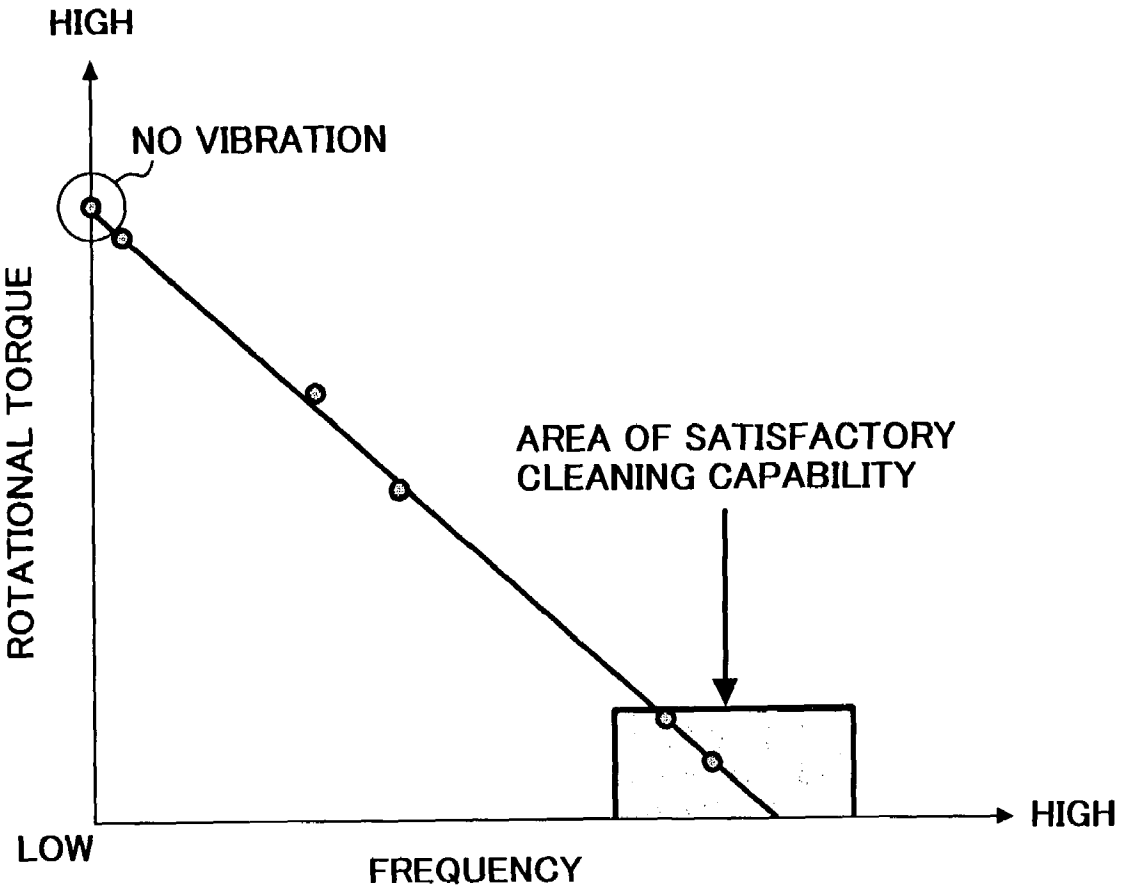
FIG. 31 is a graph illustrating a relationship between a frequency of a drive signal for the vibrating blade and a rotational torque of the image carrier, and cleaning capability thereof according to the ninth embodiment.

FIG. 31 illustrates the change in rotational torque when the drive frequency is changed by setting the voltage Vpp of the drive bias to the vibrating unit to 20 volts. This figure also illustrates a cleaning possible area and a satisfactory cleaning area based on the evaluation on the cleaning capability after output corresponding to 50,000 sheets was performed when the cleaning operation was performed under each of the drive bias conditions, that is, while residual toner was actually cleaned.

As is clear from FIG. 31, if the drive frequency is made high, the rotational torque is decreased, that is, the tendency similar to that of FIG. 29 is shown in the figure. Referring to a relation of the toque with the cleaning capability, it is clear that cleaning is possible or sufficiently performed at a point at which the drive frequency is high. If vibration is not provided, the rotational torque is high, and therefore it is predicted that the large rotational torque becomes a heavy load on rotation of the image carrier, and the cleaning capability is also very low.

The cleaning was possible to the conventional pulverized toner without vibration to the blade. However, when the toner having a shape close to spherical is used to obtain high image quality, the presence or absence of vibration largely affects the cleaning capability as explained in the first embodiment.

Figure 32:
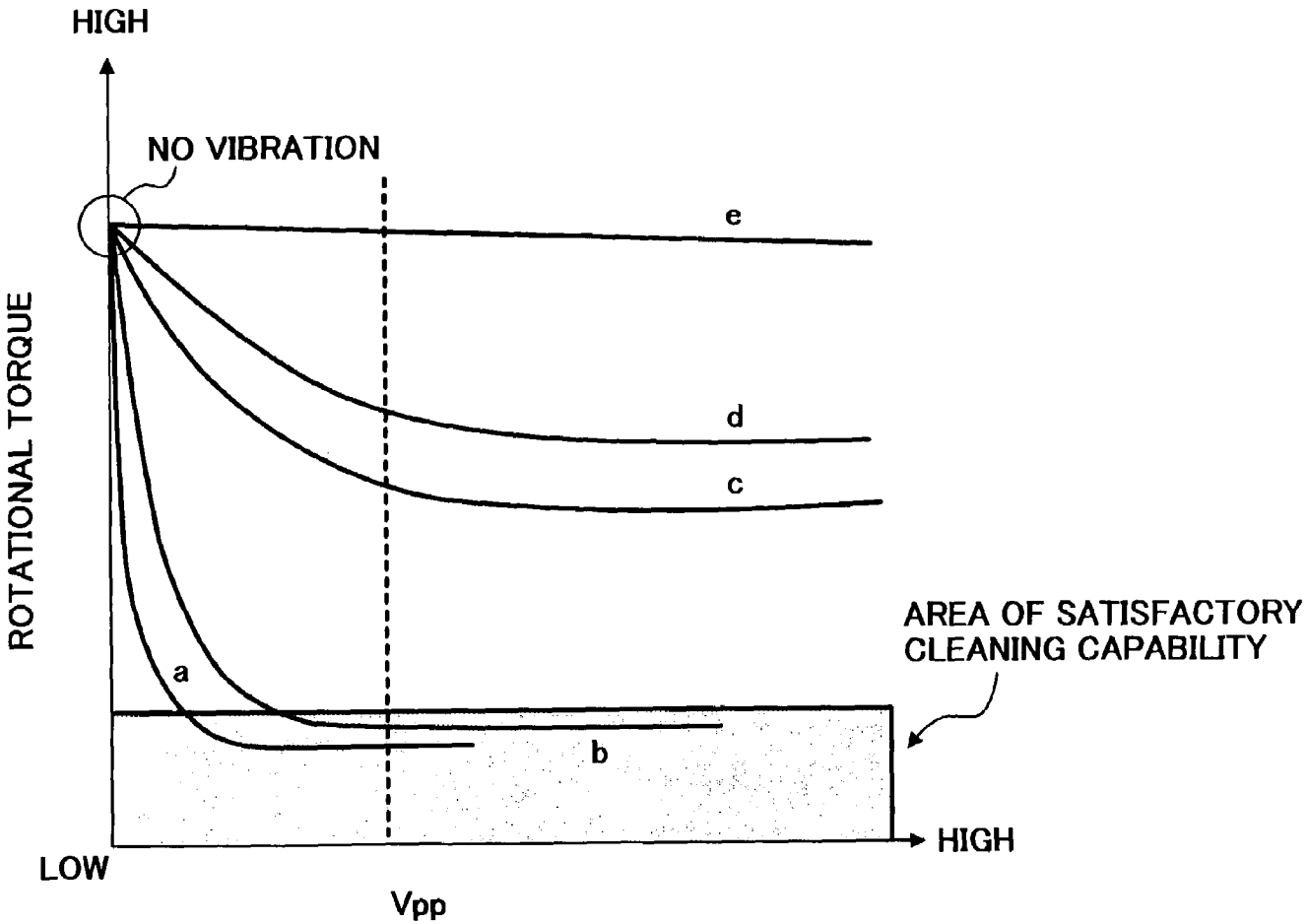
FIG. 32 is a graph illustrating a relationship among a frequency of a drive signal and a drive voltage for the vibrating blade and a rotational torque of the image carrier, and cleaning capability thereof according to the ninth embodiment.

FIG. 32 illustrates changes in rotational torque when the drive frequency of the drive bias to the vibrating unit is changed to frequencies a to e and the voltage Vpp is changed at each of the frequencies a to e. This figure also illustrates a cleaning possible area and a satisfactory cleaning area based on the evaluation on the cleaning capability after output corresponding to 50,000 sheets was performed when the cleaning operation was performed under each of the drive bias conditions, that is, while residual toner was actually cleaned. It is noted that the magnitude of frequencies a to e is set to a relation such as a>b>c>d>e.

As is clear from FIG. 32, if the voltage Vpp is increased, the rotational torque is decreased, that is, the tendency similar to that of FIG. 30 is shown in the figure. Referring to a relation of the voltage with the cleaning capability, it is clear that cleaning is possible or sufficiently performed at a point at which the voltage Vpp is high, but the cleaning capability is not good enough at low frequencies c to e. If the voltage Vpp is increased to vibrate the blade, the rotational torque can be decreased (c, d) unlike the conventional blade when the voltage Vpp is 0, i.e., without provision of the vibrating unit. However, it is understood that the drive bias to the piezoelectric element requires certain frequency vibration, considering the cleaning capability. It is noted that even if the blade was vibrated, the conventional blade and the rotational torque were hardly changed at the frequency e.

It is clear that the rotational torque is decreased, in other words, the frictional resistance between the blade and the image carrier is decreased to thereby improve the cleaning capability, from the relation between the results of changing the conditions of the drive biases and the cleaning capability.

Figure 33:
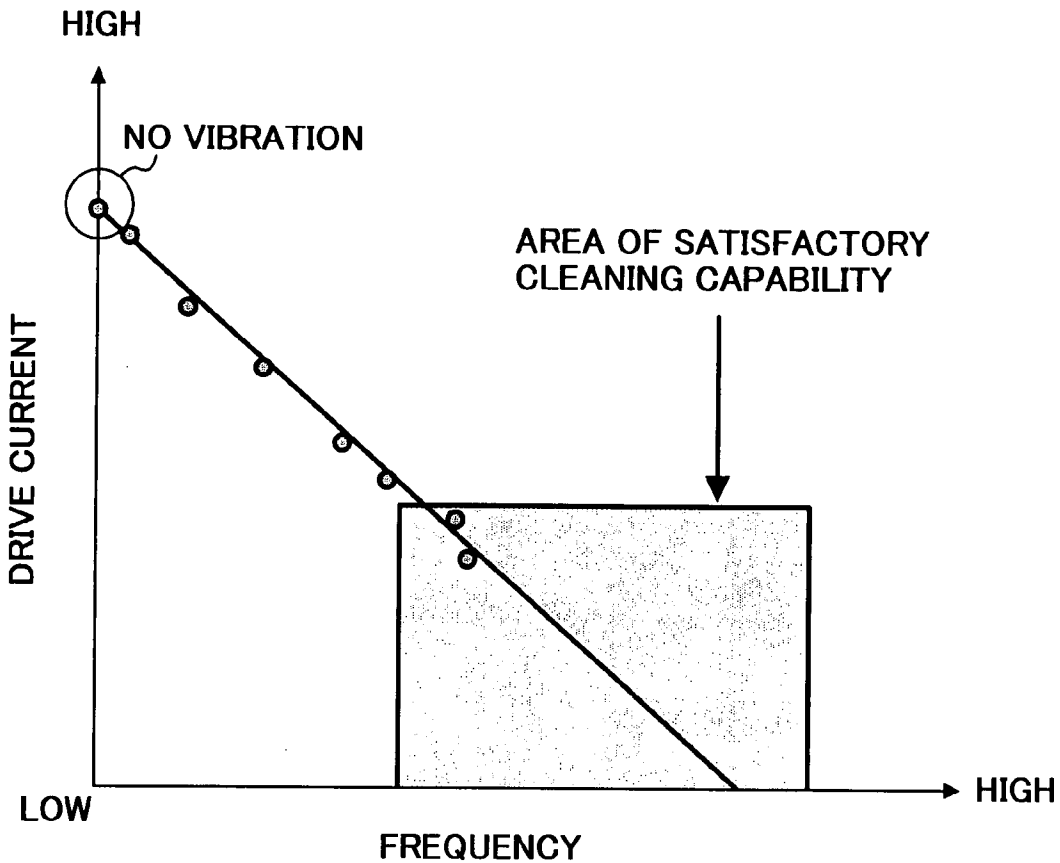
FIG. 33 is a graph illustrating a relationship between a frequency of a drive signal for the vibrating blade and a drive current of a drive motor for the image carrier, and cleaning capability thereof according to the ninth embodiment.
Figure 34:
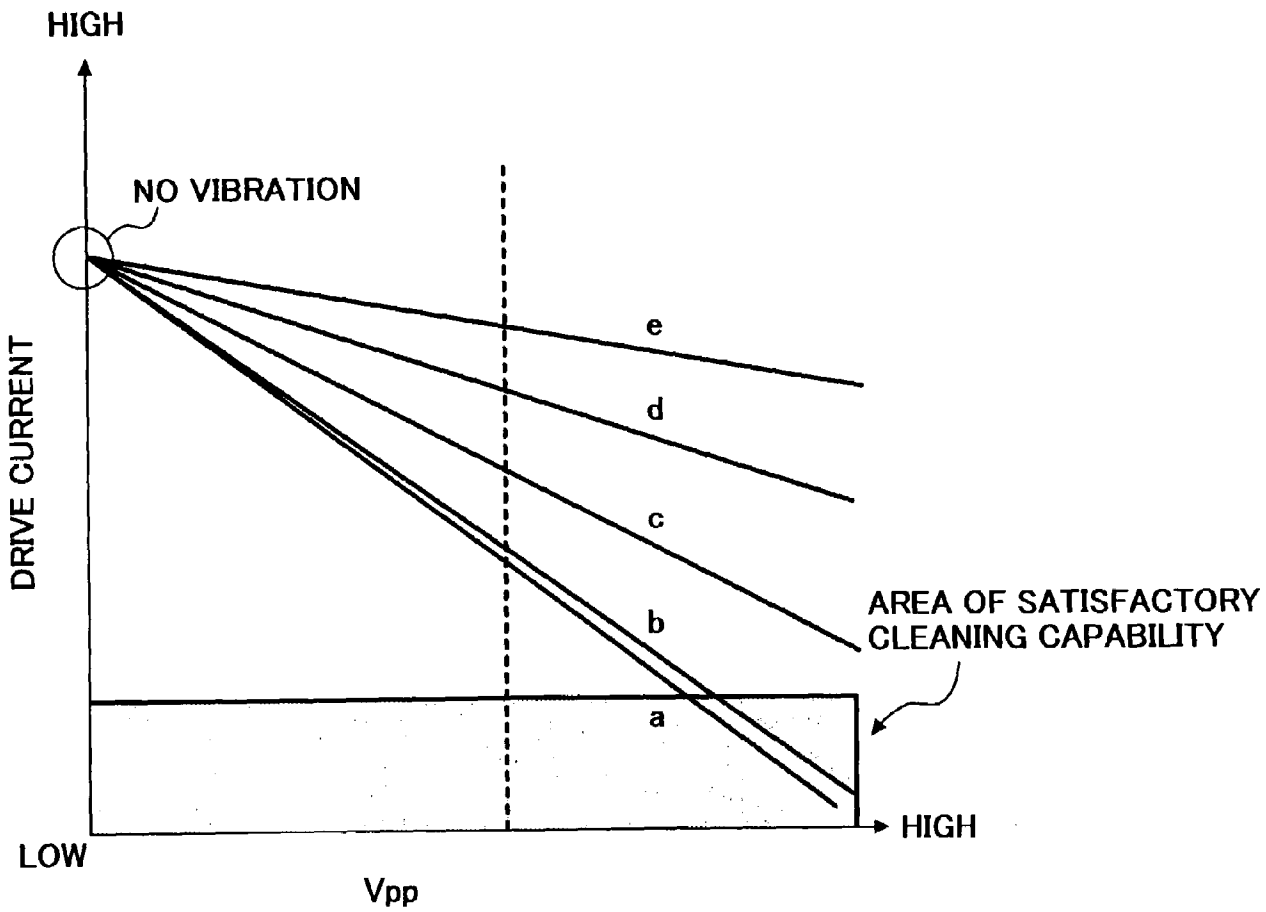
FIG. 34 is a graph illustrating a relationship among a frequency of a drive signal and a drive voltage for the vibrating blade and a drive current of the drive motor for the image carrier, and cleaning capability thereof according to the ninth embodiment.

Subsequently, as a motor that rotates the image carrier of the image forming apparatus, a DC motor was used, and a current value of the drive current for the DC motor was detected and measured. In this case, when the frictional resistance is low, i.e., the load to the motor is light, it is predicted that a small current flows through the DC motor. Actually, the motor for driving the drum-like image carrier was replaced with the DC motor to be tested in the same manner as that of the evaluation by the rotational torque meter. FIG. 33 and FIG. 34 illustrate the results of changing the frequency of drive signals for the piezoelectric element and the results of changing the voltage Vpp.

The tendency of changes in the drive bias and the drive current for the motor is the same as the results on the rotational torques, but it is understood that each voltage Vpp at each of the frequencies a to e was linearly changed. Referring to the cleaning capability, if a small drive current is supplied to the motor, the cleaning capability is improved.

Therefore, in the method of detecting a drive current to estimate frictional resistance based on the result of detection, the frictional resistance cannot directly be ascertained, but the image forming apparatus can be configured without any mechanical device like the rotational torque meter.

From the relation between the results of changing the drive biases and the cleaning capability, it is clear that the drive current is decreased, in other words, the load as frictional resistance between the blade and the image carrier is decreased to thereby improve the cleaning capability.

As explained above, feedback control is performed on the piezoelectric element that forms the vibrating unit from the conditions of image formation such as a toner consumption amount, environmental conditions, and a number of sheets to be printed, based on the results of detecting the rotational torque of the image carrier or detecting the drive current for the DC motor. Then, the frictional resistance between the blade member and the image carrier is changed, and it is thereby possible to obtain stable and excellent cleaning capability.

The cleaning capability is difficult to be evaluated in the initial stage of the image formation. Therefore, actual toner cleaning requires the evaluation on the cleaning capability after a certain number of sheets are output. As explained above, the cleaning capability was evaluated after 50,000 sheets were output, and comparison was made between the evaluation and the vibrating conditions.

Further, when the actual image forming apparatus is used to allow image formation, such changes as filming of toner and film scraping of the photoreceptive layer occur oh the surface of the image carrier. Therefore, it is easily predicted that the changes surely occur in the ninth embodiment where the frictional resistance is decreased. Consequently, it is considered that the optimal condition for cleaning, i.e., the frictional resistance between the blade and the image carrier is changed.

To solve the problem, some means is required to control the vibrating conditions of the vibrating unit. Therefore, as explained above, using the piezoelectric element is the most effective. Changing the drive bias for the piezoelectric element allows decrease in the frictional resistance, rotational torque, and the drive current for the DC motor, which makes it possible to perform cleaning under the optimal conditions even if the conditions are changed in output of some images.

Indexes of changes in vibration conditions are explained here. Filming is deficiency caused by the toner that is expanded over the surface of the image carrier by the blade. The filming of the toner may cause the frictional resistance between the blade and the image carrier to be decreased or increased depending on the toner type. In either of the cases, it is necessary to maintain the minimum frictional resistance required for cleaning the toner in order to ensure normal cleaning capability.

The toner filming tends to be fostered when a toner consumption amount is larger and an area ratio of an image to be output is higher, although they are not perfectly linearly increased, as compared with the ordinary toner consumption amount and image area ratio. The reason is assumed such that the more amount of toner comes in contact with the image carrier, the more filming by the blade may occur.

Therefore, the image area ratio is calculated based on the image data and the vibrating conditions of the blade are changed based on the calculated image area ratio. By doing so, it is possible to determine optimal cleaning conditions for controlling the frictional resistance or the drive current for the rotational torque and the DC motor when used. Furthermore, if the environmental conditions are changed, the blade portion is changed by the environment, which causes the abutting condition of the cleaning blade to be changed. Therefore, it is predicted that the frictional resistance, rotational torque, and the drive current for the DC motor are changed. By detecting these values according to changes of the environments and setting the conditions to appropriate vibrating conditions based on the results of detection, optimal cleaning can also be performed.

In the second embodiment, the pressing amount and the abutting angle of the blade member 21 of the vibrating blade 20 against the image carrier 11 are the same as those illustrated in FIG. 9. Therefore, the setting may be performed according to the first embodiment, and explanation thereof is omitted.

Figure 35:
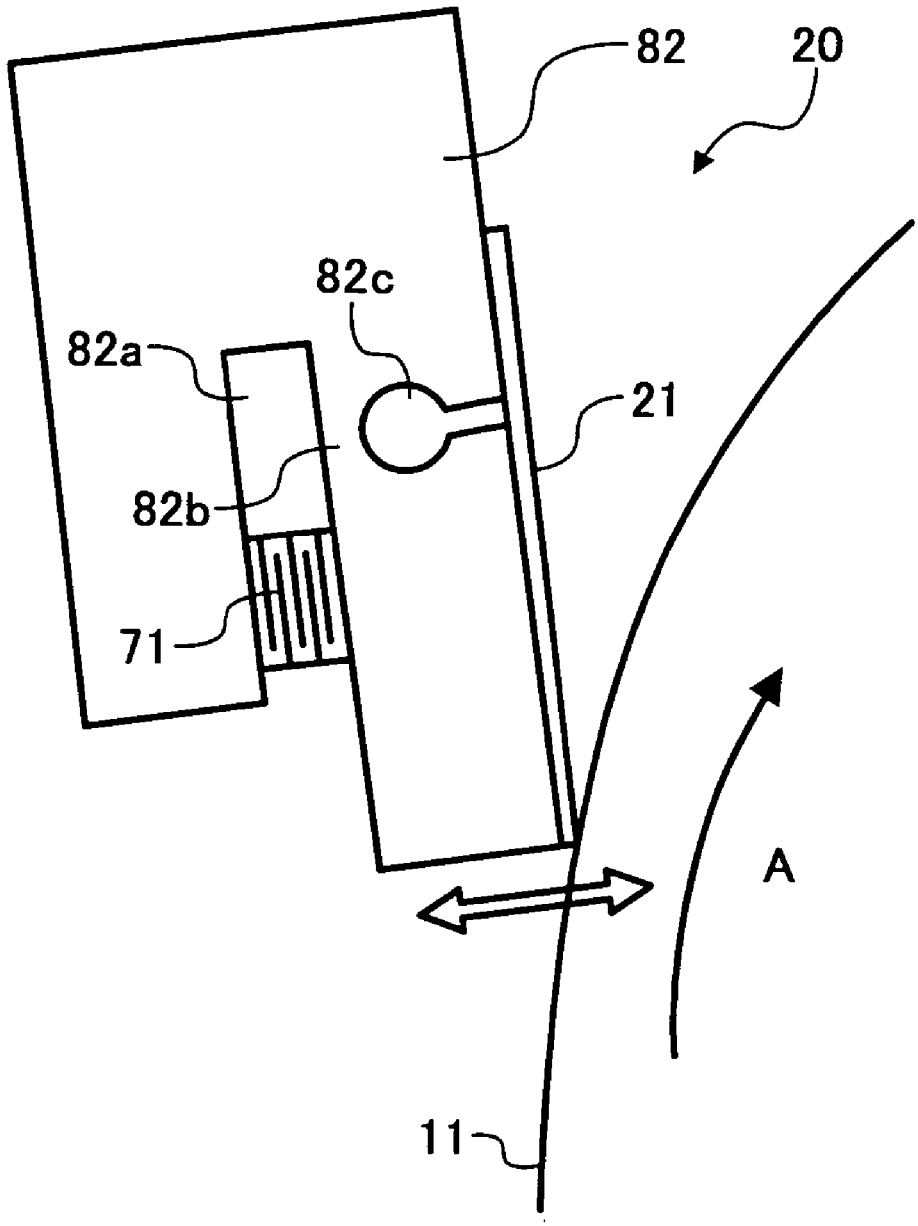
FIG. 35 illustrates another structure of the vibrating blade in the cleaning device according to a tenth embodiment of the present invention.

A tenth embodiment of the vibrating blade 20 in the cleaning device 16 will be explained below with reference to FIG. 35.

In the tenth embodiment, the vibratable member (82) is made thicker to enhance the stiffness, a concave part 82*a* having a character U shape is formed, and a laminated type piezoelectric element is disposed in the concave part 82*a* so as to sandwich a vibrating unit 71 as the laminated type piezoelectric element that utilizes displacement in the d-33 direction the same as explained above.

A vibratable groove 82*c* is provided in the vibratable member 82 so as to form a thin part 32*b* in the member 82 so that the edge part of the vibratable member 82 is efficiently vibrated by the vibrating unit 71. Further, the blade member 21 is thin-layered so that the vibration from the vibratable member 82 can easily be transmitted.

As the portion of the vibratable member 82 to which the blade member 21 is fixed becomes stiffer, and that portion more efficiently propagate the vibration to the blade member 21.

Figure 36:
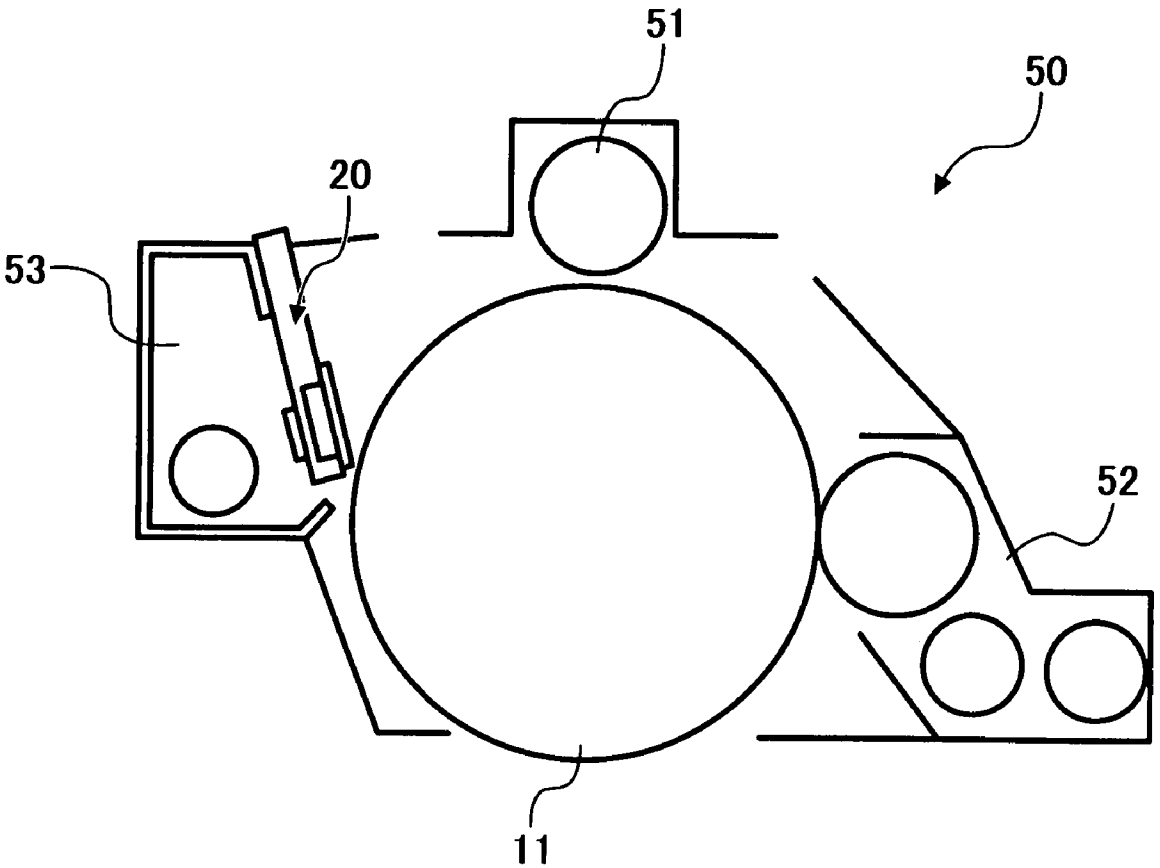
FIG. 36 illustrates a structure of a process cartridge according to the tenth embodiment.

A process cartridge including the cleaning device explained in the sixth to tenth embodiments of the present invention will be explained below with reference to FIG. 36. FIG. 36 is a cross section of the schematic structure of a process cartridge 50.

The process cartridge 50 is formed by integrating a plurality of components, into one unit, selected from among the image carrier 11, a charging unit 51, a developing unit 52, and a cleaning device 86 according to the second embodiment. This process cartridge 50 is detachably formed to a main body of an image forming apparatus such as a copier and a printer.

The cleaning device 53 is provided in the detachable process cartridge to enable improvement of maintenance and easy replacement with another cleaning device as an integral unit.

Figure 37:
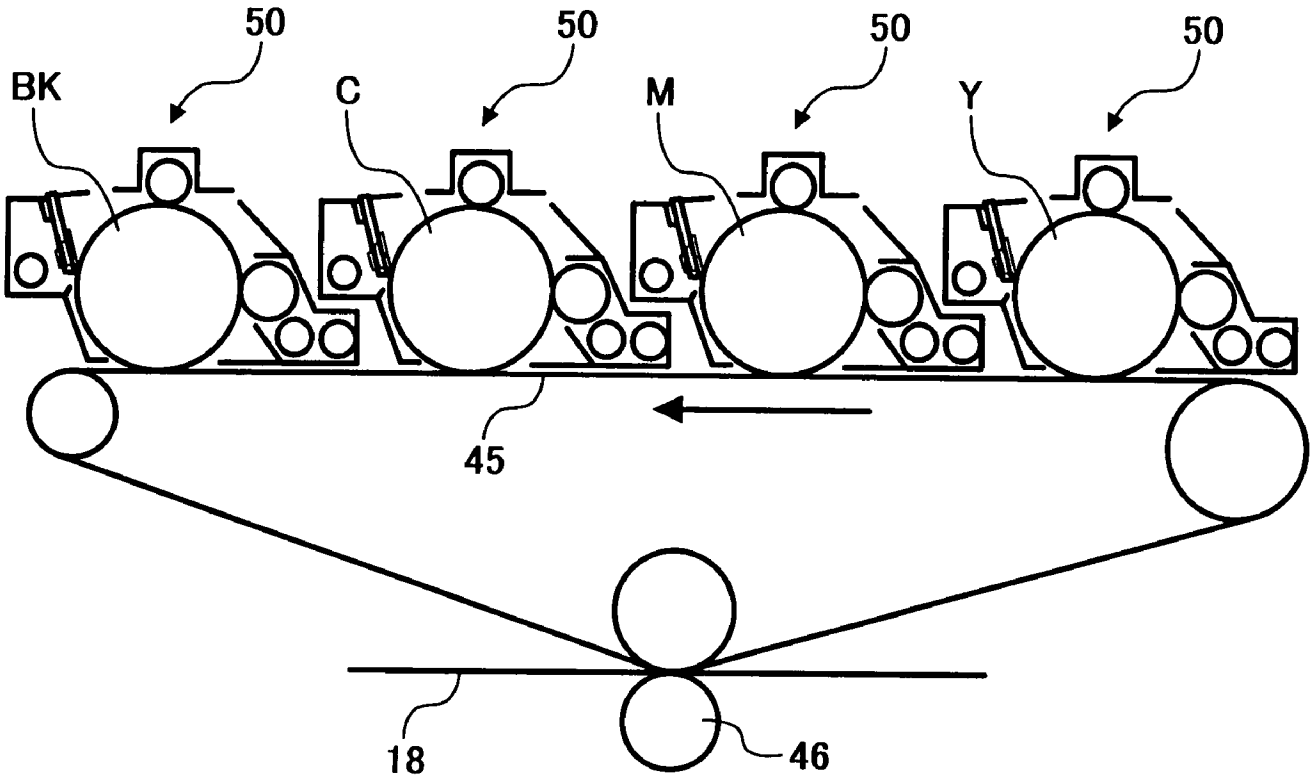
FIG. 37 illustrates a schematic structure of the image forming apparatus according to the present invention having the process cartridges according to the tenth embodiment.

A color image forming apparatus using the process cartridge 50 will be explained below with reference to FIG. 37. The image forming apparatus is a tandem type color image forming apparatus in which the process cartridges 50 of colors are arranged in tandem with each other along the transfer belt (image carrier) 45 that horizontally extends.

Four process cartridges 50 of yellow (Y), magenta (G), cyan (C), and black (Bk) are arranged. Toner images on the image carriers 11 obtained by being developed in the process cartridges 40 are sequentially transferred on the horizontally extending transfer belt 45 that is applied with a transfer voltage.

Images of yellow, magenta, cyan, and black are formed and superposedly transferred on the transfer belt 45, and the superposed images are collectively transferred on a transfer material 18 by the transfer unit 46. The superposed toner images on the transfer material 18 are fixed by a fixing unit (not shown). The process cartridges 50 are explained in order of yellow, magenta, cyan, and black, but the order is not specified, and therefore any arrangement may be provided.

Generally, the color image forming apparatus includes a plurality of image forming units, which causes its upsizing.

Further, if units for cleaning, charging, or the like are out of order individually or a time to replace the units due to end of their lives comes, because the device is complicated, a lot of time is required to exchange the units.

To solve the problem, the components of the image carrier, charging unit, and the developing unit are integrated into one unit as the process cartridge 50, and it is thereby possible to provide the color image forming apparatus compact in size with increased durability and with a user-exchangeable process cartridge.

Further, the cleaning device shown in the sixth to eight embodiments is provided in the process cartridge 50, and it is thereby possible to form a high quality image without occurrence of faulty cleaning even if the spherical toner is used.

The process cartridge using the cleaning device of the ninth embodiment may change the characteristics of color toner depending on color materials. In this case, however, the frictional resistance (rotational torque of the image carrier or drive current for the DC motor) can be optimized at the time of image formation, thus obtaining the image forming apparatus capable of maintaining cleaning capability and improving durability.

Here, explanation has been given using the spherical toner, and the same goes for the fine toner. Both the spherical and fine toner may be used in the sixth to eighth embodiments, and the irregular toner may be used in the ninth embodiment.

There is a relative speed difference between a surface to be cleaned and a blade member that abuts the surface to remove residual therefrom. Therefore, when vibrated, the blade member is steadily pulled toward the surface. An eleventh embodiment has a configuration that prevents this state. In other words, as illustrated in FIG. 1, the surface to be cleaned represents the surface of the drum-like image carrier 11, and the rotational speed of the image carrier 11 is made relatively different with respect to that of the blade member 21 that abuts the surface of the image carrier 11.

The blade member 21 is made of an elastic body such as polyurethane rubber as a main component. The thickness thereof is set to a range from 50 to 2,000 micrometers, preferably 100 to 500 micrometers. By setting so, a lack of an engaging amount is resolved if the thickness is too thin, and a damping action is prevented if the thickness is thick.

Figure 38A:
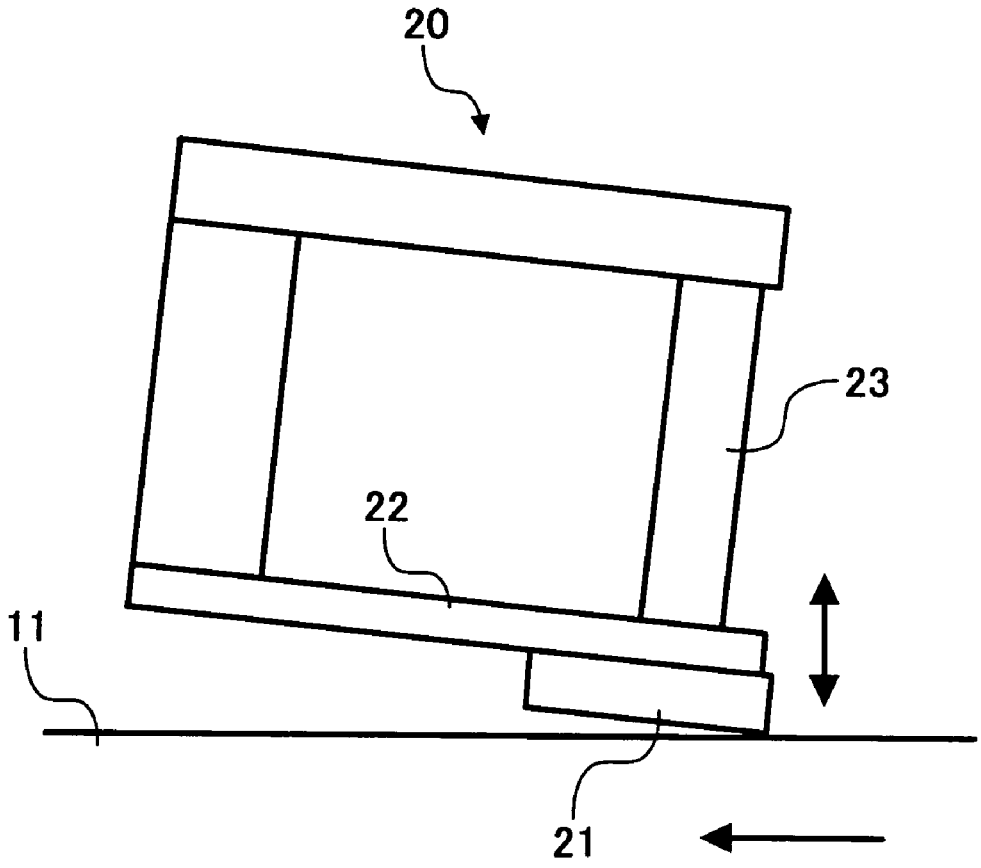
FIG. 38A and FIG. 38B illustrate a key structure of a cleaning device according to an eleventh embodiment of the present invention.
Figure 38B:
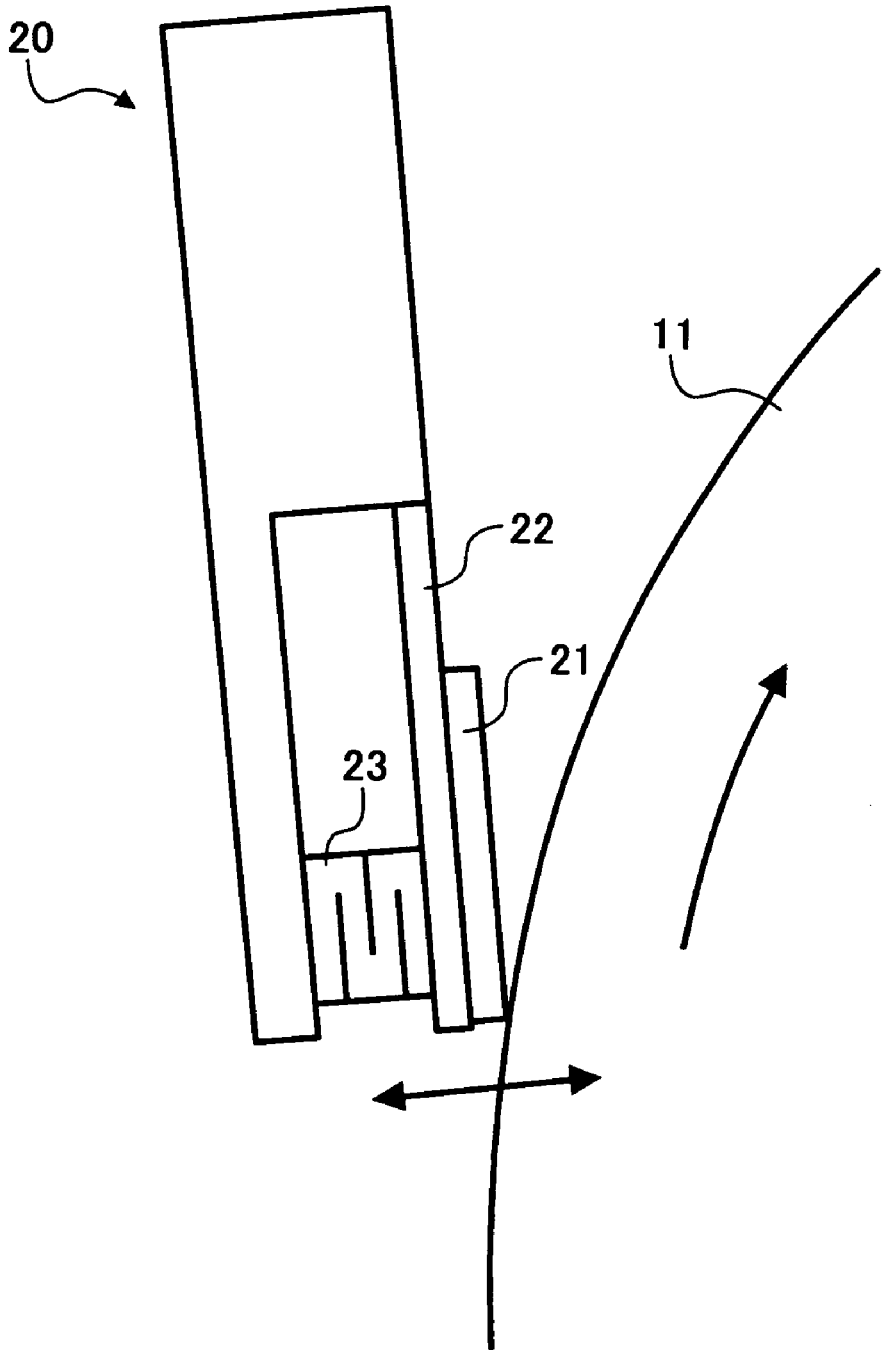
Figure 39:
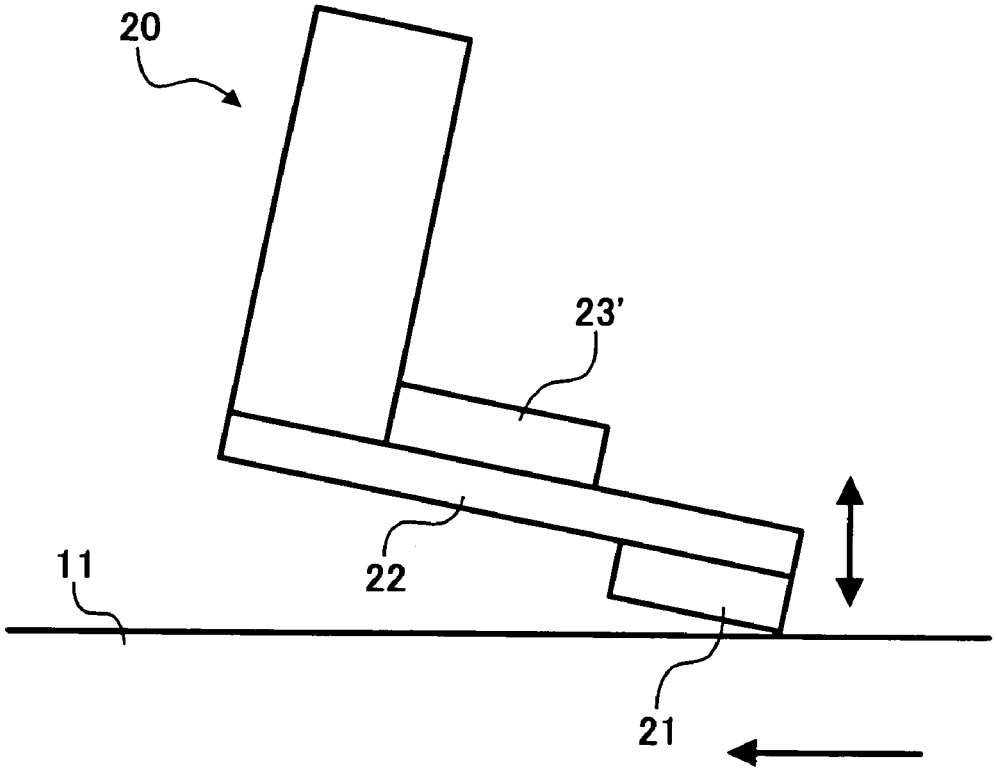
FIG. 39 illustrates another example of the structure shown in FIG. 38A.

The blade member 21 is provided on a vibratable member explained later, and one or more vibrating units are provided in the vibratable member. FIG. 38A, FIG. 38B, and FIG. 39 illustrate a support structure of the blade member 21. As illustrated in FIG. 38A and FIG. 38B, the blade member 21 is fixed to the flexible vibratable member 22, and the vibrating unit 23 is further fixed to the vibratable member 22.

As the vibrating unit 23, an electrically controllable element such as a bimorph piezoelectric element is used other than a solenoid or a motor. The bimorph piezoelectric element is advantageous in responsivity, displacement amount, and size reduction. As illustrated in FIG. 38B, the piezoelectric element is structured in a such a manner that a plurality of piezoelectric elements (indicated by reference numeral 23 for simplicity) are laminated in parallel with a thickness direction of the vibratable member 22, or a single plate (indicated by reference numeral 23') is selected as illustrated in FIG. 39. The criteria for selection based on the structural difference are as follows. If the high frequency responsivity and displacement capability are prioritized, then the laminated structure is selected, while if the displacement amount is preferred, then the single plate structure is selected. It is noted that in FIG. 38A, the surface to be cleaned is a flat one, while in FIG. 38B, the surface is a curved one. The flat surface indicates a belt as a target to be cleaned.

The vibration generated by the vibrating unit 23 is propagated to the blade member 21 through the vibratable member 22. The vibration amount at the blade member 21, that is, the amplitude of the vibration at this time is set to a value so as to be smaller than a size of spherical toner, i.e., a particle size of the toner as residual on the surface of the image carrier 11 after the toner is used for image formation.

Figure 55:
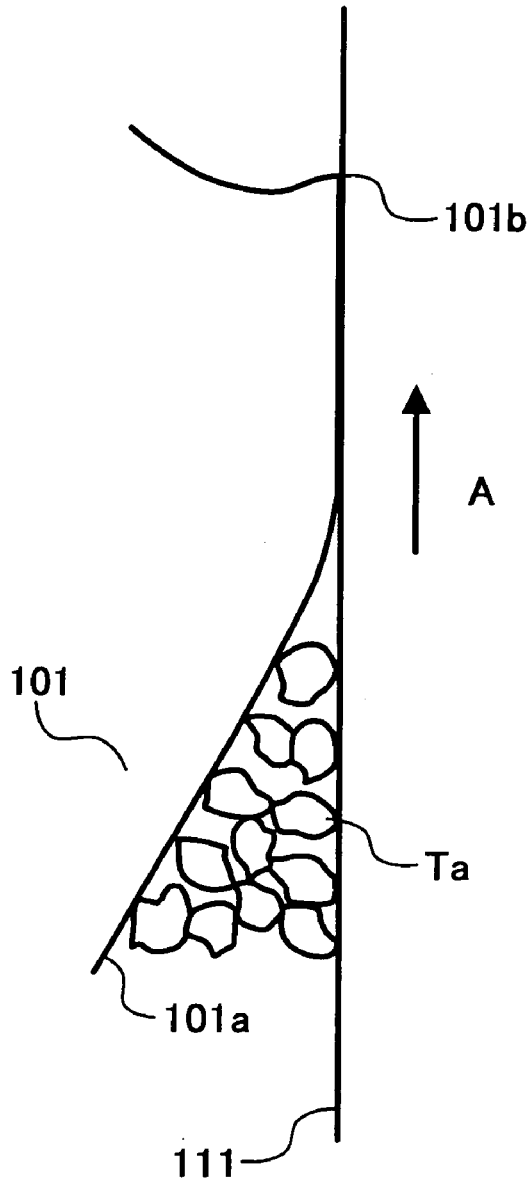
BACKGROUND ART FIG. 55
FIG. 55 illustrates a cleaning mechanism of pulverized toner when the same cleaning blade is used.
Figure 56:
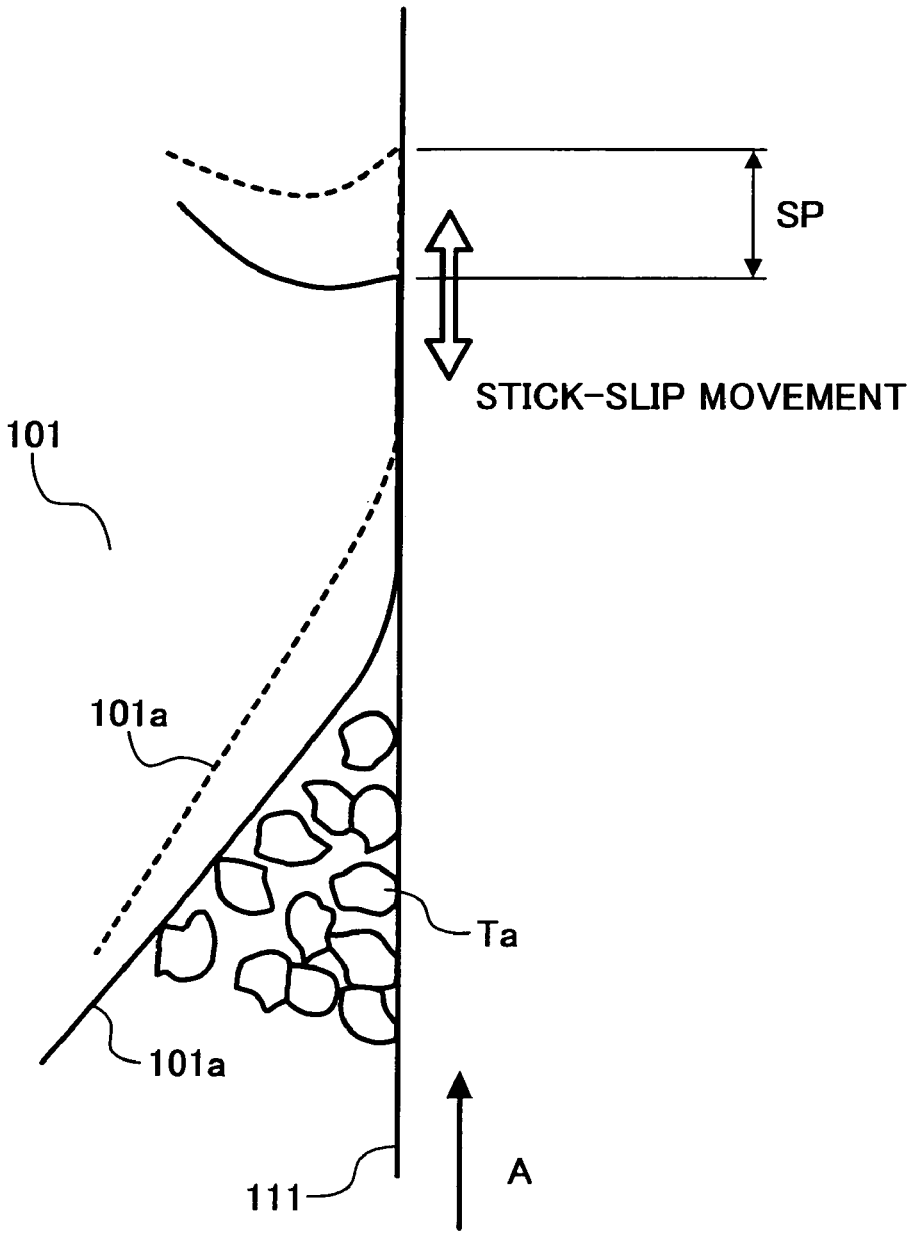
BACKGROUND ART FIG. 56
FIG. 56 illustrates a stick-slip movement in the cleaning mechanism of the pulverized toner when the same cleaning blade is used.

When any of the vibrating structures as illustrated in FIG. 38A, FIG. 38B, and FIG. 39 is used, the blade member 21 is pulled toward the surface of the image carrier 11 due to the relative speed difference and curling occurs, which has been explained in the principle as illustrated in FIG. 1. However, the curling that is steadily kept is resolved by means of the vibration. Particularly, the blade member 21 that is loosened due to the vibration releases an elastic restoring force accumulated in the curled state, which allows the cleaning surface, facing the toner, to be restored to the original form. The restoration force at this time makes the toner accumulated in the wedge-like space N (see FIG. 55) rejected. If the curled state is steadily continued, the toners continuously entering the wedge-like space N easily pass through along the lower face of the blade member 21, and thereby, faulty cleaning occurs. However, in the eleventh embodiment, by resolving the curled state that steadily occurs in the blade member 21, it is possible to suppress faulty cleaning by increasing chances to reject the toners.

The vibration at the blade member 21 is propagated to the toners (toners existing in the region indicated by the reference sign B in FIG. 1) that are directly rejected by the cleaning surface facing the blade member 21, when the curling of the blade member 21 is resolved to restore the form. The vibration is also propagated to the toners (toners existing in the region indicated by the reference sign C in FIG. 1) that exist outside the region B and do not directly contact the blade member 21. Therefore, the toners are effectively stripped from the surface of the image carrier 11, and a scraping rate when the image carrier 11 and the blade member 21 relatively move can be improved.

On the other hand, a frictional force with the image carrier 11 that is produced in the curled state of the blade member 21 is reduced by restoring the blade member 21 from the curled state to the original form by the vibration. Thus, it is also possible to suppress the increase in the frictional resistance to the image carrier 11.

Figure 40:
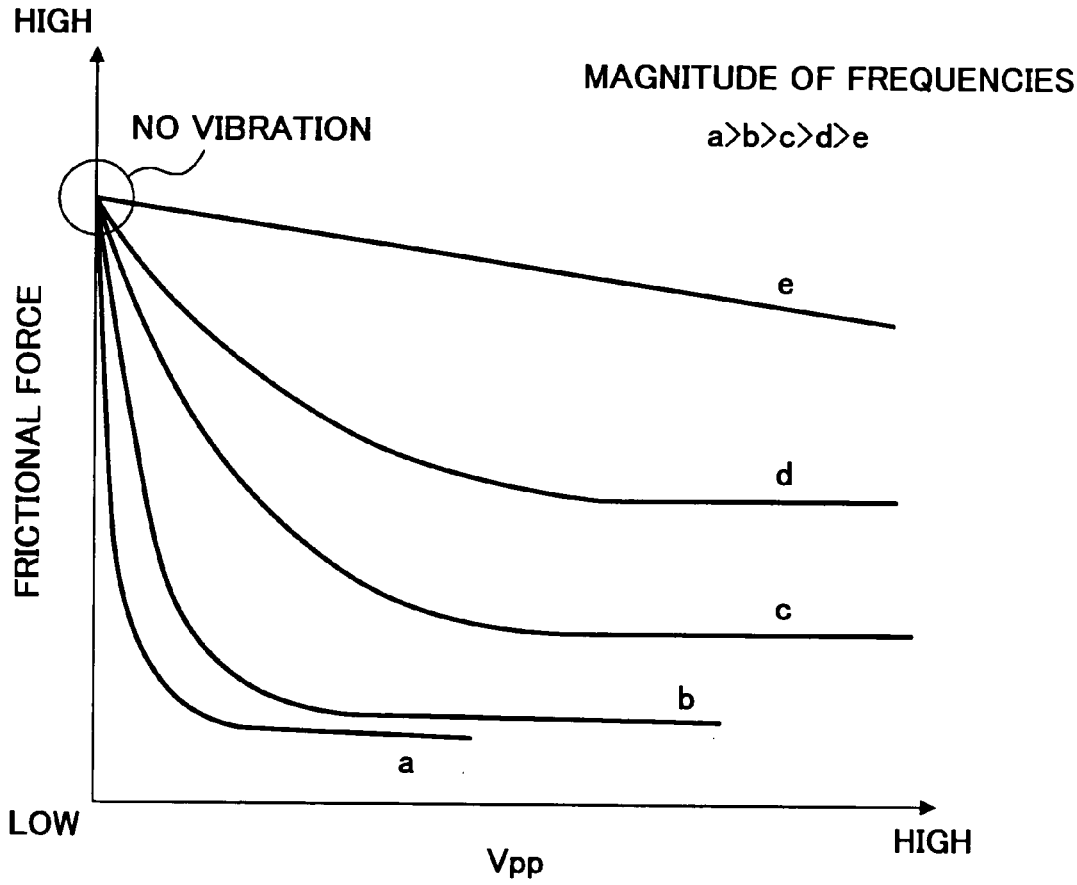
FIG. 40 is a graph illustrating measurement results of frictional force between the surface of the latent image carrier and the blade member in contact with the surface in the cleaning device according to the eleventh embodiment.

FIG. 40 is a diagram illustrating results of measuring the frictional force between the surface of the image carrier 11 and the blade member 21 abutting the carrier 11. It is clear from FIG. 40 that the frictional force is reduced by vibrating the blade member 21. As illustrated in FIG. 40 in particular, if a comparison is made by changing the number of vibrations (frequency) under the condition of constant applied voltage (Vpp) at the time of charging to the image carrier 11, then it is clear that the frictional force is decreased as the frequency becomes higher. If the frequency is zero in FIG. 40, the blade is not vibrated, in other words, this state indicates the conventional blade member, and it is therefore clear that vibrating the blade member makes the frictional force reduced.

Reference numeral 20 in FIG. 38A and FIG. 38B denotes a vibrating blade where the vibratable member 22 supporting the blade member 21 and the vibrating unit 23 are disposed.

As illustrated in FIG. 40, the frictional force is effectively reduced as the vibrating frequency for the blade member 21 becomes higher. However, in a twelfth embodiment, the frequency is set to a value lower than a primary resonance frequency of the vibrating unit 23 or 23' for the following reason.

Figure 41:
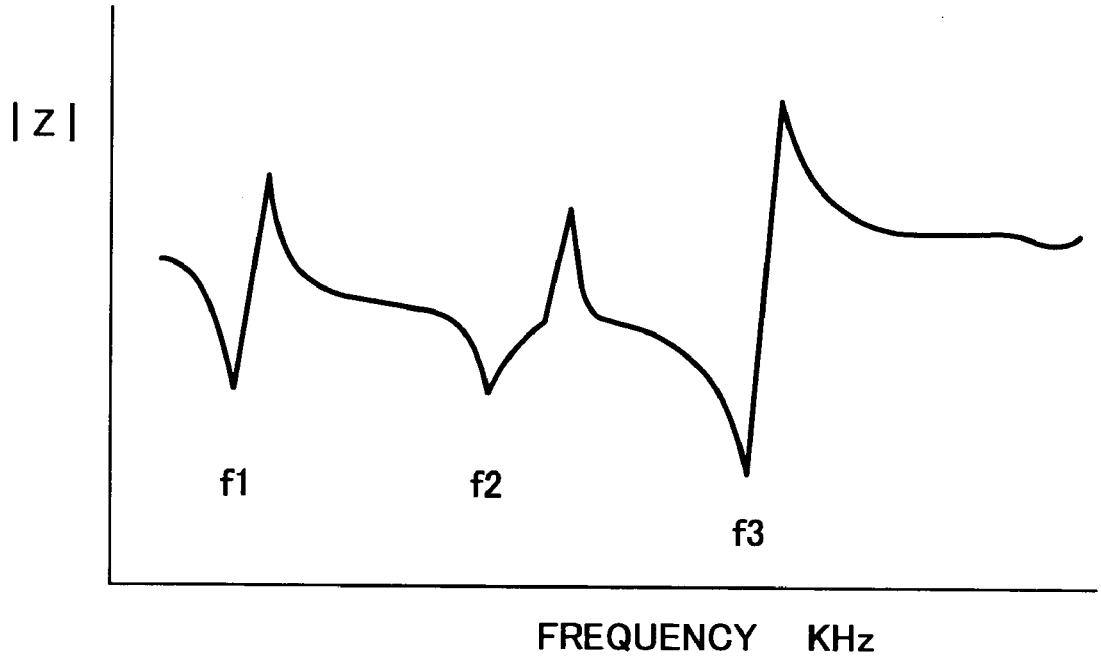
FIG. 41 is a graph illustrating results of measuring a relationship between a frequency and an impedance by a vector impedance meter according to a twelfth embodiment.

FIG. 41 illustrates a relation between the frequency and the impedance. Among resonance points occurring at three points, reference sign f1 denotes a primary resonance point as a structure, i.e., the vibrating blade 20, and f2 denotes a secondary resonance point of the structure. On the other hand, reference sign f3 indicates a resonance point at a vibrating point on the vibrating unit 23 because an impedance difference is large at the resonance point. If an operation frequency is set to a frequency higher than that at the resonance point at the vibrating point, the impedance becomes large, and it is therefore clear that electrical efficiency for vibration gets worse. Thus, it is preferable that the operation frequency is set to a value lower than that at the resonance point at the vibrating point, in order to obtain propagation characteristic with high efficiency.

As a thirteenth embodiment, the blade member 21 is brought into contact with the surface of the latent image carrier as a surface to be cleaned in some amplitude by using deflection stiffness of the vibratable member supporting the blade member 21. Therefore, the pressing force of the blade member 21 against the image carrier 11 depends on the deflection amount of the vibratable member 22. In the thirteenth embodiment, the pressing force of the blade member 21 is set to a value smaller than the pressing force produced when the vibrating unit 23 generates vibration. Accordingly, the deflection force of the blade member 21 when it is vibrated becomes large and the blade member 21 actively operates. The elastic restoring force is thereby enhanced to enable effective rejection of toner when the blade member is restored to the original form. However, it is needless to say that the amplitude in this case is set to a value not exceeding the size of the toner as a residual so as to prevent occurrence of faulty cleaning by preventing the toner from passing through the nip.

A fourteenth embodiment is characterized in that an angle ($\theta 1$) is set to a value larger than an angle ($\theta 2$). The angle ($\theta 1$) is formed between the cleaning surface of the blade member 21 facing toner and the surface of the image carrier 11, and the angle ($\theta 2$) is formed when the blade member 21 abuts the image carrier 11.

Figure 42A:
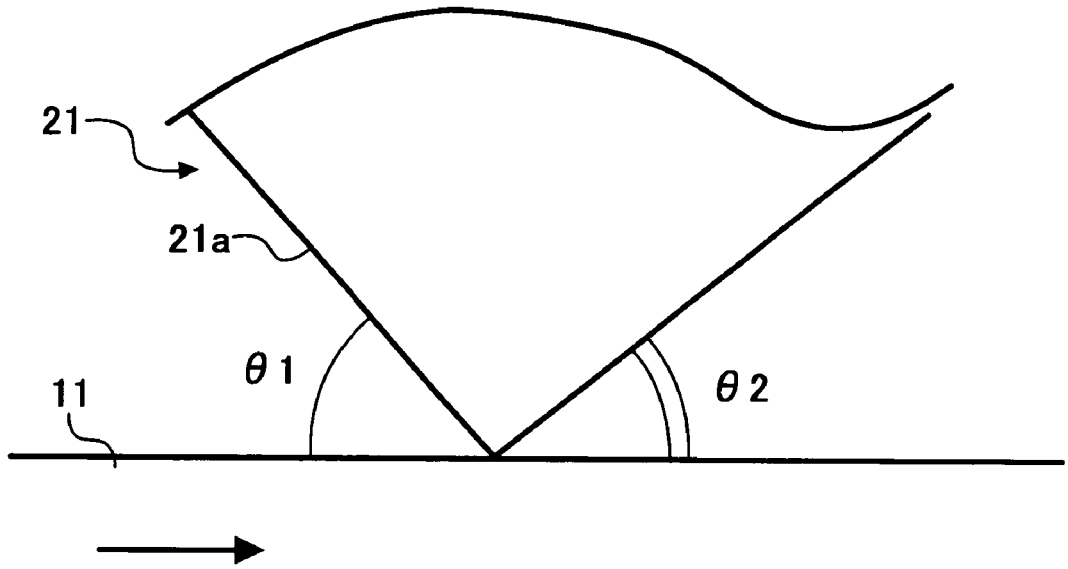
FIG. 42A to FIG. 42C illustrate comparative examples between a blade structure according to a fourteenth embodiment of the present invention and a conventional blade structure.
Figure 42B:
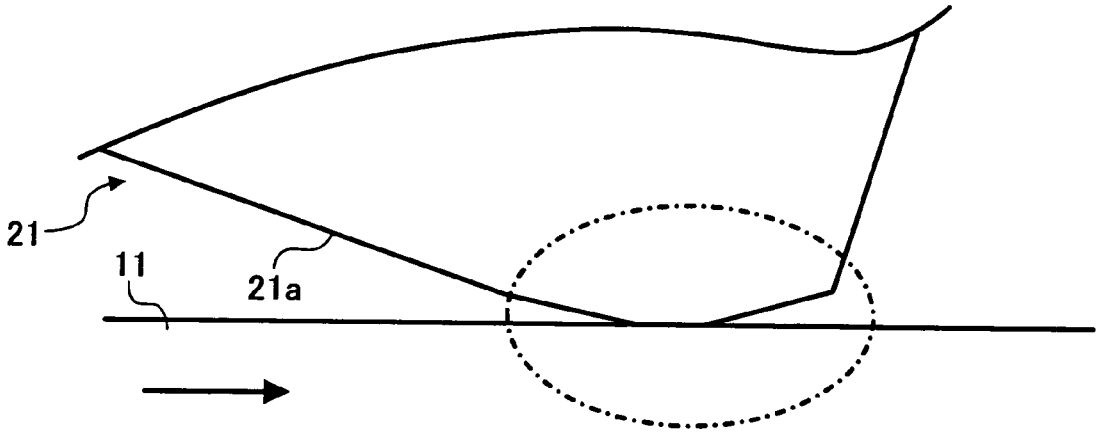
Figure 42C:
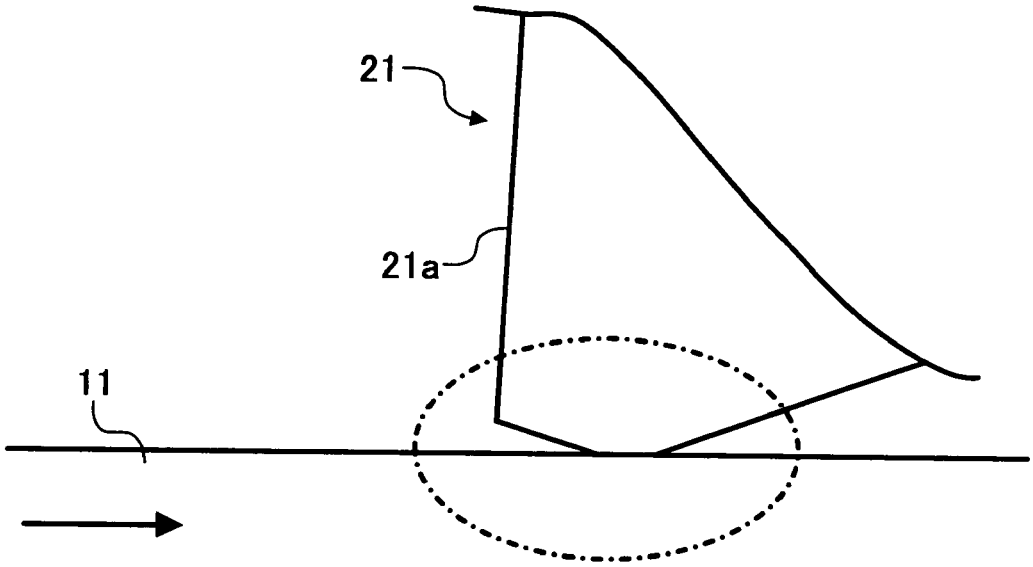

FIG. 42A to FIG. 42C illustrates an abutting state between he image carrier 11 and the blade member 21. As illustrated in FIG. 42A, when the blade member 21 is abutted against the image carrier 11, the angle formed at this case largely affects cleaning capability. That is, a cleaning angle ($\theta 1$) corresponding to an angle between the cleaning surface (indicated by reference numeral 21*a* in FIG. 42A to FIG. 42C) of the blade member 21 facing toner and the surface of the image carrier 11 exerts an effect on toner rejection force generated when the blade member 21 is restored.

If the angle at this time is too large, the toner only flies, and therefore rejection efficiency is insufficient. As illustrated in FIG. 42B, however, if the cleaning angle ($\theta 1$) is made small, squeaking and chattering of the blade more easily occur rather than faulty cleaning occurring because the blade is easily pulled toward the image carrier 11.

On the other hand, an abutting angle ($\theta 2$) has a function of scraping toner deposited on the image carrier 11. Accordingly, if this angle is high, the scraping function is eliminated. Therefore, as illustrated in FIG. 42C, if the cleaning angle is made larger or if the abutting angle is made smaller, not an edge face but a thick part of the blade member 21 is abutted on the image carrier 11, and curling does not occur in the blade edge part. In this case, the force of holding back the toner is weakened, resulting in occurrence of faulty cleaning.

From the results, the angle of the blade is set to $\theta 1 > \theta 2$, and the cleaning angle is set to $45° \text{ C.} \leqq \theta \leqq 80° \text{ C.}$, and it is thereby possible to obtain optimal cleaning capability.

Figure 43:
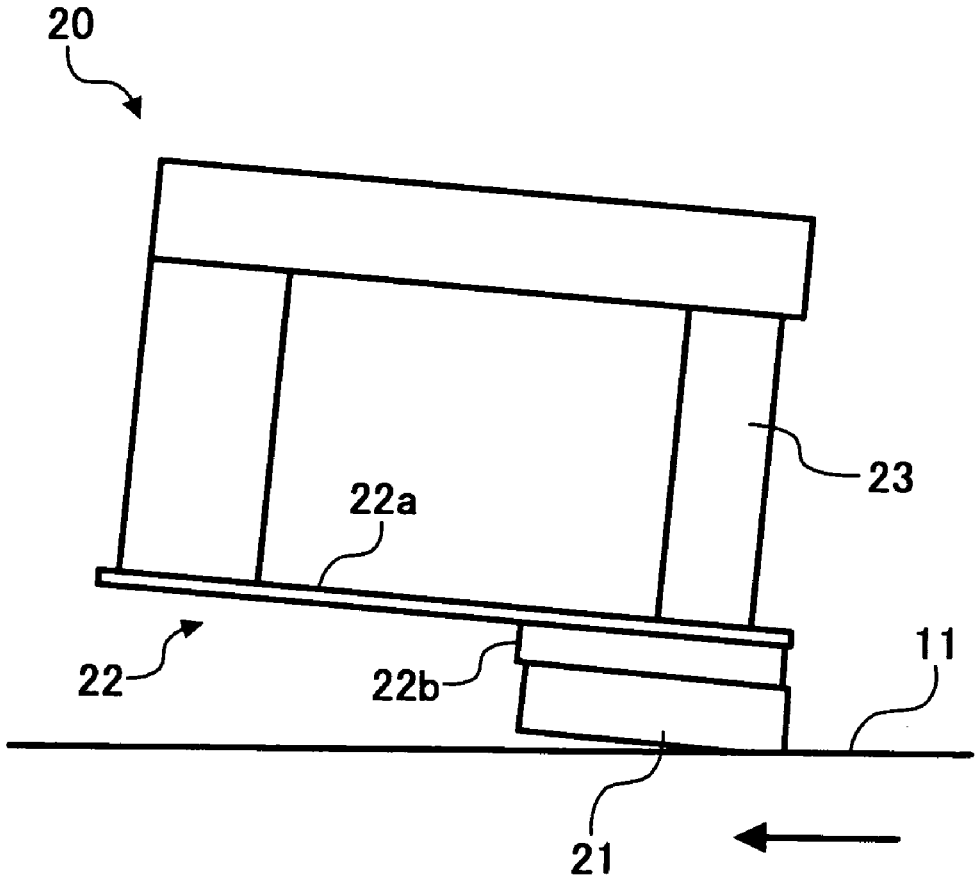
FIG. 43 illustrates a structure of a cleaning device according to a fifteenth embodiment of the present invention.
Figure 44:
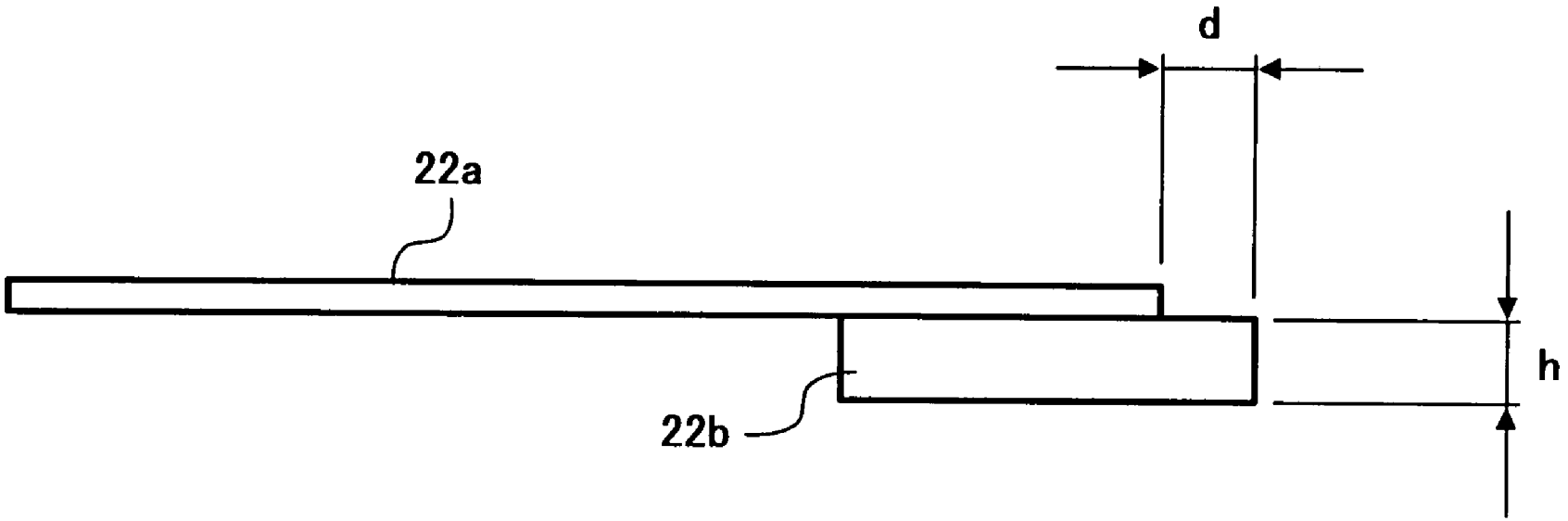
FIG. 44 illustrates a partially detailed structure of the cleaning device shown in FIG. 43.

FIG. 43 and FIG. 44 illustrate examples of structure according to a fifteenth embodiment. The vibratable member 22 provided in the vibrating unit 23 has different wall thicknesses in the extending direction, such as a thin-walled part 22*a* fixed to the vibrating blade 20 and a thick-walled part 22*b* to which the blade member 21 is fixed, unlike the case of FIG. 38A and FIG. 38B.

The thick-walled part 22*b* is formed by bonding a thick member to the vibratable member 22 that forms the thin-walled part 22*a*. In such a structure, the propagation characteristic of vibration is improved unlike the case of the vibratable member 22 having a uniform thickness. That is, in the thin-walled part 22*a*, the deflection stiffness is decreased to enable efficient propagation of vibration even if vibrating energy is reduced. In the thick-walled part 22*b*, the deflection stiffness is increased to create adaptability to frictional resistance produced when the toner is scraped off, to allow scraping force by the blade member 21 to be ensured, and to obtain uniform cleaning characteristic in the longitudinal direction by improving the stiffness in the longitudinal direction of the image carrier 11.

A method of machining the vibratable member 22 may be realized by cutting an iron mild steel plate such as SECC, etching process, or forging process. A thin plate and a thick plate are laminated and bonded to produce a high stiffness portion and a low stiffness portion, which is also easy. In this case, it is important to bond the portions over the whole surface but not to bond them at a spot.

On the other hand, how the blade member 21 is disposed on the vibratable member 22 is as illustrated in FIG. 44. It is essential to bond the blade member 21 and the vibratable member 22 over the whole surfaces in order to maintain the propagation characteristic of vibration.

As a bonding agent, epoxy type may be used, but if bonding to the blade member 21 is required, surface reforming is subjected to the members by primer coating or ion spattering on the blade side to improve the bonding performance. In order to efficiently transmit the vibration propagated from the vibratable member 22 to the edge of the blade member, a distance of the blade member 21 from the vibratable member 22 is important.

Since the blade member 21 is an elastic body by nature, the longer the distance is, the more attenuation is increased. Therefore, propagation characteristic of vibration to image carrier 11 largely depends on the length of the blade member 21 as a free end that is not bonded to the vibratable member 22. The fifteenth embodiment focuses an attention on this matter.

As illustrated in FIG. 44, it is understood from the experiment that if a projection amount (d) of the blade member 21 from the vibratable member 22 was smaller, propagation efficiency was better and significant degradation of the performance was not seen even if the blade member 21 was projected as far as an amount equivalent to the thickness (h) of the blade member 21. However, if the projection amount (d) was longer than that, the propagation performance was getting lower. Based on this fact, the projection amount is set to a value smaller than the blade thickness h in the fifteenth embodiment.

Figure 45:
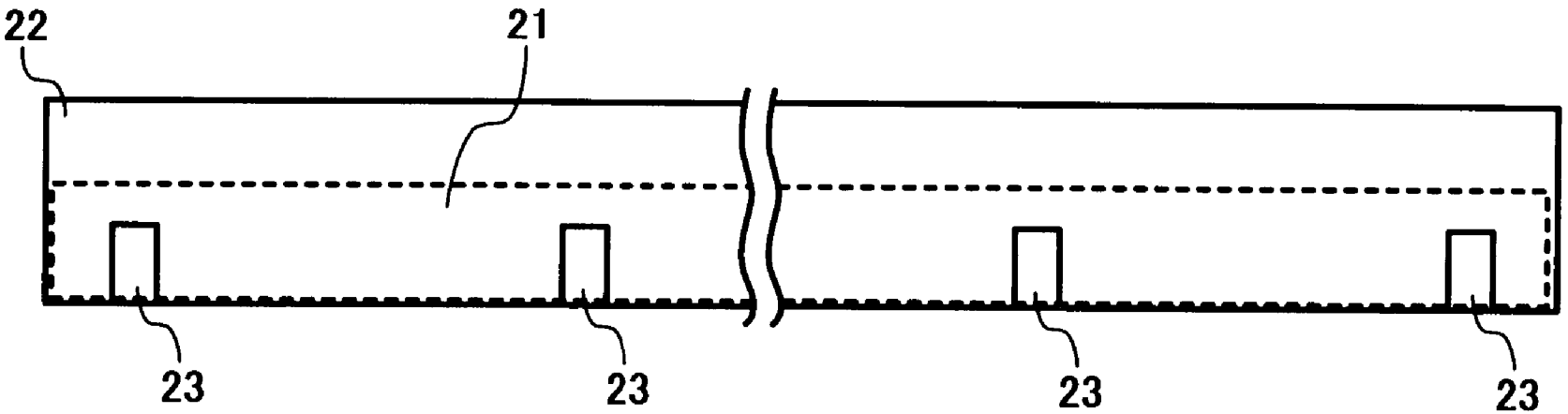
FIG. 45 is a plan view of installed vibrating units in the structure shown in FIG. 43.
Figure 46:
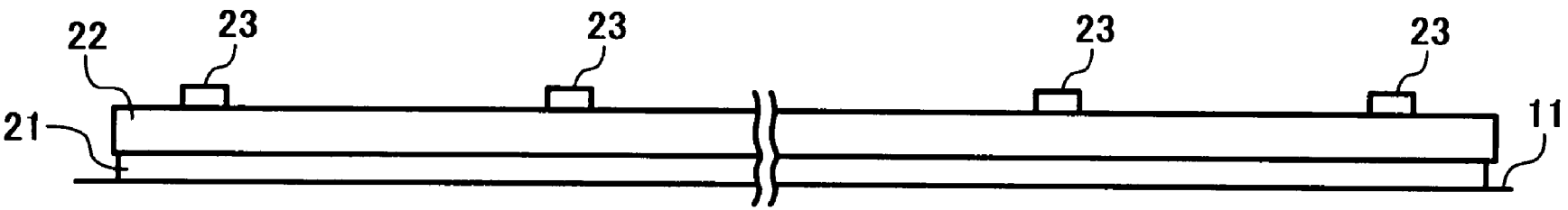
FIG. 46 is a front view of the installed vibrating units shown in FIG. 45.

The arrangement of the vibrating unit 23 provided on the vibratable member 22 can be employed as follows. As illustrated in FIGS. 45 and 46, a plurality of the vibrating units 23 are arranged on a plurality of positions on the vibratable member 22 close to the blade member 21 in the lateral direction of the vibratable member 22 in parallel with the longitudinal direction of the image carrier 11. The broken line in FIG. 45 indicates the blade member 21 fixed to the vibratable member 22. The blade member 21 vibrates with the aid of deflection of the vibratable member 22. Therefore, in the fifteenth embodiment, the vibrating unit 23 is provided on the surface of the vibratable member 22 that is opposite to the surface where the blade member 21 is provided so that vibration is easily propagated to the blade member 21.

As a sixteenth embodiment, a metal member is used for the vibratable member 22 from the viewpoint of vibration propagation and easy displacement (flexibility). As a material for the blade member 21, rubber such as polyurethane is used. Depending on a difference between such materials, a big difference occurs in specific acoustic resistances (ρc), and therefore vibration is largely attenuated when the vibration is propagated from a large acoustic resistance to a small acoustic resistance.

Referring to experiments on materials and specific acoustic resistances (g/s/cm$^2$), Iron: $270\times10^4$ (g/s/cm$^2$), Blade member (rubber): $1.4\times10^4$ (g/s/cm$^2$), and it is clear that iron is 190 times higher than rubber.

However, it is found from the experiments that the gap between the vibratable member 22 and the specific acoustic resistance can be largely reduced to six times by interposing a resin material: $44\times10^4$ (g/s/cm$^2$) between the two. In the sixteenth embodiment, a dissimilar member is inserted between the vibratable member 22 and the blade member 21 to reduce acoustic impedance along a vibration propagating direction and thereby prevent reduction in propagation efficiency.

Figure 47:
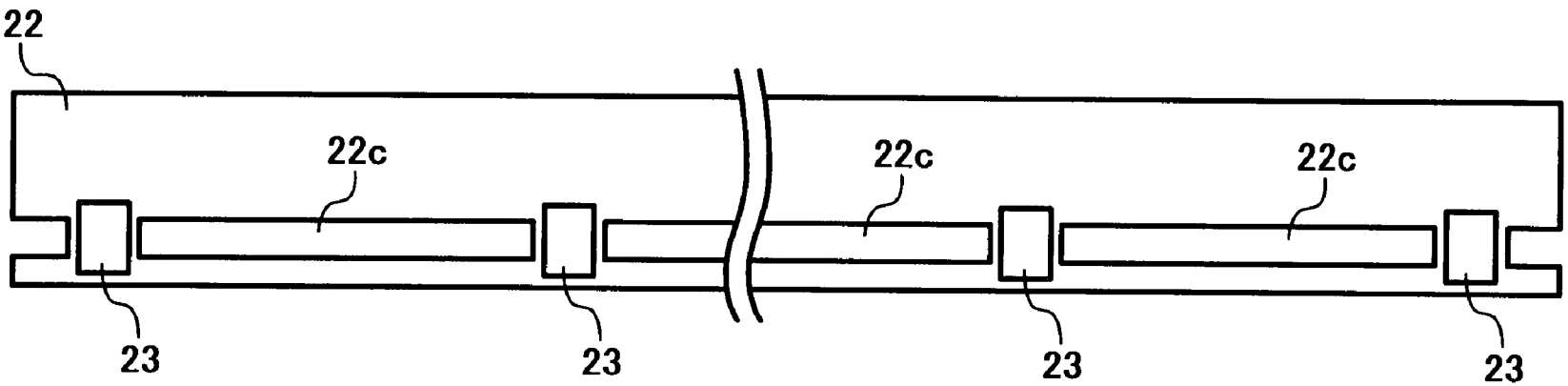
FIG. 47 illustrates a structure of a cleaning device according to a seventeenth embodiment of the present invention.

As a seventeenth embodiment, the vibratable member 22 can be structured so that deflection stiffness is made different according to a wall thickness of the member. As illustrated in FIG. 47, a lightening portion 22C that is partially punched can be also provided in the vibratable member 22 in the longitudinal direction of the image carrier 11. The vibratable member 22 having the lightening portions has a section modulus of a beam smaller in the lightening portion 22C than the other part of the vibratable member 22. Accordingly, the vibratable member 22 can easily be deflected to thereby enable enhancement of vibration propagation efficiency. The method of forming the lightening portion includes press working and etching process.

As an eighteenth embodiment, the cleaning device provided with the vibrating blade.20 including the blade member 21 and is applied to an image forming apparatus that can execute image forming process including process for the image carrier 11.

Figure 48:
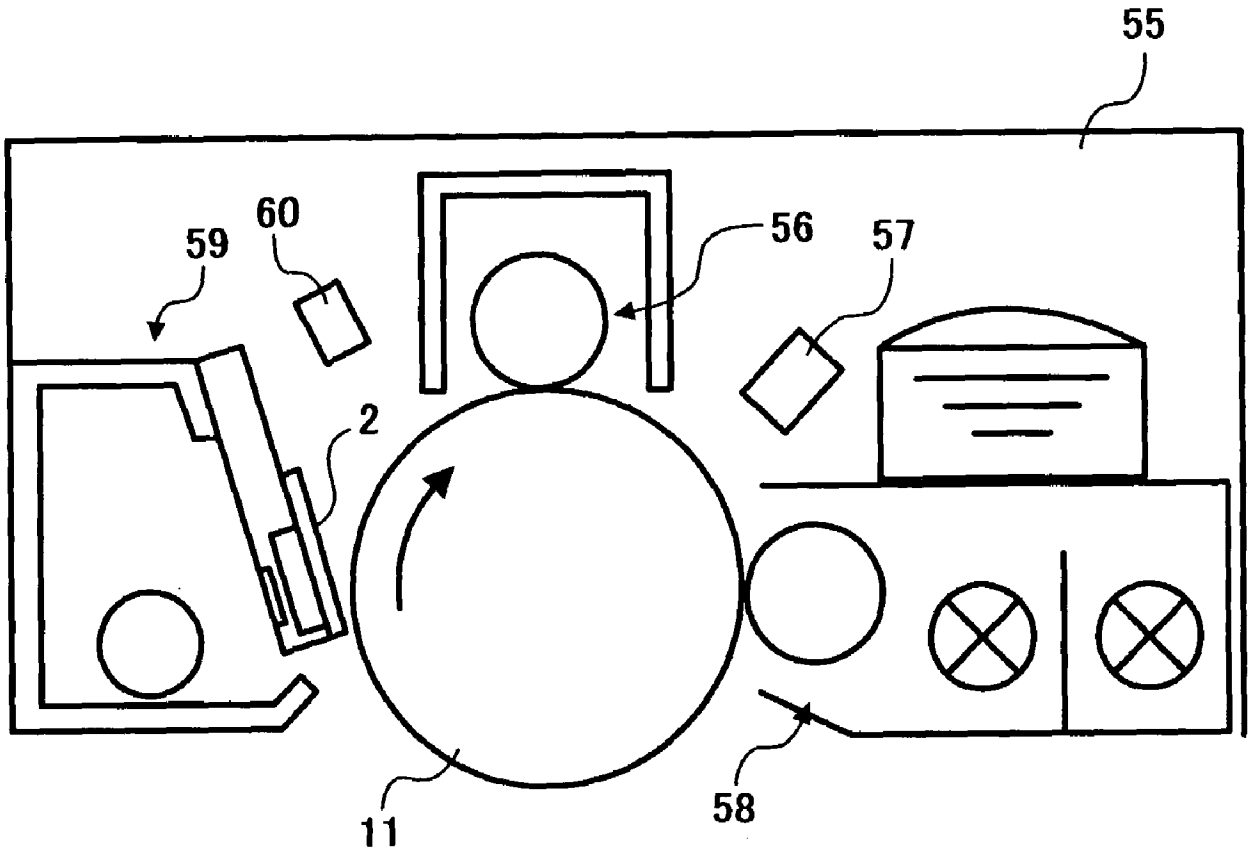
FIG. 48 illustrates a structure of a process cartridge according to an eighteenth embodiment.

FIG. 48 illustrates a structure using a drum-like photoreceptor as the image carrier 11. A charging member 56, a writing device 57, a developing device 58, a cleaning device 59, and a decharger 60 are arranged around the image carrier 11 along a rotating direction (direction indicated by arrow) of the image carrier 11. These devices are used for executing the image forming process. The devices are integrally accommodated in a process cartridge 55 that is formed with an image forming unit.

Figure 49A:
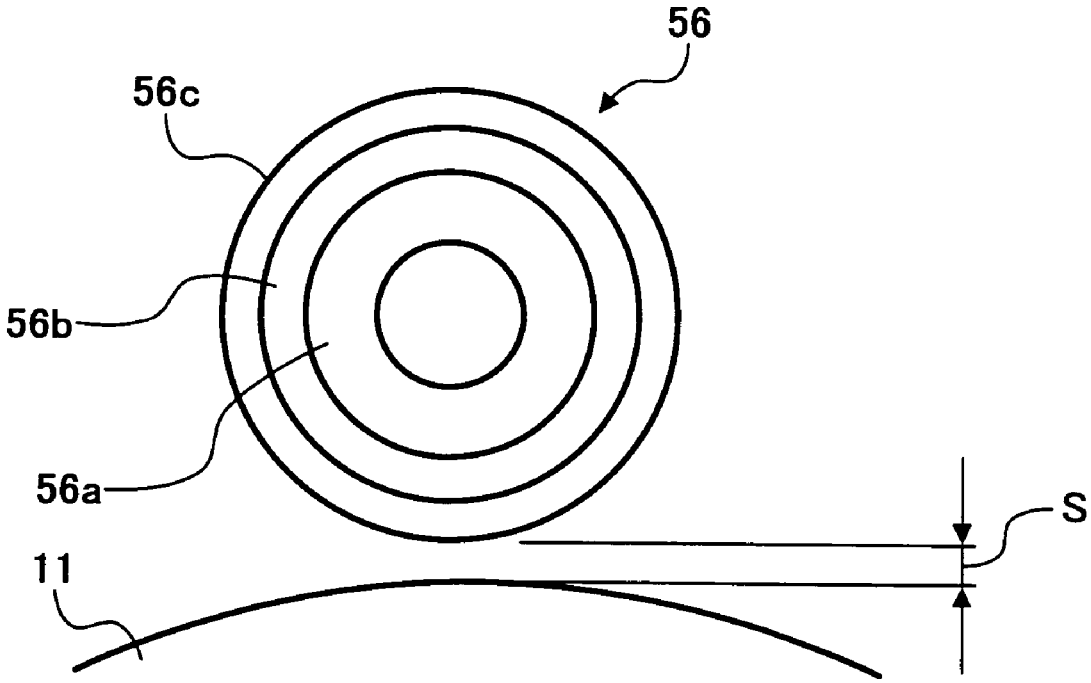
FIG. 49A and FIG. 49B illustrate a structure of a charging member used in the process cartridge shown in FIG. 48.
Figure 49B:
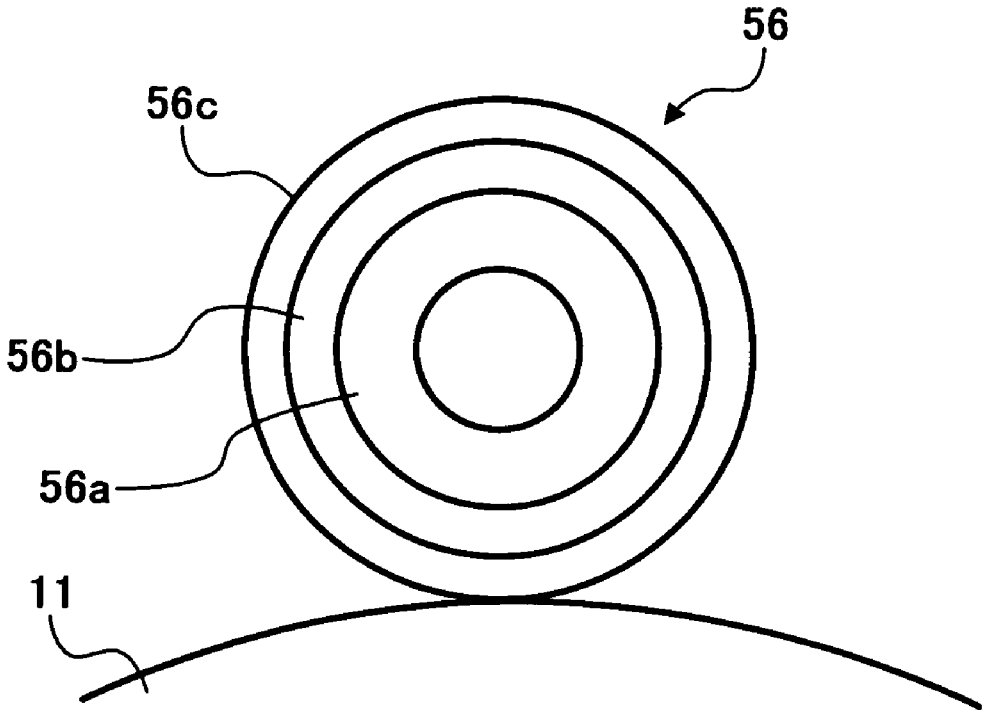
Figure 50:
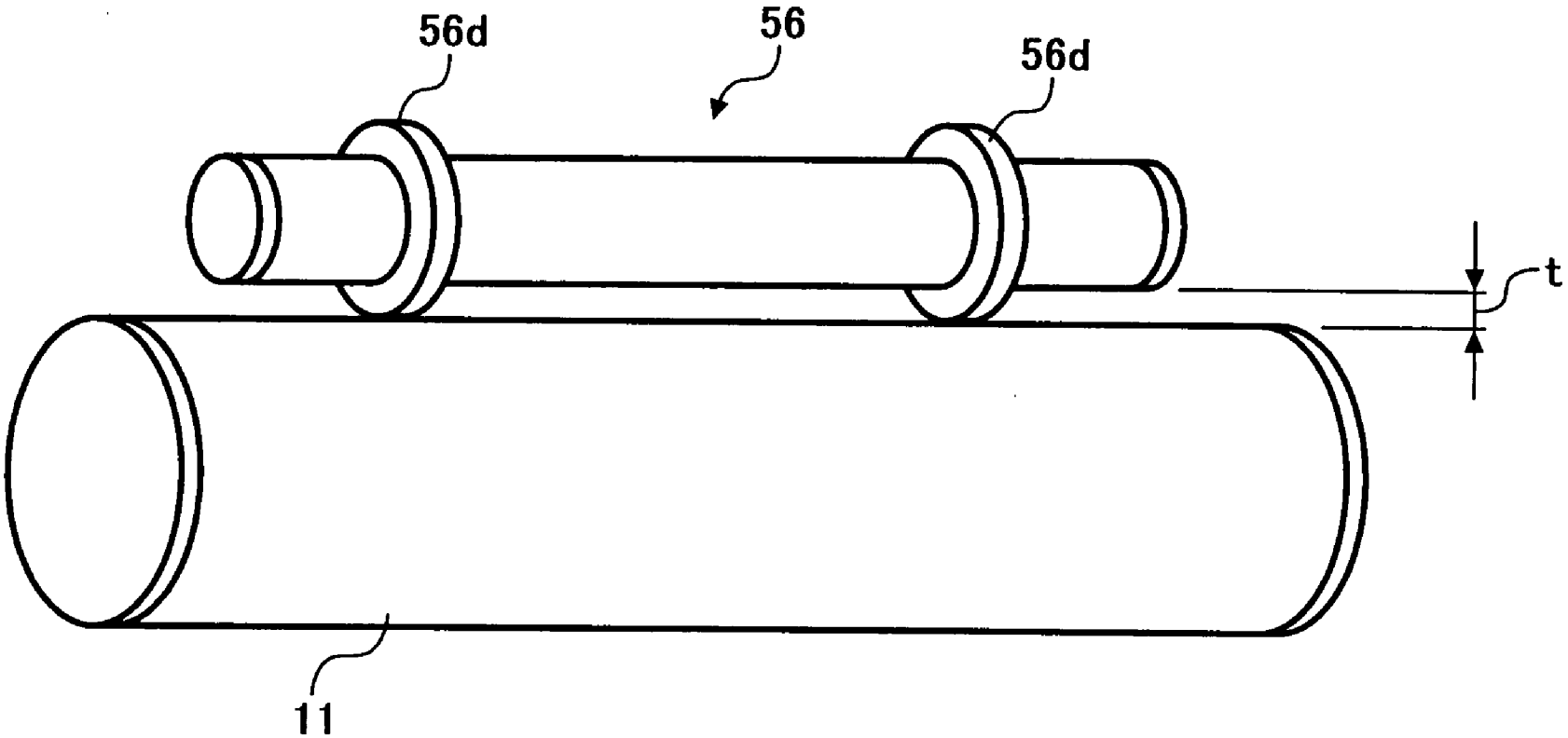
FIG. 50 illustrates a structural example of forming a gap of the charging member shown in FIG. 49.

A charging device used in the process cartridge 55 has, as illustrated in FIG. 49A and FIG. 49B, the charging member 56 formed with a roller that is provided close to the image carrier 11 (see FIG. 49A) or in contact with the image carrier 11 (see FIG. 49B). The charging member 56 is structured as follows.

As illustrated in FIG. 49A and FIG. 49B, the charging member 56 has a conductive base 56*a*, and a resistive layer 56*b* around the base 56*a*. The base 56*a* is an aluminum hollow cylinder having a diameter of about 10 to 50 millimeters and a thickness of about 2 to 5 millimeters. The resistive layer 56*b* is comprised of an epichlorohydrin rubber layer and a surface layer 56*c* made of resin covering the surface of the layer 56*b*. For the surface layer 56*c*, a resin tube may be used. The tube is made of a fluororesin as a main component such as ethylene tetrafluoride copolymer, polyvinylidene fluoride, and ethylene tetrafluoride perfluoro alkyl vinyl ether copolymer, with a thickness of about 30 to 100 micrometers and a surface roughness Rz of about 0.2 to 2 micrometers. In addition, any material may be used if the material can uniformly be charged.

The charging member 56 is disposed so as to be in contact with the surface of the image carrier 11 or in a non-contact state at a predetermined space S. The charging member 56 charges the image carrier 11 to a predetermined polarity at a predetermined potential by applying a bias to the conductive base 56*a*.

If the charging member 56 is disposed so as not to contact the image carrier 11, spacers 56*d* are provided on both ends thereof in the axial direction. By abutting the spacers 56*d* against non-image forming regions of both ends in the axial direction of the image carrier 11, the charging member is held in such a manner that a space t is formed between the surface to be charged as the surface of the image carrier 11 and a charging surface as the surface of the charging roller so that a distance at the closest position between the surfaces is 5 to 100 micrometers. This closest distance is more preferably set to 5 to 50 micrometers.

As the writing unit 57 in the process cartridge 55, an LD or an LED is used as a light-emitting device, and the device radiates the image carrier 11 with light based on image data to form an electrostatic latent image. The developing device 58 has an internally fixed magnet roller and a rotatable developer carrier on which developer is carried. In the eighteenth embodiment, a two-component magnetic brush development is used. This development uses a two-component developer consisting of toner and carrier as a developer. As another developing method, one-component developing method without using carrier may be used. The developer carrier is applied with a voltage from a developing bias power source. Charged toner is adhered to the electrostatic latent image in a developing region by using a potential difference between a developing bias and a potential of the latent image formed on the image carrier 11, and development is thereby performed.

Figure 51:
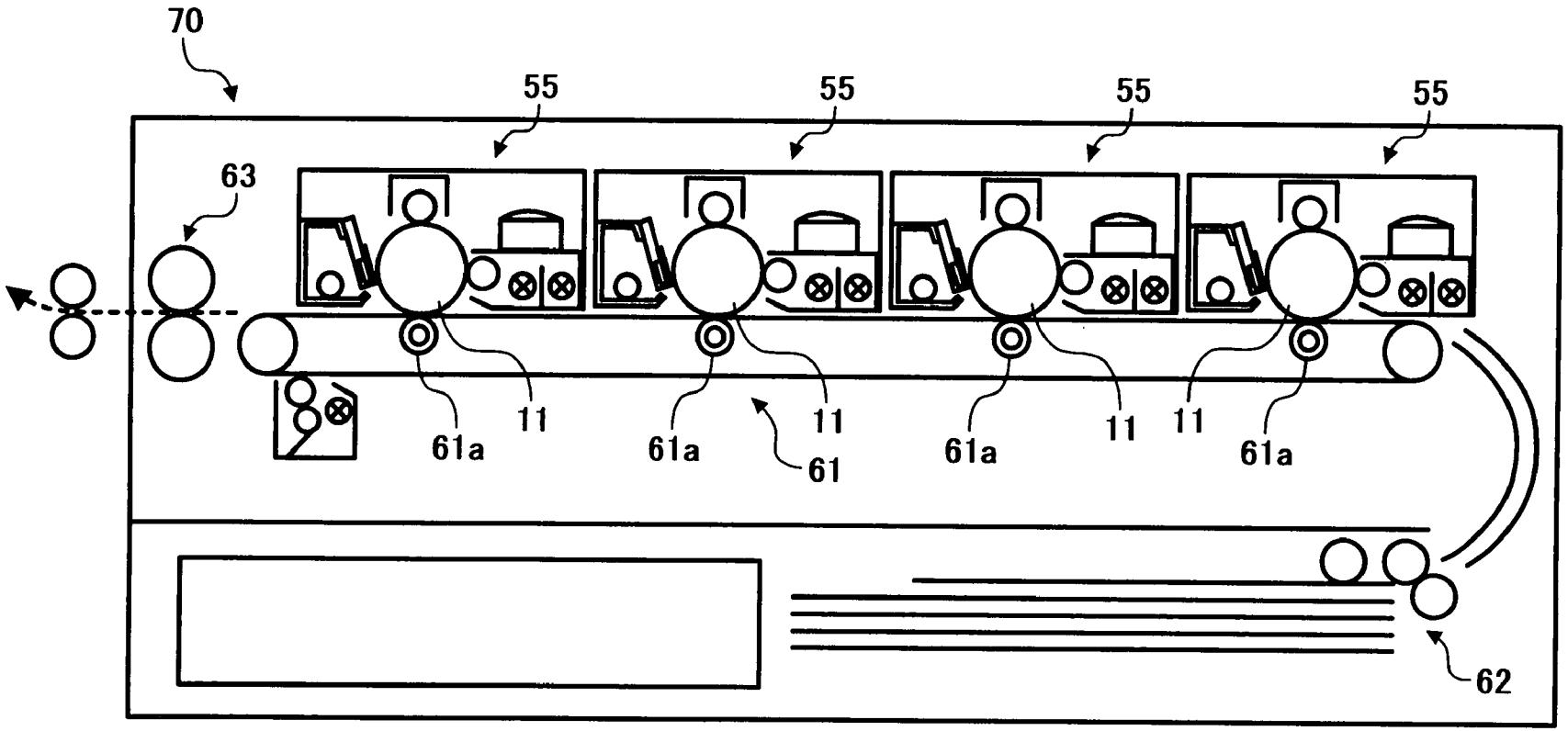
FIG. 51 illustrates a structure of the image forming apparatus to which the cleaning device according to the third embodiment is applied.

The process cartridge 55 is detachably provided in the image forming apparatus, and an example of the attachment is shown in FIG. 51. FIG. 51 illustrates an image forming apparatus 70 capable of forming a plurality of color images such as a full-color image, and the process cartridge 50 is structured to form images using developers of respective colors. The image forming apparatus 70 of FIG. 51 is provided with a transfer device 61 having a belt extending along positions facing the image carriers 11 of the process cartridges 55. During the process of transferring a sheet fed from a paper feeder 62 while the sheet faces the image carrier 11 of each of the process cartridges 55, images of respective colors are superposedly transferred on the sheet through transfer members 61*a* provided at positions facing the image carriers 11, respectively. After the image transfer process is finished, the image on the sheet is fixed by a fixing device 63, and the sheet is ejected.

When the image forming apparatus has the charging member 56 provided close to or in contact with the image carrier 11 in the charging device in particular, discharge product is innegligible. The discharge product increases a frictional coefficient on the surface of the image carrier 11. However, by using the cleaning device according to the embodiment, it is possible to reduce the influence of the discharge product on the frictional force and prevent faulty cleaning.

The inventors of the present invention measured, using the image forming apparatus shown in FIG. 51, the cleaning capability and the frictional force between the image carrier 11 and the blade member 21, evaluated if curling of the blade occurred, and obtained the results shown in table 5.

The charging and developing conditions were set as follows, and a time when evaluation was conducted was constant. As comparative examples, an ordinary cleaning blade (cleaning blade for Copier MF 200 produced by Ricoh Co., Ltd.) was used for evaluation in the same manner as explained above.

Condition for Evaluation

Rotational speed of image carrier: 100 mm/sec

Latent image carrier: Organic compound type photoreceptor (hereinafter, referred to as OPC), film thickness 30 micrometers Charging method: Scolotron charger, charging roller (a space with image carrier is zero and 50 μm)

Charge applying bias:

| | | |
|---|---|---|
| Contact type charging roller: | DC component | −900 V, |
| | AC component (Vpp) | 2.2 kV, |
| | Frequency | 1.5 kHz |
| Non-contact type charging roller: | DC component | −1,000 V, |
| | AC component (Vpp) | 2.4 kV, |
| | Frequency | 1.5 kHz |
| In either of the rollers, waveform is sinusoidal wave. | | |
| Scolotron charger: | Grid electrode | −900 V, |
| | wire electrode | −6 kV |
| Applied bias for development: | DC component | −500 V, |
| | AC component (Vpp) | 1.5 kV, |
| | Frequency | 2.2 kHz |
| Waveform is sinusoidal wave. | | |
| Environmental conditions: | Temperature | 23° C. |
| | Relative humidity | 50% |
| Blade member: Material polyurethane (JISA hardness as a bulk: about 70°) | Thickness | 0.2 mm |
| Vibration transmission (vibratable) | Thickness member (3): | 0.3 mm |
| Vibrating member (unit) (4): | Laminated type PZT | |
| Load (pressure at the edge part of blade member): | | 25 g/cm |

Method of Evaluation

An image pattern was prepared so that an amount of toner deposition on the photoreceptor is 0.1 (mg/cm$^2$), and determination was given based on a state obtained after the pattern was output by 1,00,000 sheets of A3-size paper in portrait orientation.

The cleaning capability was measured by Macbeth reflectivity densitometer RD 514 in the same manner as explained above, by transferring toner (residual tone after transfer) on the surface of the photoreceptor as the image carrier 11 onto a white paper using Scotch tape (produced by Sumitomo 3M Ltd.). If a difference between the white paper with the residual toner transferred and a blank (only the scotch tape was adhered on the white paper) was 0.01 or less, then the cleaning was sufficiently performed ("hollow circle" is described in tables for evaluation results). If the difference exceeded 0.01 (high density), the cleaning was insufficiently performed, and a cross (no good) is described therein.

Figure 52:
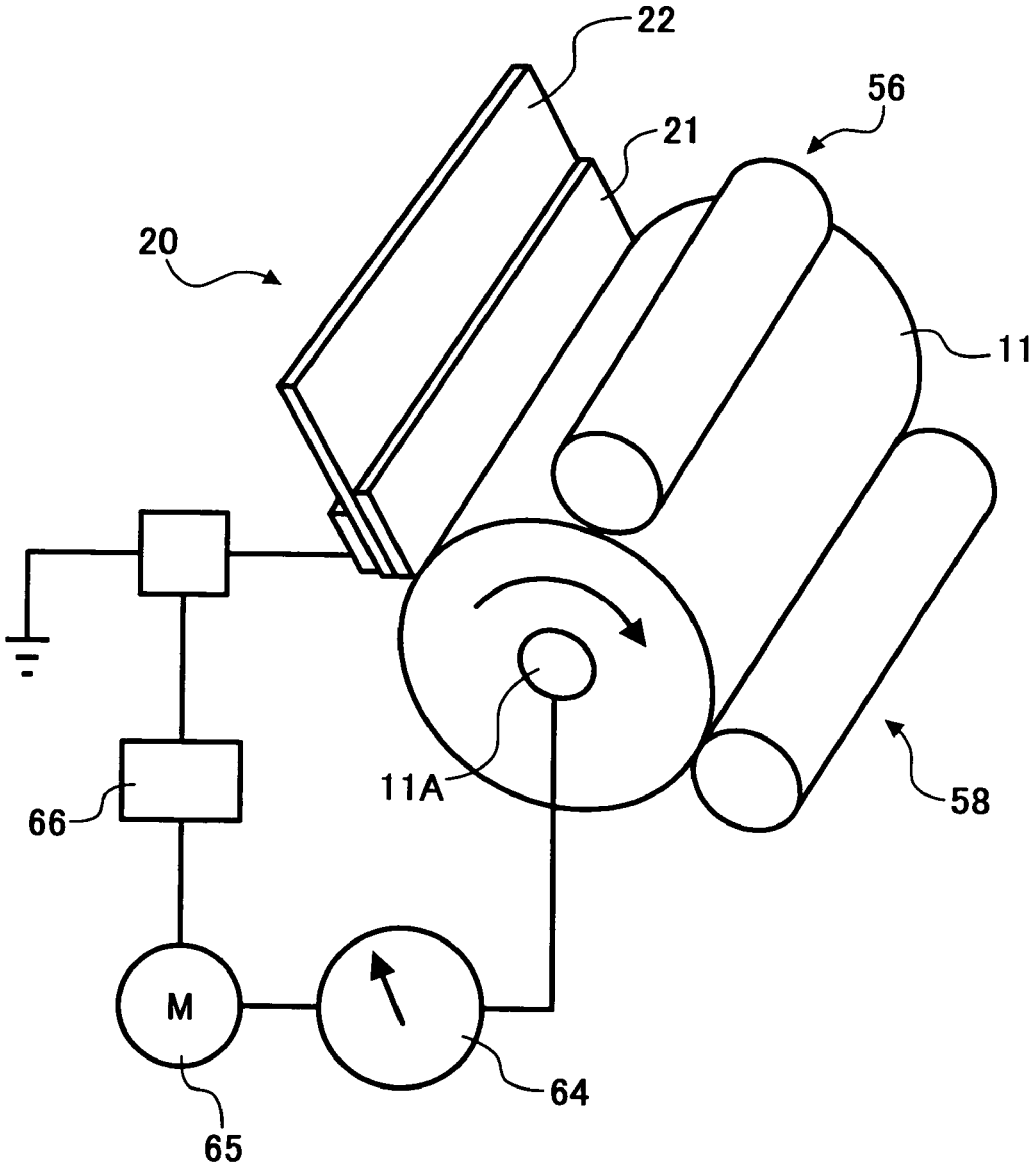
FIG. 52 illustrates a structure of vibration control of the vibrating blade used in the cleaning device according to the third embodiment.
Figure 53:
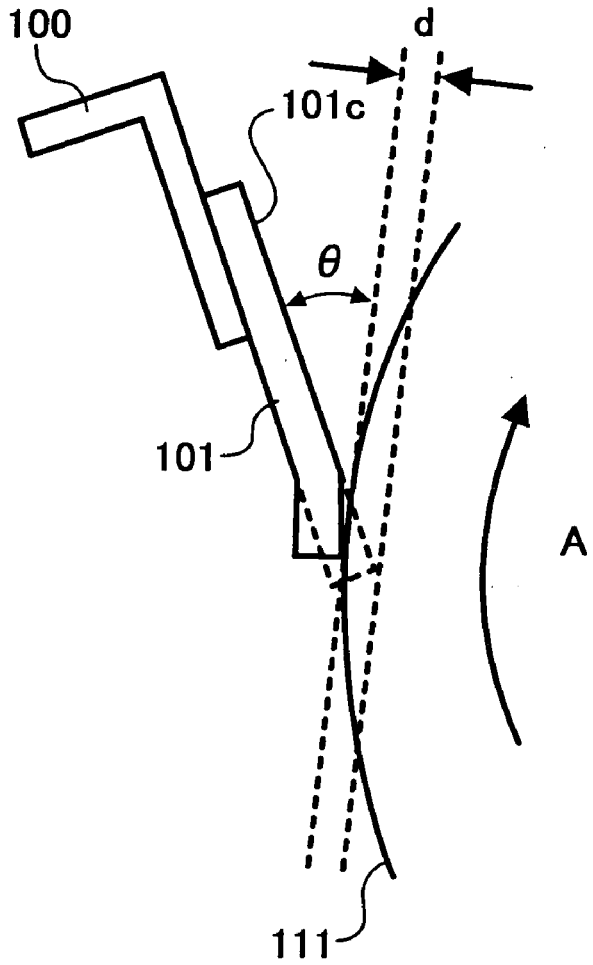
BACKGROUND ART FIG. 53
FIG. 53 illustrates a contact condition of a conventional doctor blade of a counter type with respect to the image carrier when this doctor blade is used.

Frictional force between the image carrier 11 and the blade member 21 was measured by fixing a rotational torque meter 64 to a shaft 11A of the drum-like image carrier 11 fixed to the image forming apparatus as illustrated in FIG. 52, and measuring torque during rotational operation. If the torque was higher than the initial value, then "cross" is described, and if the torque was lower than the initial value, then "hollow circle" is described.

Curling of the blade member 21 was measured by using "squeaking" as substantial characteristics that was produced due to "abnormal stick-slip phenomenon" as a state where curling of the blade easily occurred.

TABLE 5

After 1,00,000 sheets were output in portrait orientation of A3-size paper.

| Cleaning method | Charging method | Measurement of torque | Cleaning capability | Curling of blade |
|---|---|---|---|---|
| Charging | Contact type charging roller | x | x | ○ |
| | Non-contact type charging roller | x | x | x |
| | Scolotron charger | x | ○ | ○ |
| Vibrating | Contact type charging roller | ○ | ○ | ○ |
| | Non-contact type charging roller | ○ | ○ | ○ |
| | Scolotron charger | ○ | ○ | ○ |

Referring to the results of the table 5, a value of torque read from the torque meter 64 fixed to the image carrier 11 and a drive current of the DC motor 65 are provided to be set so that these values are fed-back based on the previously set image forming conditions (amount of toner consumption, environments, number of sheets to be printed). The feedback is realized by changing a voltage applied to the piezoelectric element through a CPU substrate that controls operation of the image forming apparatus and an operation sequencer 66. Therefore, the piezoelectric element capable of electrically changing the magnitude of vibration is the most appropriate in the viewpoint of easy control and cost reduction.

A ratio of the image area can be grasped when image data is input into the CPU substrate, and vibrating conditions of the blade member 21 can be changed previously. Therefore, it is possible to set cleaning conditions to optimal ones for controlling the frictional force or rotational torque and drive current when the DC motor 65 is used. Further, if environmental conditions are changed, the blade member 21 is deformed due to the change, and this causes an abutting condition of the blade member 21 to change. Therefore, it is predicted that the frictional force, rotational torque, and DC motor drive current may be changed, and therefore by monitoring these values according to environmental changes and setting the values to appropriate vibrating conditions, optimal cleaning can also be performed.

As explained above, by changing a drive bias for the piezoelectric element, it is possible to reduce the frictional force, rotational torque, and DC motor drive current, and perform cleaning under optimal conditions even if any of conditions are changed.

The present document incorporates by reference the entire contents of Japanese priority documents, 2002-265076 filed in Japan on Sep. 11, 2002, 2002-272963 filed in Japan on Sep. 19, 2002, 2002-276613 filed in Japan on Sep. 24, 2002 and 2003-075939 filed in Japan on Mar. 19, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cleaning device for cleaning toner from an image carrier that carries a toner image made of toner, comprising:

a blade member having an end, wherein the end touches a surface of the image carrier and scrapes off toner from the surface;

a vibratable member configured to flex in a direction of flexure, and to which the blade member is fixed; and a vibrating unit that vibrates the vibratable member in the direction of flexure so that the end of the blade member does not curl toward the image carrier.

2. The cleaning device according to claim 1, wherein the blade member has a length, and the blade member is situated such that length of the blade member is parallel to an axis of rotation of the image carrier and the blade member makes an acute angle with a tangent to the surface of the image carrier in a direction of rotation of the image carrier.

3. The cleaning device according to claim 1, wherein the angle is between 0 degree and 50 degrees.

4. The cleaning device according to claim 1, wherein the vibratable member presses the blade member against the image carrier.

5. The cleaning device according to claim 1, wherein the vibrating unit is a piezoelectric element.

6. The cleaning device according to claim 5, wherein the piezoelectric element is plate-like and fixed to the vibratable member.

7. The cleaning device according to claim 6, wherein the piezoelectric element expands and contracts to thereby vibrate the vibratable member.

8. The cleaning device according to claim 6, wherein the piezoelectric element has an electrode, and the electrode is electrically connected to the vibratable member.

9. The cleaning device according to claim 5, wherein the vibratable member has a fixed end and a free end, and the piezoelectric element is fixed to the vibratable member between the fixed end and the free end.

10. The cleaning device according to claim 5, wherein the piezoelectric element is a laminated type piezoelectric element that displaces the vibratable member in a laminating direction as d-33 direction.

11. The cleaning device according to claim 5, wherein the piezoelectric element is a laminated type piezoelectric element that displaces the vibratable member in a face direction as d-31 direction, wherein the face direction is a direction perpendicular to the laminating direction.

12. The cleaning device according to claim 1, wherein the vibrating unit is fixed to the vibratable member, and the vibratable member is stiffer in a portion where the blade member is fixed than in a portion where the vibrating unit is fixed.

13. The cleaning device according to claim 1, wherein the vibrating unit is fixed to the vibratable member, the vibratable member is stiffer than the blade member, and a distance between the end of the blade member and an end of the blade member is between one to two times a thickness of the blade member.

14. The cleaning device according to claim 1, wherein the vibrating unit is fixed to the vibratable member, the vibratable member is stiffer than the blade member, the vibratable member having an end, wherein the end of the blade member and the end of the vibratable member are at same level or the end of the blade member protrudes towards the image carrier more than the end of the vibratable member.

15. The cleaning device according to claim 1, wherein a plurality of the vibrating units are arranged at predetermined interval along a width of the vibratable member.

16. The cleaning device according to claim 15, further comprising a drive circuit that drives the vibrating units.

17. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; a vibrating unit that vibrates the vibratable member so that the end of the blade member does not curl toward the image carrier; and a force imparting unit that imparts pressing force to the vibratable member to thereby press the end of the blade member against the image carrier.

18. A process cartridge comprising:

an image carrier that carries a toner image made of toner; and a cleaning unit having a blade member having an end, wherein the end touches a surface of the image carrier and scrapes off toner from the surface;

a vibratable member configured to flex in a direction of flexure, and to which the blade member is fixed; and a vibrating unit that vibrates the vibratable member in the direction of flexure so that the end of the blade member does not curl toward the image carrier.

19. An image forming apparatus comprising:

an image carrier that carries a toner image made of toner; and a cleaning unit having a blade member having an end, wherein the end touches a surface of the image carrier and scrapes off toner from the surface;

a vibratable member configured to flex in a direction of flexure, and to which the blade member is fixed; and a vibrating unit that vibrates the vibratable member in the direction of flexure so that the end of the blade member does not curl toward the image carrier.

20. An image forming apparatus comprising a plurality of process cartridges, each process cartridge including an image carrier that carries a toner image made of toner;

a charging unit that electrically charges the image carrier;

a developing unit that develops the toner images on the image carrier;

a transfer unit that transfers the developed toner image onto a recording medium; and a cleaning unit having a blade member having an end, wherein the end touches a surface of the image carrier and scrapes off toner from the surface;

a vibratable member configured to flex in a direction of flexure, and to which the blade member is fixed; and a vibrating unit that vibrates the vibratable member in the direction of flexure so that the end of the blade member does not curl toward the image carrier.

21. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member configured to flex in a direction of flexure, and to which the blade member is fixed; and a vibrating unit that, after the toner image is transferred onto the recording medium, vibrates the vibratable member in the direction of flexure so that the end of the blade member vibrates to thereby clean toner remaining on the image carrier and so that the blade does not curl toward the image carrier.

22. The image forming apparatus according to claim 21, wherein the toner is produced by a polymerization method.

23. The image forming apparatus according to claim 21, wherein the end of the blade member is formed with a material having less affinity for the toner than another portion of the blade member.

24. The image forming apparatus according to claim 21, wherein an external additive is added to the toner, and the first end of the blade member is formed with a material having less affinity for the external additive than other portion of the blade member.

25. The image forming apparatus according to claim 21, wherein amplitude of vibrations of the end of the blade member is smaller than an average particle size of the toner.

26. The image forming apparatus according to claim 21, wherein the vibrating unit is a piezoelectric element.

27. The image forming apparatus according to claim 26, further comprising a voltage applying unit that applies an alternating voltage to the piezoelectric element.

28. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which the blade member is fixed; and a vibrating unit that, after the toner image is transferred onto the recording medium, vibrates the vibratable member so that the end of the blade member vibrates to thereby clean toner remaining on the image carrier and so that the blade does not curl toward the image carrier, wherein amplitude of vibrations of the end of the blade member can be set as desired.

29. The image forming apparatus according to claim 28, further comprising an amplitude controlling unit that electrically controls the amplitude of vibrations of the end of the blade member.

30. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which the blade member is fixed;

a vibrating unit that, after the toner image is transferred onto the recording medium, vibrates the vibratable member so that the end of the blade member vibrates to thereby clean toner remaining on the image carrier and so that the blade does not curl toward the image carrier, and an amplitude controlling unit that changes amplitude of vibrations of the end of the blade member when the toner image is being formed and when toner image is not being formed.

31. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which the blade member is fixed;

a vibrating unit that, after the toner image is transferred onto the recording medium, vibrates the vibratable member so that the end of the blade member vibrates to thereby clean toner remaining on the image carrier and so that the blade does not curl toward the image carrier, and an amplitude controlling unit that changes amplitude of vibrations of the end of the blade member based on at least one of an amount of toner deposited on the image carrier, number of images formed, environmental conditions, and an amount of toner replenished.

32. A cleaning device comprising:

a blade member having an end, wherein the end touches a surface of an image carrier that carries a toner image made of toner having sphericity of 0.96 to 1.00 based on a flow type particle image analyzer;

a vibratable member configured to flex in a direction of flexure, and to which the blade member is fixed; and a vibrating unit that vibrates the vibratable member in the direction of flexure so that the end of the blade member vibrates to thereby clean the toner on the image carrier and so that the blade does not curl toward the image carrier.

33. The cleaning device according to claim 32, wherein the toner is produced by a polymerization method.

34. The cleaning device according to claim 32, wherein the end of the blade member is formed with a material having less affinity for the toner than other portion of the blade member.

35. The cleaning device according to claim 32, wherein an external additive is added to the toner, and the end of the blade member is formed with a material having less affinity for the external additive than other portion of the blade member.

36. The cleaning device according to claim 32, wherein amplitude of vibrations of the end of the blade member is smaller than an average particle size of the toner.

37. The cleaning device according to claim 32, wherein the vibrating unit is a piezoelectric element.

38. The cleaning device according to claim 33, wherein amplitude of vibrations of the end of the blade member can be set as desired.

39. The cleaning device according to claim 34, wherein amplitude of vibrations of the end of the blade member can be set as desired.

40. The cleaning device according to claim 35, wherein amplitude of vibrations of the end of the blade member can be set as desired.

41. The cleaning device according to claim 36, wherein amplitude of vibrations of the end of the blade member can be set as desired.

42. The cleaning device according to claim 37, further comprising a voltage applying unit that applies an alternating voltage to the piezoelectric element.

43. The cleaning device according to claim 38, further comprising an amplitude controlling unit that electrically controls the amplitude of vibrations of the end of the blade member.

44. The cleaning device according to claim 39, further comprising an amplitude controlling unit that electrically controls the amplitude of vibrations of the end of the blade member.

45. The cleaning device according to claim 40, further comprising an amplitude controlling unit that electrically controls the amplitude of vibrations of the end of the blade member.

46. The cleaning device according to claim 41, further comprising an amplitude controlling unit that electrically controls the amplitude of vibrations of the end of the blade member.

47. A process cartridge comprising:

an image carrier that carries a toner image made of toner; and a cleaning unit having a blade member having an end, wherein the end touches a surface of an image carrier that carries a toner image made of toner having sphericity of 0.96 to 1.00 based on a flow type particle image analyzer;

a vibratable member configured to flex in a direction of flexure, and to which the blade member is fixed; and a vibrating unit that vibrates the vibratable member in the direction of flexure so that the end of the blade member vibrates to thereby clean the toner on the image carrier and so that the blade does not curl toward the image carrier.

48. An image forming apparatus comprising a plurality of process cartridges, each process cartridge including an image carrier that carries a toner image made of toner;

a charging unit that electrically charges the image carrier;

a developing unit that develops the toner images on the image carrier;

a transfer unit that transfers the developed toner image onto a recording medium; and a cleaning unit having a blade member having an end, wherein the end touches a surface of an image carrier that carries a toner image made of toner having sphericity of 0.96 to 1.00 based on a flow type particle image analyzer;

a vibratable member configured to flex in a direction of flexure, and to which the blade member is fixed; and a vibrating unit that vibrates the vibratable member in the direction of flexure so that the end of the blade member vibrates to thereby clean the toner on the image carrier and so that the blade does not curl toward the image carrier.

49. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein the vibrating unit is a piezoelectric element, wherein the piezoelectric element is plate-like and fixed to the vibratable member, wherein the piezoelectric element has an electrode, and the electrode is electrically connected to the vibratable member.

50. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein the vibrating unit is a piezoelectric element, wherein the vibratable member has a fixed end and a free end, and the piezoelectric element is fixed to the vibratable member between the fixed end and the free end.

51. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein the vibrating unit is a piezoelectric element, wherein the piezoelectric element is a laminated type piezoelectric element that displaces the vibratable member in a laminating direction as d-33 direction.

52. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein the vibrating unit is fixed to the vibratable member, and the vibratable member is stiffer in a portion where the blade member is fixed than in a portion where the vibrating unit is fixed.

53. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein the vibrating unit is fixed to the vibratable member, the vibratable member is stiffer than the blade member, and a distance between the end of the blade member and an end of the blade member is between one to two times a thickness of the blade member.

54. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein the vibrating unit is fixed to the vibratable member, the vibratable member is stiffer than the blade member, the vibratable member having an end, wherein the end of the blade member and the end of the vibratable member are at same level or the end of the blade member protrudes towards the image carrier than the end of the vibratable member.

55. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member so that the end of the blade member does not curl, wherein a plurality of the vibrating units are arranged at predetermined interval along a width of the vibratable member.

56. The cleaning device according to claim 55, further comprising a drive circuit that drives the vibrating units.

57. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which to the blade member is fixed; and a vibrating unit that, after the toner image is transferred onto the recording medium, vibrates the vibratable member so that the end of the blade member vibrates to thereby clean toner remaining on the image carrier and so that the blade does not curl, wherein the end of the blade member is formed with a material having less affinity for the toner than other portion of the blade member.

58. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which to the blade member is fixed; and a vibrating unit that, after the toner image is transferred onto the recording medium, vibrates the vibratable member so that the end of the blade member vibrates to thereby clean toner remaining on the image carrier and so that the blade does not curl, wherein an external additive is added to the toner, and the first end of the blade member is formed with a material having less affinity for the external additive than other portion of the blade member.

59. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which to the blade member is fixed; and a vibrating unit that, after the toner image is transferred onto the recording medium, vibrates the vibratable member so that the end of the blade member vibrates to thereby clean toner remaining on the image carrier wherein amplitude of vibrations of the end of the blade member is smaller than an average particle size of the toner.

60. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member configured to flex in a direction of flexure, and to which to the blade member is fixed;

a vibrating unit that, after the toner image is transferred onto the recording medium, vibrates the vibratable member in the direction of flexure so that the end of the blade member vibrates to thereby clean toner remaining on the image carrier, wherein the vibrating unit is a piezoelectric element, and a voltage applying unit that applies an alternating voltage to the piezoelectric element.

61. An image forming apparatus, in which a latent image is formed on an image carrier, the latent image is developed with a toner having sphericity of 0.96 to 1.00 based on a flow type particle image analyzer (FPIA), the toner image is transferred onto a recording medium, the image forming apparatus comprising:

a blade member having an end, wherein the end touches a surface of the image carrier;

a vibratable member to which to the blade member is fixed;

a vibrating unit that, after the toner image is transferred onto the recording medium, vibrates the vibratable member so that the end of the blade member vibrates to thereby clean toner remaining on the image carrier, and an amplitude controlling unit that changes amplitude of vibrations of the end of the blade member when the toner image is being formed and when toner image is not being formed.

62. A cleaning device comprising:

a blade member having an end, wherein the end touches a surface of an image carrier that carries a toner image made of toner having sphericity of 0.96 to 1.00 based on a flow type particle image analyzer;

a vibratable member to which the blade member is fixed; and a vibrating unit that vibrates the vibratable member so that the end of the blade member vibrates to thereby clean the toner on the image carrier, wherein the end of the blade member is formed with a material having less affinity for the toner than other portion of the blade member.

63. The cleaning device according to claim 62, wherein amplitude of vibrations of the end of the blade member can be set as desired.

64. The cleaning device according to claim 63, further comprising an amplitude controlling unit that electrically controls the amplitude of vibrations of the end of the blade member.

65. A cleaning device comprising:

a blade member having an end, wherein the end touches a surface of an image carrier that carries a toner image made of toner having sphericity of 0.96 to 1.00 based on a flow type particle image analyzer;

a vibratable member to which the blade member is fixed; and a vibrating unit that vibrates the vibratable member so that the end of the blade member vibrates to thereby clean the toner on the image carrier, wherein an external additive is added to the toner, and the end of the blade member is formed with a material having less affinity for the external additive than other portion of the blade member.

66. The cleaning device according to claim 65, wherein amplitude of vibrations of the end of the blade member can be set as desired.

67. The cleaning device according to claim 66, further comprising an amplitude controlling unit that electrically controls the amplitude of vibrations of the end of the blade member.

68. A cleaning device comprising:

a blade member having an end, wherein the end touches a surface of an image carrier that carries a toner image made of toner having sphericity of 0.96 to 1.00 based on a flow type particle image analyzer;

a vibratable member to which the blade member is fixed; and a vibrating unit that vibrates the vibratable member so that the end of the blade member vibrates to thereby clean the toner on the image carrier, wherein amplitude of vibrations of the end of the blade member is smaller than an average particle size of the toner.

69. The cleaning device according to claim 68, wherein amplitude of vibrations of the end of the blade member can be set as desired.

70. The cleaning device according to claim 69, further comprising an amplitude controlling unit that electrically controls the amplitude of vibrations of the end of the blade member.

71. A cleaning device comprising:

a blade member having an end, wherein the end touches a surface of an image carrier that carries a toner image made of toner having sphericity of 0.96 to 1.00 based on a flow type particle image analyzer;

a vibratable member configured to flex in a direction of flexure, and to which the blade member is fixed; and a vibrating unit that vibrates the vibratable member in the direction of flexure so that the end of the blade member vibrates to thereby clean the toner on the image carrier, wherein the vibrating unit is a piezoelectric element, and further comprising a voltage applying unit that applies an alternating voltage to the piezoelectric element.

72. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member at a frequency of between 17 kilohertz and 50 kilohertz so that the end of the blade member does not curl.

73. A cleaning device for cleaning toner from an image carrier that carries a toner image made of toner, comprising:

a blade member having an end, wherein the end touches a surface of the image carrier and scrapes off toner from the surface;

a vibratable member to which the blade member is fixed; and a vibrating unit that vibrates the vibratable member at a frequency of at least 1.5 kilohertz so that the end of the blade member does not curl.

74. A cleaning device for cleaning toner from an image carrier that carries a toner image made of toner, comprising:

a blade member which is made of elastic material having an end, wherein the end touches a surface of the image carrier and scrapes off toner from the surface;

a vibratable member to which the blade member is fixed; and a vibrating unit that vibrates the vibratable member so that the end of the blade member does not curl toward the image carrier.

75. The cleaning device according to claim 74, wherein the elastic material comprises polyurethane rubber.

* * * * *